US011330897B2

(12) United States Patent
Byrne et al.

(10) Patent No.: US 11,330,897 B2
(45) Date of Patent: May 17, 2022

(54) PAINT BRUSH WITH INTEGRATED HANGER AND PACKAGING THEREFOR

(71) Applicant: The Wooster Brush Company, Wooster, OH (US)

(72) Inventors: James M. Byrne, Wooster, OH (US); John L. Scott, Sr., Wooster, OH (US); Matthew Joseph Doerfler, Wooster, OH (US); Scott A. Melegari, West Salem, OH (US); Everett A. Crosby, Homerville, OH (US)

(73) Assignee: The Wooster Brush Company, Wooster, OH (US)

( * ) Notice: Subject to any disclaimer, the term of this patent is extended or adjusted under 35 U.S.C. 154(b) by 125 days.

(21) Appl. No.: 16/825,483

(22) Filed: Mar. 20, 2020

(65) Prior Publication Data

US 2020/0305591 A1 Oct. 1, 2020

Related U.S. Application Data

(60) Provisional application No. 62/823,838, filed on Mar. 26, 2019, provisional application No. 62/889,255, (Continued)

(51) Int. Cl.
*A46B 17/02* (2006.01)
*A46B 15/00* (2006.01)
(Continued)

(52) U.S. Cl.
CPC ..... *A46B 17/02* (2013.01); *A46B 15/0097* (2013.01); *A46B 17/04* (2013.01); (Continued)

(58) Field of Classification Search
CPC ..... A46B 17/02; A46B 17/04; A46B 5/021; A46B 5/026; A46B 15/0097; A46B 2200/202; F16B 45/02; B44D 3/123
See application file for complete search history.

(56) References Cited

U.S. PATENT DOCUMENTS 888,896 A 5/1908 Howard
1,206,010 A 11/1916 MacKeever
(Continued)

OTHER PUBLICATIONS

Photographs of a paint brush prototype received by Applicant in Oct. 2018, which relate to the description in U.S. Pat. No. 10,051,952 (Aide).

*Primary Examiner* — Laura C Guidotti
(74) *Attorney, Agent, or Firm* — Renner, Otto, Boisselle & Sklar LLP

(57) ABSTRACT

A paint brush having a handle with an integrated hanger that is pivotably movable between a retracted position for stowing the hanger within a groove of the handle, and an extended position for extending the hanger outwardly from the groove to hang the paint brush on an object. When stowed in the retracted position the hanger may be flush with an outer surface of the handle to enhance the ergonomic design. The hanger and groove may be configured to enable ease of deployment of the hanger from the retracted to extended position simply with a one-handed operation. The portion of the handle having the groove may be made of a flexible material which may better secure the hanger in the groove when stowed and/or may facilitate installation of the hanger. The handle may include a grip portion having the flexible material which is over-molded onto a rigid head portion.

22 Claims, 40 Drawing Sheets

Related U.S. Application Data filed on Aug. 20, 2019, provisional application No. 62/966,248, filed on Jan. 27, 2020.

(51) Int. Cl.

| | |
|---|---|
| ***B65D 73/00*** | (2006.01) |
| ***A46B 17/04*** | (2006.01) |
| *B44D 3/12* | (2006.01) |
| *A46D 3/00* | (2006.01) |

(52) U.S. Cl.

CPC .... *B65D 73/0085* (2013.01); *A46B 2200/202* (2013.01); *A46D 3/00* (2013.01); *B44D 3/123* (2013.01)

(56) References Cited

U.S. PATENT DOCUMENTS

| | | | | |
|---|---|---|---|---|
| 1,215,052 | A | 2/1917 | Nelson | |
| 1,228,774 | A | 6/1917 | Hecht | |
| 1,277,019 | A | 8/1918 | Wright | |
| 1,289,171 | A | 12/1918 | Hilton | |
| 1,313,515 | A | 8/1919 | Caffrey | |
| 1,713,077 | A | 5/1929 | Frizl | |
| 3,131,919 | A | 5/1964 | Hartley | |
| 3,612,464 | A | 10/1971 | Harrah | |
| 4,746,042 | A | 5/1988 | King | |
| 5,044,038 | A | 9/1991 | Matkovic | |
| 5,087,014 | A | 2/1992 | Desjardin | |
| 5,406,668 | A | 4/1995 | Goodhue | |
| 6,244,559 | B1 | 6/2001 | Stanton | |
| 6,408,474 | B1 | 6/2002 | Husted | |
| 6,966,100 | B2 | 11/2005 | Sonne | |
| D654,783 | S | 2/2012 | Warren | |
| 10,021,966 | B2 | 7/2018 | Ortiz | |
| 10,051,952 | B2 | 8/2018 | Aide | |
| 10,806,245 | B1 * | 10/2020 | Sganga | A46B 17/02 |
| 2004/0026581 | A1 | 2/2004 | Hitzler | |
| 2015/0040336 | A1 | 2/2015 | McCaul | |
| 2017/0203609 | A1 | 7/2017 | Haskins | |
| 2017/0282636 | A1 | 10/2017 | Hall | |
| 2017/0311709 | A1 | 11/2017 | McInerney | |
| 2020/0221858 | A1 * | 7/2020 | Alvarez | A46B 17/04 |

* cited by examiner

PAINT BRUSH WITH INTEGRATED HANGER AND PACKAGING THEREFOR

RELATED APPLICATIONS

This application claims the benefit of U.S. Provisional Application No. 62/823,838 filed Mar. 26, 2019, U.S. Provisional Application No. 62/889,255 filed Aug. 20, 2019, and U.S. Provisional Application No. 62/966,248 filed Jan. 27, 2020, all of which are hereby incorporated herein by reference in their entireties.

FIELD OF INVENTION

The present invention relates generally to paint brushes, and more particularly to a paint brush having an integrated hanger for hanging the paint brush on an object.

BACKGROUND

It is generally known to provide a hanger on a paint brush handle to hang the paint brush from an object, such as to prevent the paint brush from falling into the paint. Conventional paint brushes utilizing such hangers often require numerous assembly steps and/or additional parts to manufacture the paint brush.

SUMMARY OF INVENTION

An aspect of the present invention provides a paint brush having a handle with an integrated hanger that is pivotably movable between a retracted position for unobtrusively stowing the hanger within a groove of the handle, and an extended position for extending the hanger outwardly from the groove to enable the paint brush to be hanged on an object such as a paint bucket, tray, ladder, or the like.

The paint brush may be configured such that the hanger is assembled to the handle with fewer parts and/or fewer (or simpler) assembly steps, thereby minimizing costs.

The integrated hanger and groove of the paint brush also may provide a more ergonomic design. For example, when stowed in the retracted position the hanger may be flush with an outer surface of the handle thereby providing improved comfort in the user's hand while painting. The portion of the handle having the groove may be made of a flexible material which also may improve comfort and may better secure the hanger in the groove when stowed. In addition, the hanger and groove may be configured to enable ease of deployment of the hanger from the retracted to extended position simply with a one-handed operation by the user.

According to one aspect of the invention, a paint brush includes: a handle having a flexible portion having a groove; bristles operatively attached to the handle; and a hanger hinged to the handle for pivotable movement between a retracted position for stowing the hanger in the groove, and an extended position for extending the hanger from the groove for hanging the paint brush from an object; wherein the hanger has a hanger portion and a journal that is unitary with the hanger portion; wherein the flexible portion has a socket that opens to a sidewall of the groove, and wherein the journal of the hanger is received and pivotably retained in the socket to enable the hanger to move between the retracted and extended positions; and wherein the flexible portion of the handle has sufficient flexibility to enable the groove to be spread apart for inserting the journal of the hanger into the socket through the sidewall of the groove.

According to another aspect of the invention, a paint brush includes: a handle having a surface groove; bristles operatively attached to the handle; and a hanger hinged to the handle with a hinge connector for pivotable movement between a retracted position for stowing the hanger in the surface groove and an extended position for extending the hanger from the surface groove for hanging the paint brush from an object; wherein a first hinge part of the hinge connector includes a resilient snap-in receiver, and wherein a second hinge part of the hinge connector includes a pivot that is received and pivotably retained in the snap-in receiver such that the hanger is pivotably movable between the retracted and extended positions.

According to another aspect of the invention, a paint brush includes: a handle having a head portion and a grip portion that at least partially overlies the head portion, the grip portion having a surface groove; bristles operatively attached to the handle; and a hanger hinged to the handle such that the hanger is pivotably movable between a retracted position for stowing the hanger in the surface groove and an extended position for extending the hanger from the surface groove for hanging the paint brush from an object.

According to another aspect of the invention, a paint brush includes: a handle having a head portion and a grip portion that at least partially overlies the head portion, the grip portion having a surface groove, and the head portion extending inwardly through the grip portion such that a part of the head portion is exposed in the surface groove; and a hanger operatively coupled to the part of the head portion exposed in the surface groove, such that the hanger is pivotably movable between a retracted position for stowing the hanger in the surface groove and an extended position for extending the hanger from the surface groove for hanging the paint brush from an object.

According to another aspect of the invention, a paint brush includes: a handle having a head portion and a grip portion that at least partially overlies the head portion, the grip portion having a surface groove; bristles operatively attached to the head portion of the handle; and a hanger hinged to the handle with a hinge connector for pivotable movement between a retracted position for stowing the hanger in the surface groove and an extended position for extending the hanger from the surface groove for hanging the paint brush from an object; wherein the head portion has a first hinge part of the hinge connector, the head portion extending inwardly through the grip portion such that the first hinge part is exposed in the surface groove; and wherein the hanger has a second hinge part of the hinge connector, the second hinge part of the hanger being received and pivotably secured to the first hinge part of the head portion such that the hanger is pivotably movable between the retracted and extended positions.

According to another aspect of the invention, a paint brush includes: a handle having a surface groove; bristles operatively attached to the handle; and a hanger hinged to the handle for pivotable movement between a retracted position for stowing the hanger in the surface groove and an extended position for extending the hanger from the surface groove for hanging the paint brush from an object; wherein the paint brush includes an integrally-formed and permanently-linked hinge assembly having a first linkage part that forms a first loop and a second linkage part that forms a second loop, wherein the first and second loops are non-removably and pivotably interlinked together; wherein the hanger includes the first linkage part that forms the first loop, and wherein the hinge assembly includes a hinge body having the second linkage part that forms the second loop, the hinge body and the hanger being pivotably interlinked together by the respective first and second loops such that the hanger is pivotably movable relative to the hinge body between the retracted and extended positions.

According to another aspect of the invention, a paint brush includes: a handle having a head portion and a grip portion that at least partially overlies the head portion, the grip portion having a surface groove; bristles operatively attached to the head portion of the handle; and a hanger hinged to the handle with a hinge connector for pivotable movement between a retracted position for stowing the hanger in the surface groove and an extended position for extending the hanger from the surface groove for hanging the paint brush from an object; wherein the head portion has a first hinge part of the hinge connector, the head portion extending inwardly through the grip portion such that the first hinge part is exposed in the surface groove; and wherein the hanger has a second hinge part of the hinge connector, the second hinge part being pivotably secured to the first hinge part with a third hinge part of the hinge connector, such that the hanger is pivotably movable between the retracted and extended positions.

According to another aspect of the invention, a paint brush includes: a handle having a surface groove; bristles operatively attached to the handle; and a hanger hinged to the handle for pivotable movement between a retracted position for stowing the hanger in the surface groove and an extended position for extending the hanger from the surface groove for hanging the paint brush from an object; wherein the surface groove opens to an edge of the handle, and the hanger when in the retracted position extends to the edge such that a corner of the hanger is exposed at the edge for enabling pivoting of the hanger from the retracted to extended position.

According to another aspect of the invention, a method of forming a paint brush handle includes: providing a handle having a grip portion that at least partially overlies a head portion adapted for operatively coupling to a plurality of bristles; wherein the grip portion includes a surface groove; and operatively connecting a hanger to the handle such that the hanger is hinged to the handle for pivotable movement between a retracted position for stowing the hanger in the surface groove and an extended position for extending the hanger from the surface groove for hanging the paint brush from an object.

According to another aspect of the invention, a method of forming a paint brush handle includes: forming a surface groove in the handle such that the surface groove opens to an edge of the handle; and operatively connecting a hanger to the handle such that the hanger is hinged to the handle for pivotable movement between a retracted position for stowing the hanger in the surface groove and an extended position for extending the hanger from the surface groove for hanging the paint brush from an object, and such that the hanger when in the retracted position extends to the edge such that a corner of the hanger portion is exposed at the edge for enabling pivoting of the hanger from the retracted to extended position.

According to another aspect of the invention, a method of forming a paint brush handle includes: providing a main body portion of the handle; forming a notch in an edge of the main body portion; inserting an insert assembly into the notch; wherein the insert assembly includes an insert body having a surface groove, and a hanger hinged to the insert body for pivotable movement between a retracted position for stowing the hanger in the surface groove and an extended position for extending the hanger from the surface groove.

According to another aspect of the invention, display packaging is provided including a box having sidewalls that enclose a space, the box being configured to at least partially contain a paint brush having a handle and a hanger hinged to the handle; wherein the box includes at least one opening that is configured to permit at least a portion of the hanger to extend therethrough when the hanger is deployed to its extended position.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

Figure 1:
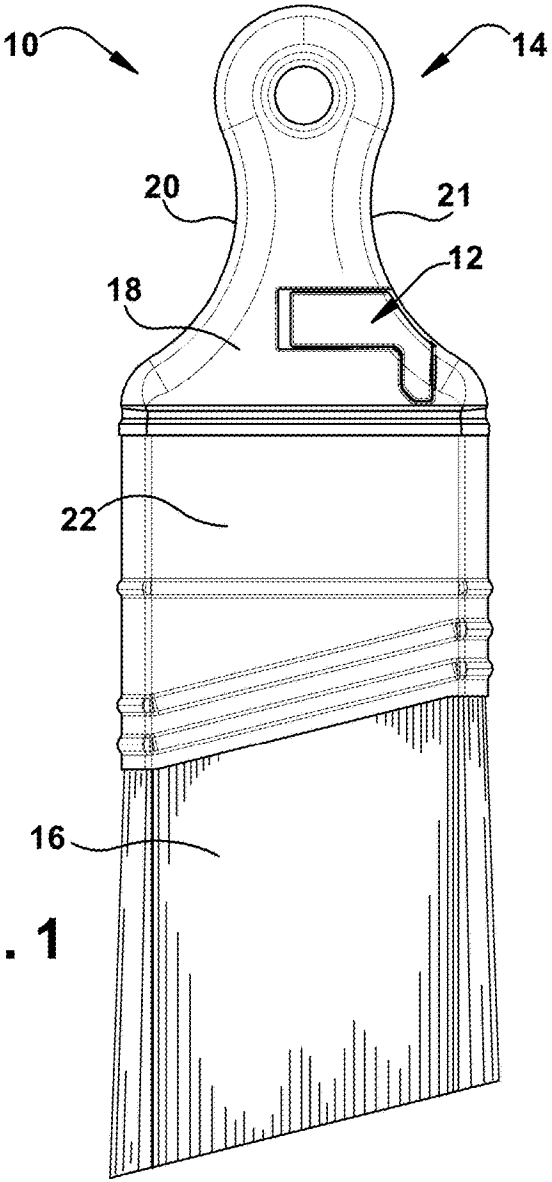
FIG. 1 is a front plan view of an exemplary paint brush according to an embodiment of the invention.

Referring to FIGS. 1-15, an exemplary embodiment of a paint brush 10 having an integrated hanger 12 is shown. Referring initially to FIGS. 1-12, the paint brush 10 generally includes a handle 14 and bristles 16 (also referred to as filaments 16) that are operatively coupled to the handle 14. The handle 14 may be a relatively flat design, having opposite front and rear flat sides 18, 19, with opposite edges 20, 21 connecting the flat sides 18, 19. The filaments 16 may be coupled to the handle 14 with a metal ferrule 22 in a conventional manner. For example, the filaments 16 may be set in a suitable adhesive 24, such as an epoxy, that extends into one or more outwardly protruding annular grooves 25 in the inner wall of the ferrule 22 for securely fastening the filaments 16 to the ferrule 22 (as shown in the rear cross-sectional view of FIG. 15, for example). In the illustrated embodiment, the lower ends of the filaments 16 are progressively longer across the lateral width of the brush 10 to provide an angled brush, such as typically used for trim work. However, it will be appreciated that the lower ends of the filaments 16 may all be of substantially the same length if desired.

Figure 3:
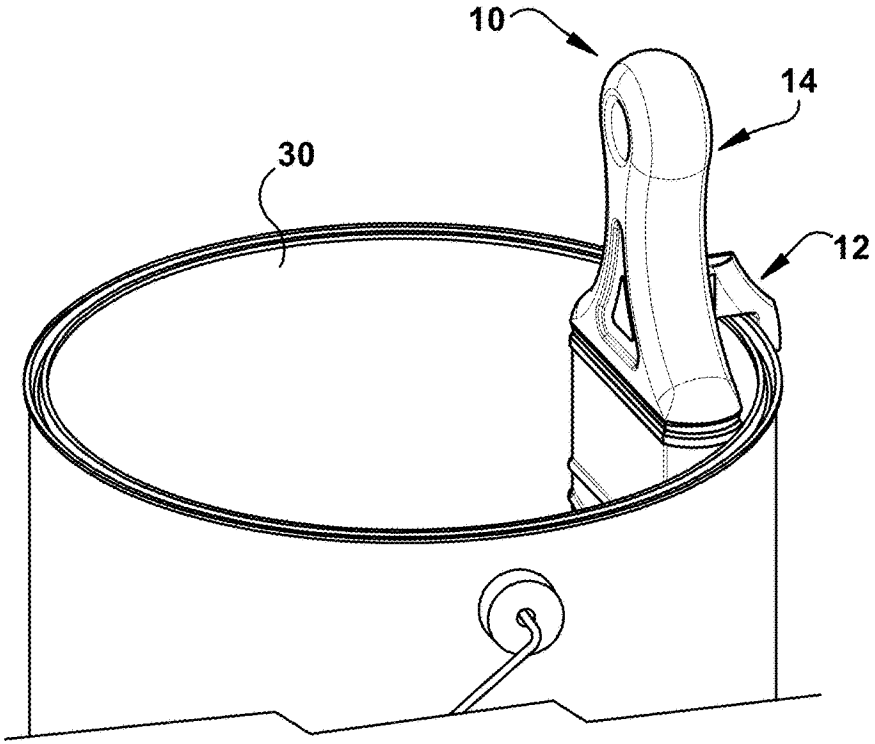
FIG. 3 is a perspective view of the paint brush shown being hanged from a bucket.
Figure 2:
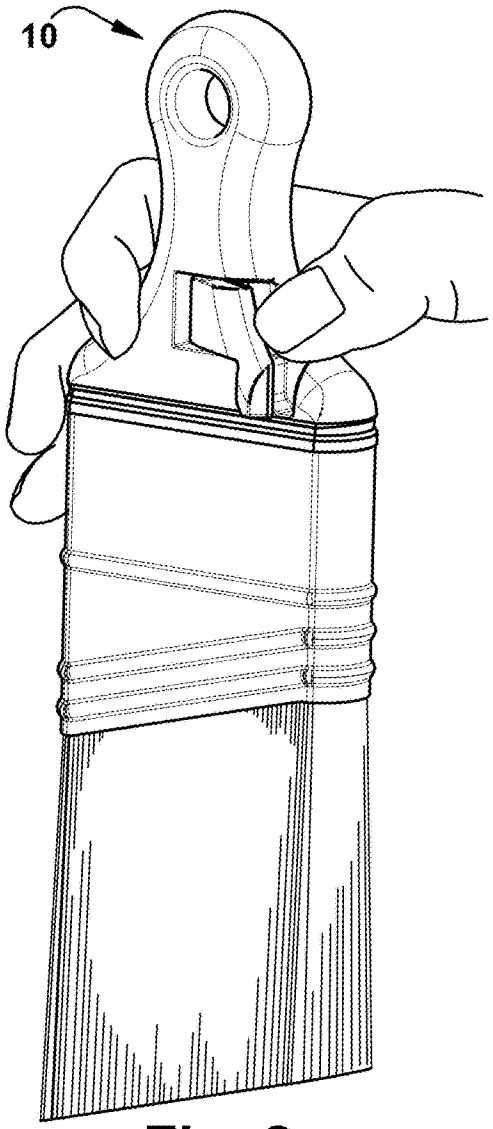
FIG. 2 is a perspective view of the paint brush shown being held in a user's hand while deploying an exemplary hanger of the paint brush.
Figure 5:
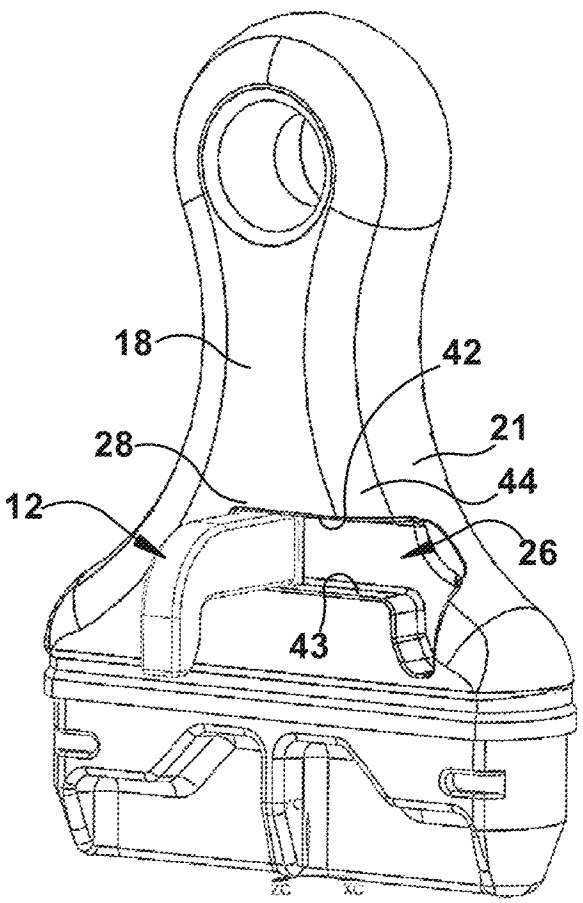
FIG. 5 is a perspective view of the paint brush handle with the hanger shown in an exemplary extended or deployed position.
Figure 4:
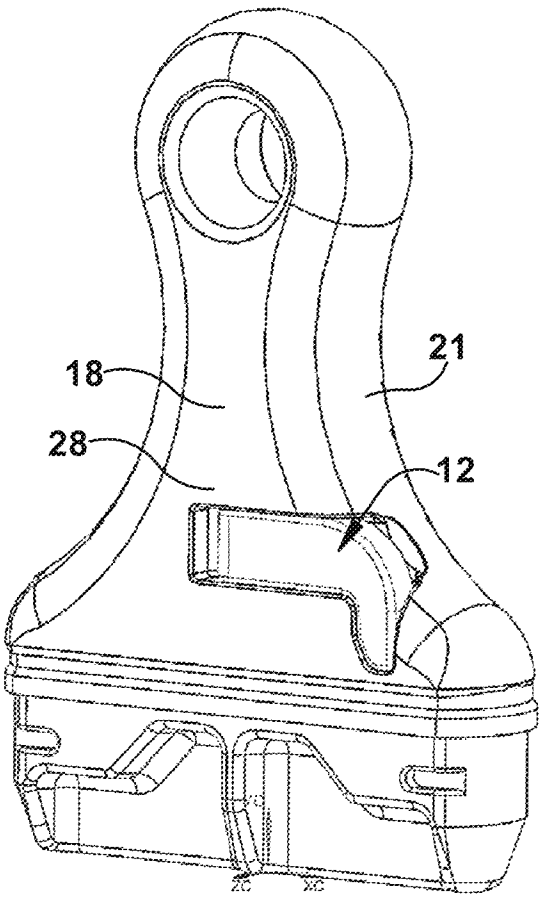
FIG. 4 is a perspective view of the paint brush handle with the hanger shown in an exemplary retracted or stowed position.
Figure 8:
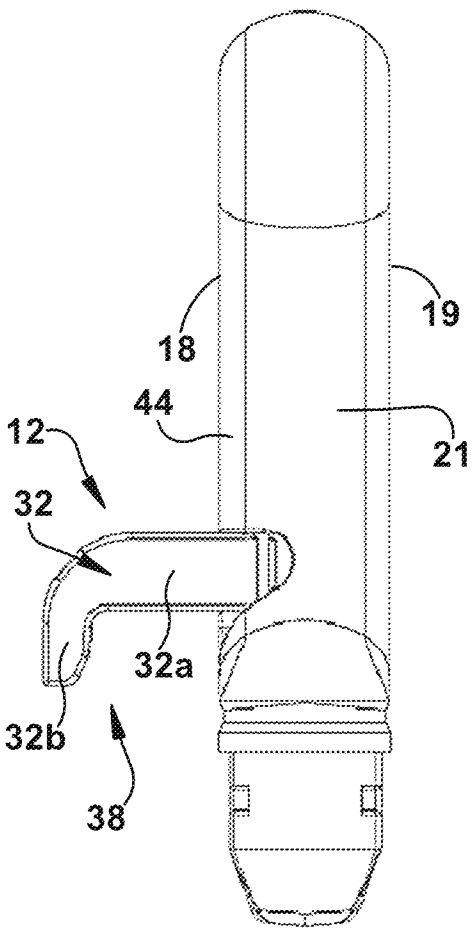
FIG. 8 is a right side view of the paint brush handle with the hanger in the extended position.
Figure 7:
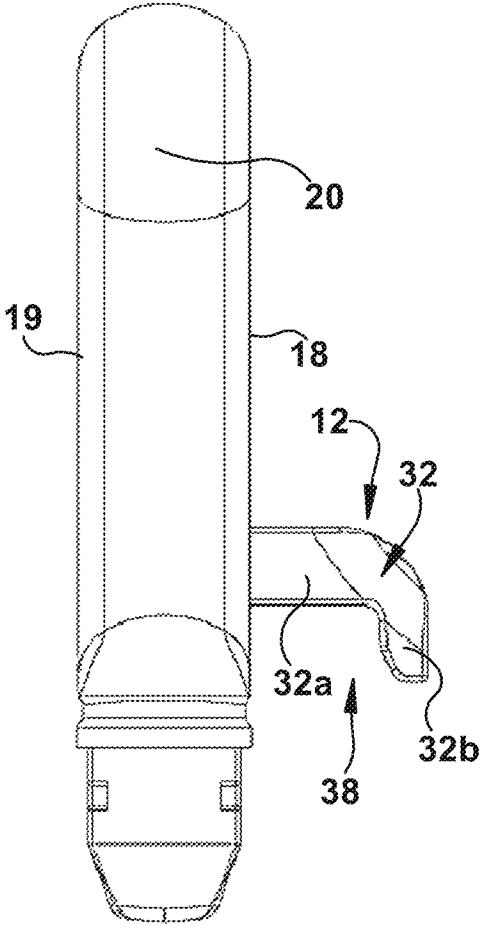
FIG. 7 is a left side view of the paint brush handle with the hanger in the extended position.
Figure 6:
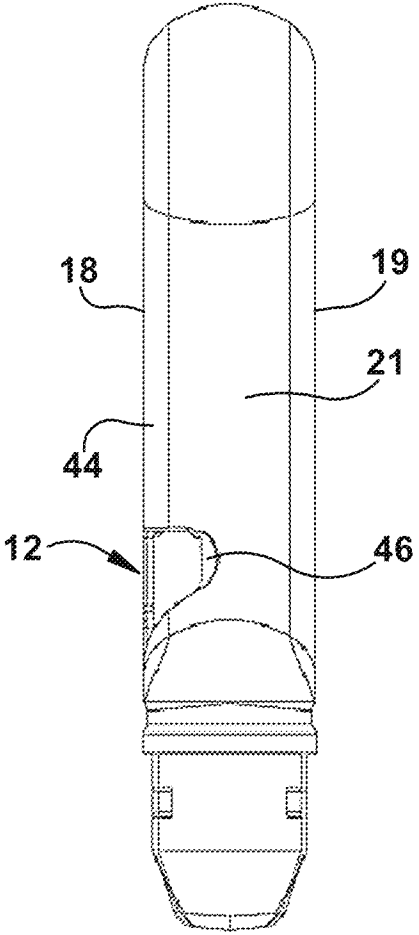
FIG. 6 is a right side view of the paint brush handle with the hanger in the retracted position.
Figure 9:
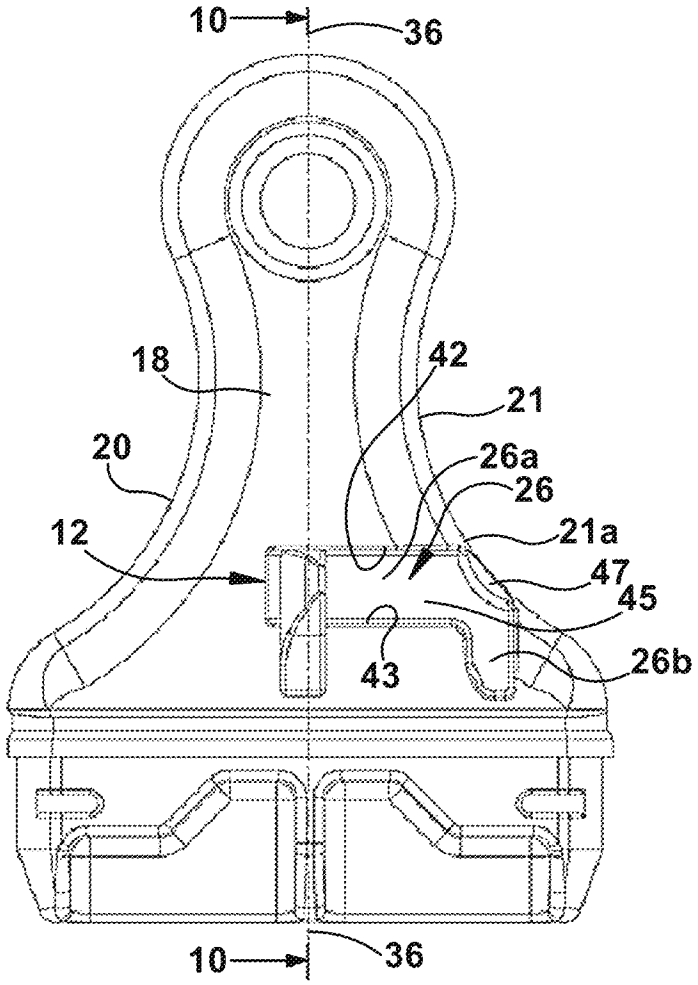
FIG. 9 is a front plan view of the paint brush handle with the hanger in the extended position.
Figure 10:
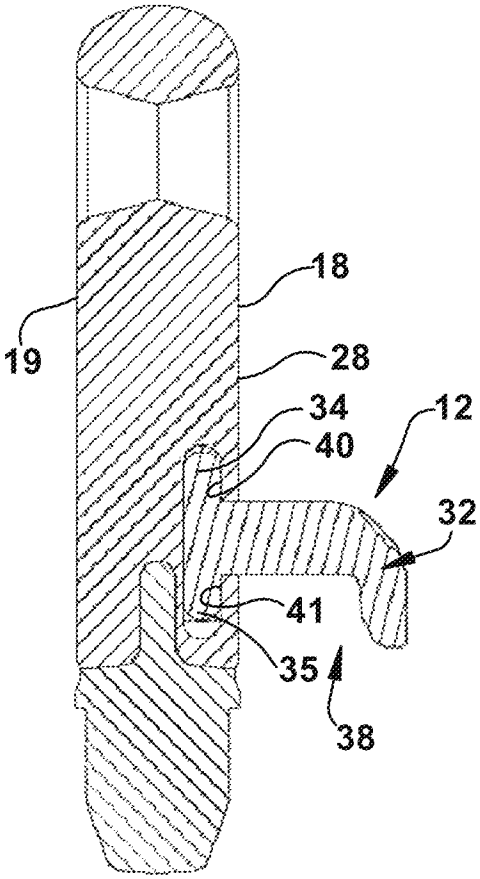
FIG. 10 is a cross-sectional view of the paint brush handle taken about the line 10-10 in FIG. 9.
Figure 11:
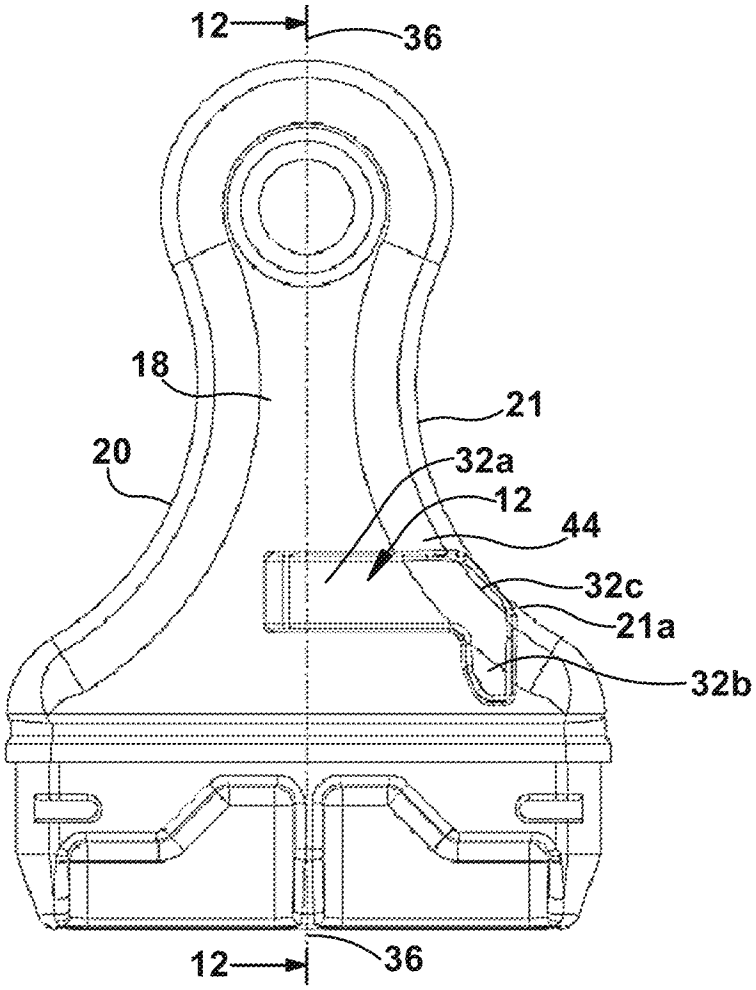
FIG. 11 is a front plan view of the paint brush handle with the hanger in the retracted position.
Figure 12:
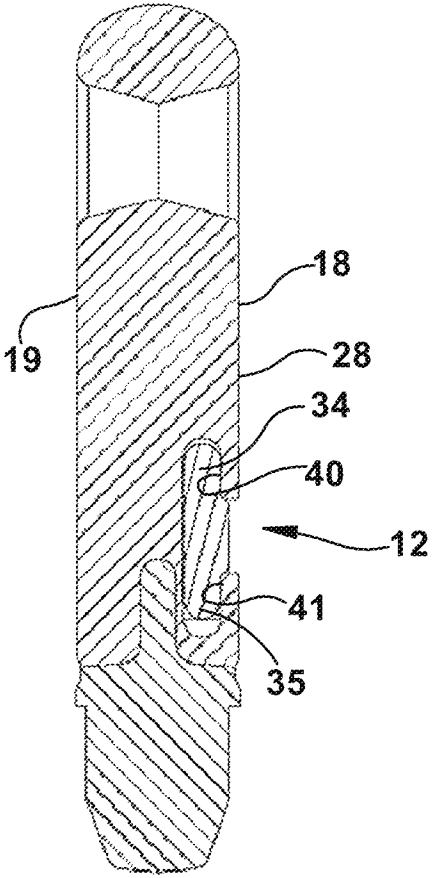
FIG. 12 is a cross-sectional view of the paint brush handle taken about the line 12-12 in FIG. 11.

The handle 14 has a groove 26 in an outer surface 28 of the handle, and the hanger 12 is hinged to the handle 14 for pivotable movement between a retracted position for stowing the hanger 12 in the groove 26 (as shown in FIGS. 4, 6, 11 and 12, for example), and an extended position for extending the hanger 12 from the groove 26 (as shown in FIGS. 5 and 7-10, for example). For example, as shown in FIG. 2, the paint brush 10 is adapted to fit in a user's hand, and the exemplary hanger 12 and groove 26 are configured to enable easy single-handed deployment of the hanger 12 from the retracted position to the extended position to allow the user to hang the paint brush 10 from an object 30, such as a tray or bucket (as shown in FIG. 3), or any other suitable object, such as a paint can, ladder, or the like as may be desired.

In the illustrated embodiment, the hanger 12 has a hanger portion 32 (or main body) and a journal 34 that is unitary with the hanger portion 32. The journal 34 forms a pivot, such as a pivot pin, that extends from the hanger portion 32 to provide a pivot axis 36 for the hanger 12. In exemplary embodiments, the hanger 12 includes a second journal 35 which forms a second pivot opposite the first journal 34, and which may improve the stability of the hanger 12 during pivotal rotation of the hanger and/or hanging of the paint brush 10. The journal(s) 34, 35 cooperate with the groove 26 so that the hanger 12 may be flush with the outer surface 28 of the handle 14, as discussed below. Also as shown, the hanger portion 32 includes a first segment 32*a* that extends in a direction transverse to the pivot axis 36, and includes a second segment 32*b* that extends transverse to the first segment 32*a* to form a hook 38 that enables the hanger 12 to be securely hanged on an object. The hook 38 may be so dimensioned to hang on the edge of conventional (e.g., one-gallon or five-gallon) paint cans, paint cups, paint trays, or the like.

In the illustrated embodiment, the handle 14 has at least one socket 40 that opens to a sidewall 42 of the groove 26. The socket 40 is configured to receive and retain the journal 34 of the hanger 12 for enabling pivotable movement of the hanger 12 between the retracted and extended positions. In exemplary embodiments, the groove 26 includes a second socket 41 that opens to an opposing sidewall 43 of the groove 26. The second socket 41 opposes the first socket 40 and is configured to receive and pivotably retain the second journal 35. The socket(s) 40, 41 may be formed or machined into the sidewall(s) 42, 43 of the groove 26 so as to be surrounded by the material forming the portion of the handle 14 having the groove 26. As shown in the illustrated embodiment, for example, the portion of the outer surface 28 of the handle juxtaposed to the groove 26 is a continuous outer surface that extends along at least a portion of the groove 26, and the socket(s) 40, 41 are inwardly spaced apart from this continuous outer surface to open to the sidewall(s) 42, 43 of the groove at a depth below the continuous surface. Such a configuration may reduce or eliminate the need for additional assembly parts, such as plates or other coverings, that otherwise might be required to retain the journal(s) 34, 35 of the hanger 12 in the handle 14.

As shown, the groove 26 has a shape that corresponds to a shape of the hanger portion 32 of the hanger 12, such that when the hanger 12 is pivotably moved to the retracted position the hanger portion 32 is stowed within the groove 26. In this manner, the groove 26 includes a first groove segment 26*a* that is configured to receive the first segment 32*a* of the hanger portion, and includes a second groove segment 26*b* that is transverse to the first groove segment 26*a* and is configured to receive the second segment 32*b* of the hanger portion. In exemplary embodiments, the hanger 12 is configured to be flush with the outer surface 28 of the handle 14 when in the retracted and stowed position. This enhances the ergonomics of the paint brush 10 and makes the brush more comfortable for the user. It is understood that in this stowed flush state, the hanger 12 may have some minor variation in elevation relative to the outer surface 28 so as to be slightly recessed or protrude from the outer surface 28 without affecting the comfort to the user.

In exemplary embodiments, the hanger 12 and groove 26 are disposed on the front side 18 of the handle 14, such that the length of the groove 26 and hanger 12 (when stowed) extend in a lateral direction across the front side 18, with the depth of the groove 26 extending in a transverse direction, and the pivot axis 36 being generally centrally located and extending in the longitudinal direction. In exemplary embodiments, the groove 26 and the hanger 12 extend laterally to the edge 21 of the handle 14 for facilitating deployment of the hanger 12 by the user. As shown in the illustrated embodiment, for example, the groove 26 may open to the edge 21 of the handle such that a corner 32*c* of the hanger portion 32 (when stowed) is exposed at the edge 21 for improving access of the hanger 12 to the user. The exposed corner 32*c* of the hanger portion 32 may be located along the edge 21 of the handle at the curved transition 21*a* between the upper portion of the handle 14 and the lower portion of the handle 14, where the user's thumb or forefinger are likely to be placed during painting, which further enhances the ergonomics of the design. Also as shown, the transition between the edge 21 of the handle and the front side 18 may have a curved surface 44. The corner 32*c* of the hanger 12 may be contoured to the shape of a curved surface 44 that connects the edge 21 of the handle with the front side 18 of the handle, and the corner 32*c* also may be contoured to the shape of the curved transition 21*a* along the edge 21 between the upper and lower portions of the handle 14. Such contouring of the hanger 12 provides a continuous flush interface between the outer surface 28 of the handle 14 and the hanger 12. In addition, the edge 21 of the handle 14 may include an indent 46 below the hanger 12 (when stowed), such as below the corner 32*c* of the hanger 12, to further provide an access point for enabling the user to deploy the hanger 12. As shown, a bottom surface 47 of the indent 46 may be formed by a deeper part of the bottom surface 45 of the groove 26 such that the bottom surface 47 of the indent 46 is spaced apart from the hanger portion 32 when in the retracted and stowed position.

In exemplary embodiments, the portion of the handle 14 having the groove 26 may be made of a flexible material, such as a thermoplastic elastomer (TPE) material, including thermoplastic rubber (TPR), thermoplastic olefin (TPO), thermoplastic polyurethane (TPU) or thermoplastic vulcanizate (TPV), or any other suitable material. The hanger 12, on the other hand, may be made of a rigid material having an elastic modulus that is less than that of the flexible material of the handle 14. For example, the hanger 12 may be made of a thermoset or thermoplastic polymer, such as polypropylene (PP), polyamide (PA), polyoxymethylene (POM), or polycarbonate (PC), or any other suitable material.

Figure 14:
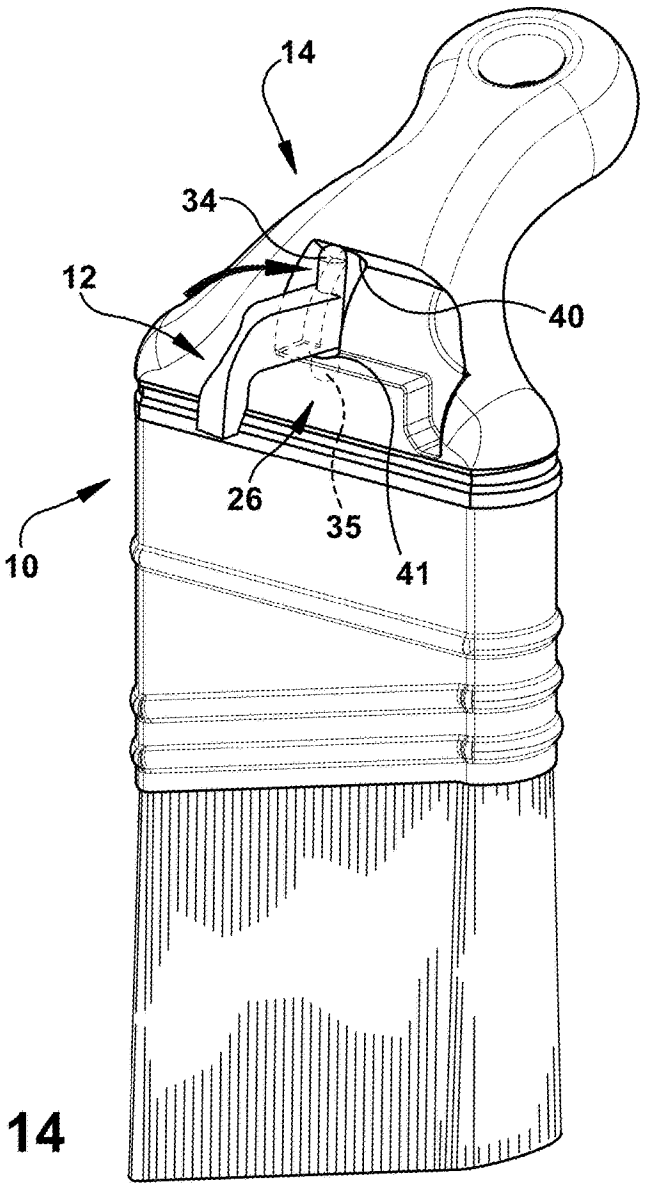
FIG. 14 shows an exemplary method of attaching the hanger to the paint brush handle.
Figure 13:
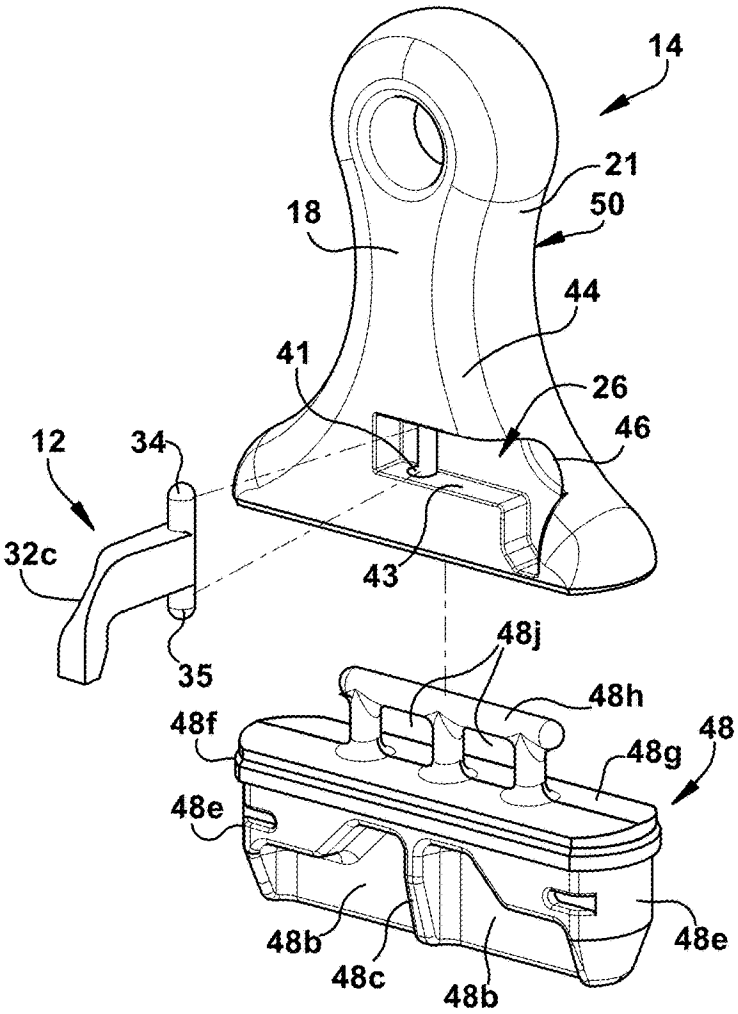
FIG. 13 is an exploded perspective front view of the paint brush handle with hanger.

The use of the flexible material for the handle 14 may provide several advantages. For example, as shown in FIG. 14, the flexible material may have sufficient flexibility to enable the groove 26 to be spread apart for inserting the journal(s) 34, 35 of the hanger into the socket(s) 40, 41 through the sidewall(s) 42, 43 of the groove 26. As shown in FIG. 13, for example, the unitary hanger 12 is discrete with respect to the handle 14, and the journal(s) 34, 35 extend from the hanger portion 32 to provide a width that is wider than the width of the groove 26 in the longitudinal direction. In exemplary embodiments, the width of the groove 26 may be spread apart by about the width between the end(s) of the journal(s) 34, 35. In the illustrated embodiment, for example, the width between the ends of the journals 34, 35 is about 15 mm and the width of the groove 26 is about 7 mm. As shown in FIG. 14, the flexible portion of the handle 14 is bent or stretched to spread apart the groove 26 in preparation for inserting the hanger 12. In the illustrated embodiment, for example, the groove 26 is spread apart from the 7 mm original width to a width of up to about 15 mm, although a greater or lesser spread may be employed. As shown in FIG. 14, the journals 34,35 of the hanger 12 are inserted into the opposing sockets 40, 41 of the handle 14, which is facilitated by the spreading apart of the groove 26. As shown, the flexible material of the handle 14 is then relaxed and springs back to its original shape such that the journals 34, 35 are now pivotably retained within the sockets 40, 41 and the paint brush 10 is ready for use.

In exemplary embodiments, the flexible material of the handle 14 is molded, such as via injection molding, and the socket(s) 40, 41 and groove 26 are pre-molded with the handle 14. This minimizes the number of assembly steps for machining the sockets 40, 41 and/or the groove 26, and also makes it easier to provide the opposing sockets 40, 41 within the relatively narrow groove 26. The flexible material of the handle 14 also may improve the usability of the hanger 12. For example, the resiliency provided by the flexible material may deformably grip the hanger 12 when stowed to prevent inadvertent deployment of the hanger 12 to the extended position. The flexible material of the handle 14 may provide such grip via the socket(s) 40, 41 engaging the journal(s) 34, 35 and/or via the sidewalls 42, 43 engaging the hanger portion 32.

Figure 15:
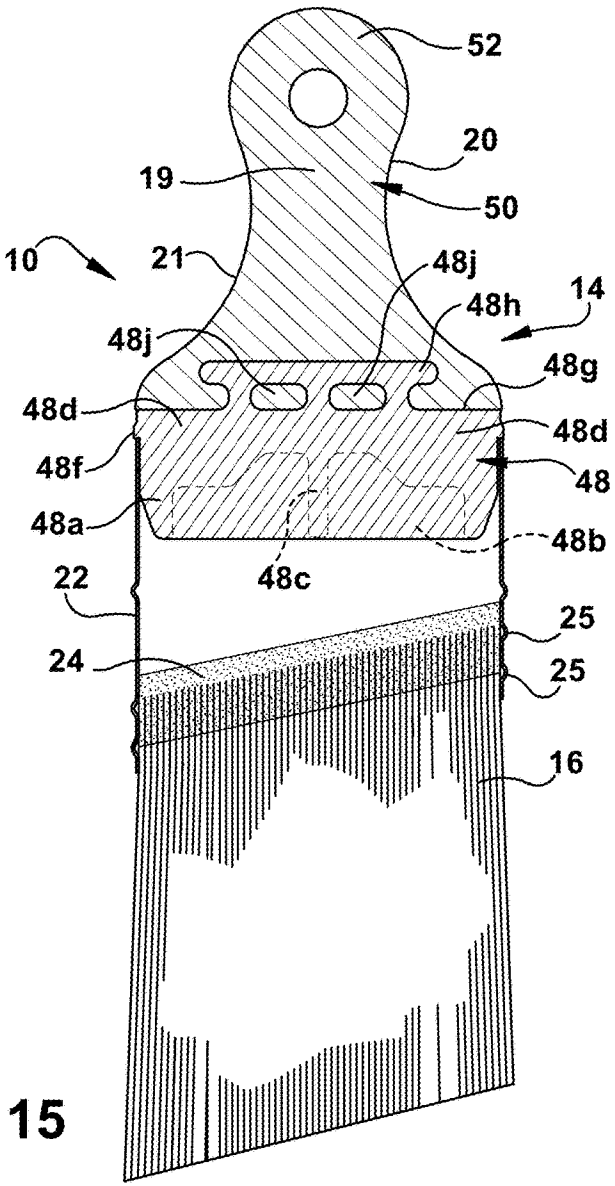
FIG. 15 is a rear cross-sectional view of the paint brush.
Figure 17:
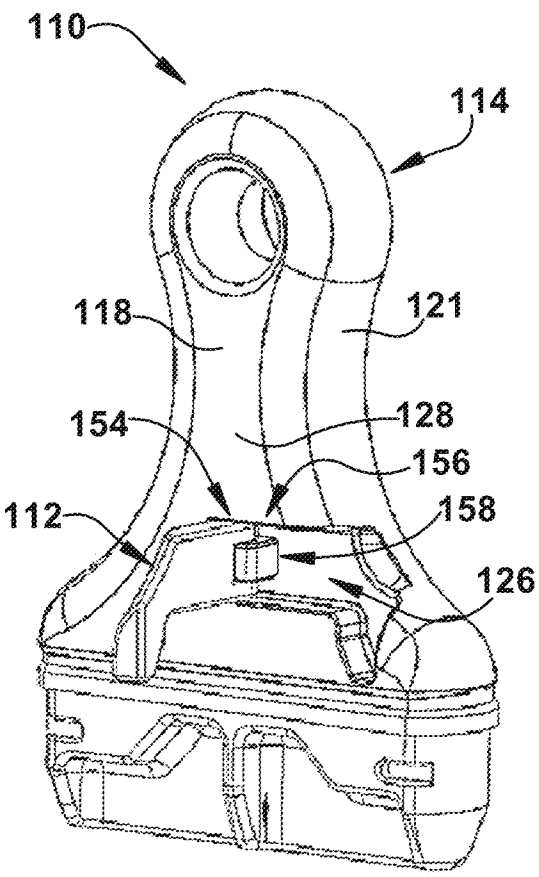
FIG. 17 is a perspective view of the paint brush handle in FIG. 16 with an exemplary hanger shown in an exemplary extended position.
Figure 16:
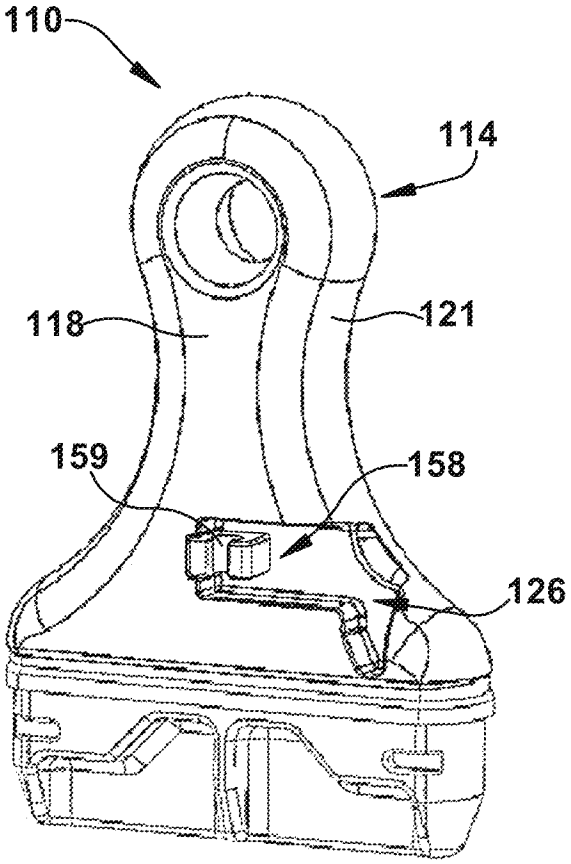
FIG. 16 is a perspective view another exemplary handle of another exemplary paint brush shown without another exemplary hanger.

Referring particularly to the exploded perspective view of FIG. 13 and the rear cross-sectional view of FIG. 15, in exemplary embodiments the handle 14 may include a head portion 48 and a grip portion 50 that at least partially overlies the head portion 48. The grip portion 50 may be made of the relatively soft, flexible material described above, which may be over-molded onto the head portion 48 to secure the grip portion 50 to the head portion 48.

The head portion 48 may be pre-molded out of a relatively rigid plastic, such as polypropylene, which is impervious to most paint solvents. The lower end 48*a* of the head portion 48 is shaped to provide a close fit within the upper end of the metal ferrule 22. On opposite sides of the head portion 48 intermediate the width thereof are pockets 48*b* which reduce the thickness of the head portion to provide more even cooling of the head portion during injection molding of the head portion. Extending transversely through the center of each pocket 48*b* is a cross web 48*c* that provides additional support for the brush ferrule 22 when the head portion 48 is fitted within the brush ferrule.

At opposite ends of the pockets 48*b* on each side of the head portion 48 are land areas 48*d* each containing a crimp slot 48*e* to allow portions of the ferrule 22 to be crimped into the slots 48*e* for securing the ferrule 22 to the head portion 48. Alternatively or additionally, suitable fasteners, such as nails, may be driven through the ferrule 22 into the land areas 48*d* next to the crimp slots 48*e* to securely attach the brush ferrule 22 to the head portion 48 without the need for crimping the ferrule 22 into the crimp slots 48*e*. Extending around the periphery of the upper end of the head portion 48 is a raised band 48*f* to provide a stop and transition point for the ferrule 22 when the lower end of the head portion is fitted within the ferrule.

At the upper end of the head portion 48 is a transverse end wall 48*g* having an integral web portion 48*h* protruding axially outwardly/upwardly from the axial center of the transverse end wall about which the inner end of the grip portion 50 is over-molded to secure the grip portion 50 to the head portion 48 with the grip portion 50 extending axially outwardly of the web portion 48*h*. In exemplary embodiments, the thermoplastic material of the grip portion 50 is desirably compatible with the thermoplastic material of the head portion 48, whereby during the over-molding operation, the grip portion 50 forms a chemical bond with the web portion 48*h* and transverse end wall 48*g* of the head portion 48. Also, one or more openings 48*j* (two being shown) are provided in the web portion 48*h* through which the material of the grip portion 50 is molded during the over-molding operation to provide a mechanical connection between the head portion 48 and grip portion 50.

In exemplary embodiments, the grip portion 50 desirably has an overall length of approximately two to three inches and substantially flat opposite sides 18, 19 and curved opposite edges 20, 21 that terminate in a rounded upper end 52. Such an overall shape allows the grip portion 50 to be held in a variety of ways including the way shown in FIG. 2 in which the thumb and middle finger of the user's hand engage opposite sides of the ferrule and the index finger rests on the upper edge of the ferrule. Gripping the brush 10 this way provides added control and maneuverability of the brush which is particularly advantageous when painting corners and tight spaces and the like. Also, providing the brush handle 14 with such a relatively short grip portion 50 allows the grip portion to fit in the palm of the user's hand when the ferrule 22 is gripped between the thumb and middle finger and the index finger is placed on the top edge of the ferrule. As noted above, the hanger 12 and the groove 26 also may extend laterally to the curved transition 21*a* between the upper and lower portion of the grip portion 50 where the thumb and/or forefinger are placed to facilitate ease of deployment of the hanger 12 by the user with only one hand. It is understood that although the grip portion 50 is shown as being a relatively short grip, that the grip portion 50 could be made longer, for example, up to six inches, and still provide greater control and maneuverability of the brush 10 due to the increased flexibility of the grip portion.

The exemplary paint brush 10 provides one or more of the following advantages. The unitary hanger 12 and groove 26 design provides few parts and a simple assembly process. The groove 26 and socket(s) 40, 41 may be pre-molded into the handle 14 (e.g., flexible grip portion 50) thereby minimizing machining and assembly time. The flexible material of the handle 14 (e.g., grip portion 50) may allow for spreading apart of the groove 26 for facilitating installation of the hanger 12. The resiliency of the flexible material, such as via the socket(s) 40, 31 and/or the sidewalls 42, 43, also may improve the grip on the hanger 12, which may help to selectively maintain the hanger 12 in either the extended (deployed) or retracted (stowed) positions. The hanger portion 32 (when stowed) may extend to and be exposed at the edge 21 of the handle 14 to improve accessibility to the user, and the indent 46 may be provided below the stowed hanger 12 to provide an access point to deploy the hanger 12 with only one hand. When in the stowed position, the hanger 12 may be flush with the outer surface 28 of the handle (e.g., flexible grip portion 50), and the hanger 12 also may have contoured surfaces, such as at the corner 32*c*, to provide a continuous flush surface, thereby enhancing the ergonomic design.

FIGS. 16-27 show another exemplary embodiment of a paint brush 110 having an integrated hanger 112, in which only the handle 114 is shown. The paint brush handle 114 is similar to the above-referenced paint brush handle 14, and consequently the same reference numerals but in the 100-series are used to denote structures corresponding to similar structures in the paint brush handles 14, 114. In addition, the foregoing description of the paint brush 10 is equally applicable to the paint brush 110, except as noted below. For example, although the paint brush 110 is not shown with the ferrule or filaments, it is understood that such features of the paint brush 10 may be employed with the paint brush 110. In addition, it is understood that other aspects of the paint brushes 10, 110 may be substituted for one another or used in conjunction with one another where applicable.

Figure 20:
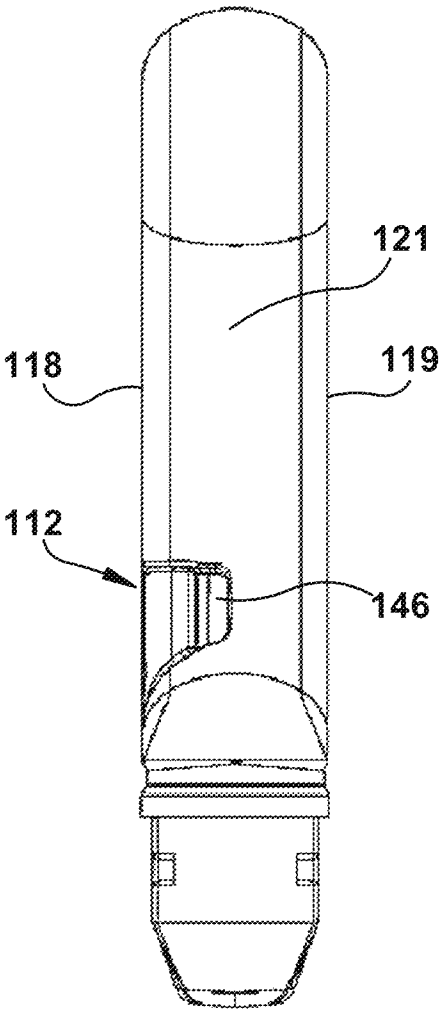
FIG. 20 is a right side view of the paint brush handle with the hanger in the retracted position.
Figure 23:
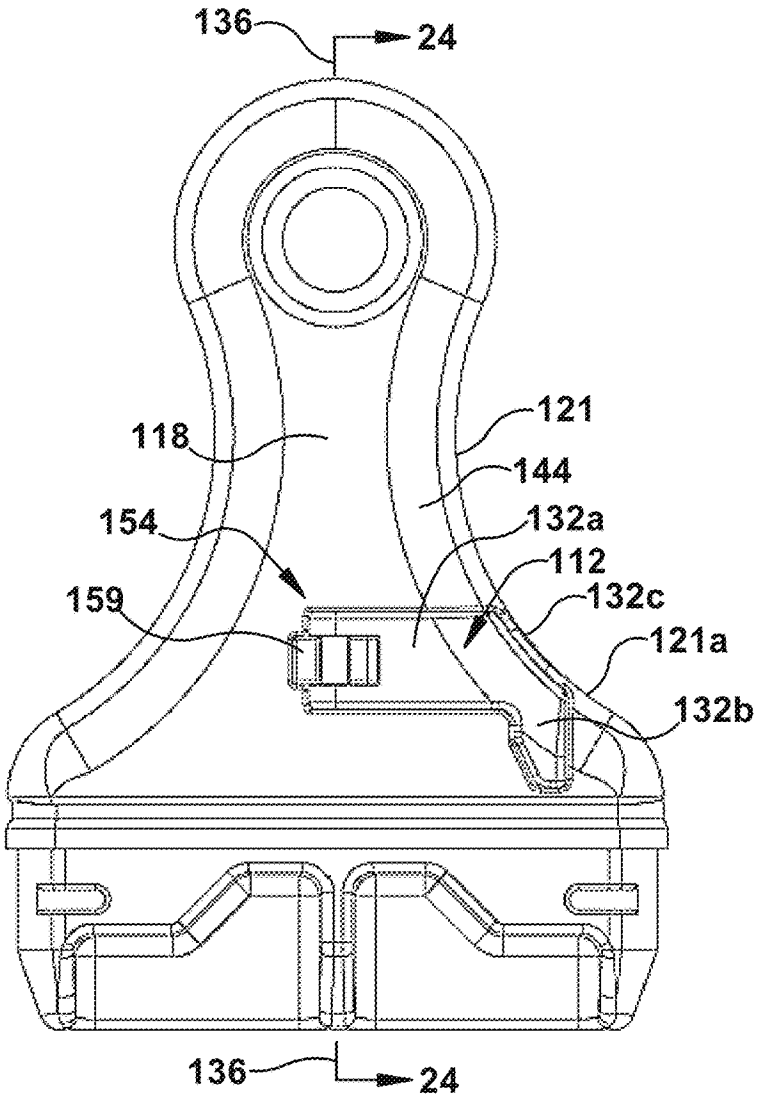
FIG. 23 is a front plan view of the paint brush handle with the hanger in the retracted position.
Figure 24:
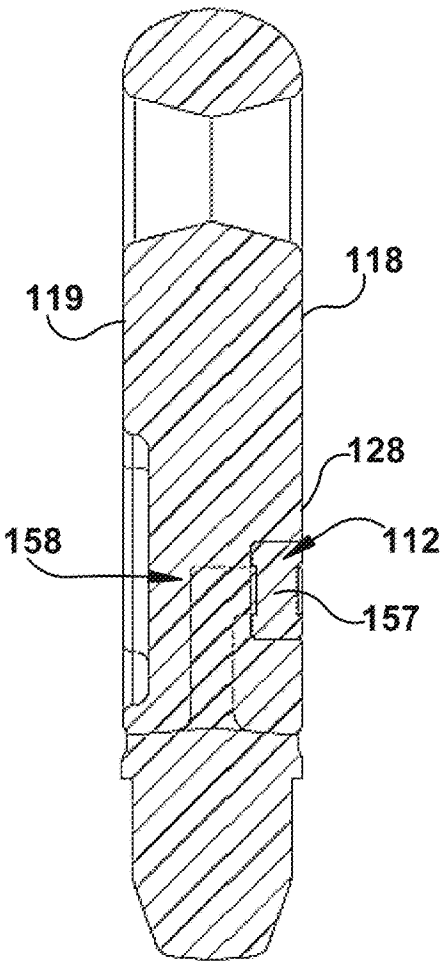
FIG. 24 is a cross-sectional view of the paint brush handle taken about the line 24-24 in FIG. 23.
Figure 25:
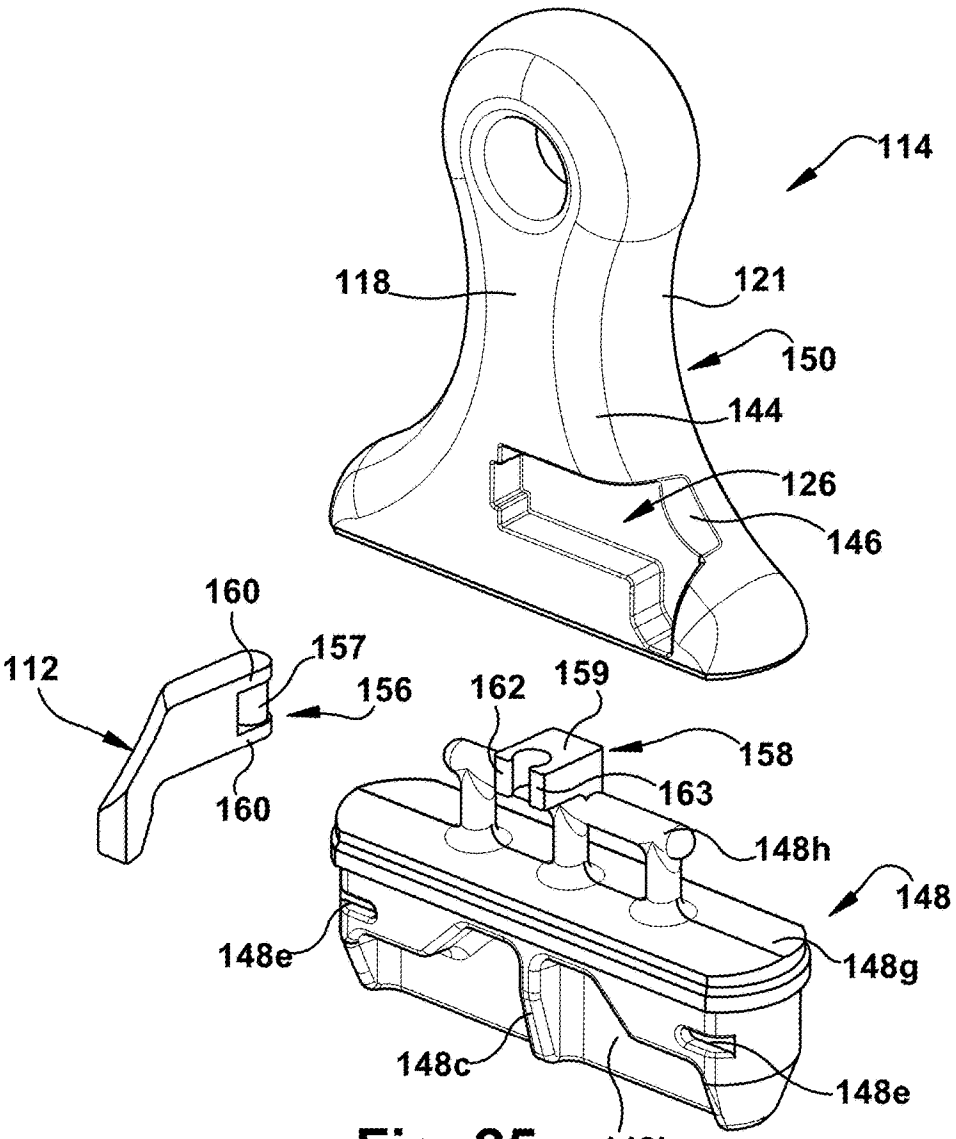
FIG. 25 is an exploded perspective front view of the paint brush handle with hanger.
Figure 27:
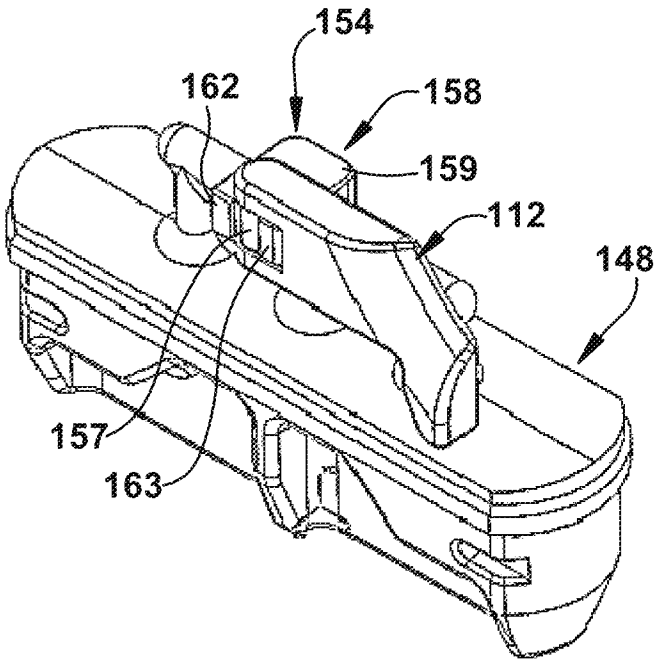
FIG. 27 is a perspective view of the head portion of the paint brush handle shown with the hanger assembled.

As shown, the exemplary paint brush handle 114 has an outer surface 128 with a groove 126, and an exemplary hanger 112 hinged to the handle 114 with a hinge connector 154 disposed in the groove 126 for providing pivotable movement of the hanger 112 between a retracted position (as shown in FIGS. 20, 23 and 24), and an extended position (as shown in FIGS. 18, 19, 21 and 22). In exemplary embodiments, the hinge connector 154 includes a first hinge part 156 having a pivot 157, and a second hinge part 158 having a pivot receiver 159 that receives and retains the pivot 157 to enable the pivotal movement of the hanger 112 between the retracted and extended positions.

In the illustrated embodiment, the hanger 112 has the pivot 157 and the handle 114 has the pivot receiver 159. It is understood, however, that in alternative embodiments the handle 114 could have the pivot 157 and the hanger 114 could have the pivot receiver 159. As shown in the illustrated embodiment, particularly with reference to FIGS. 25-27, the pivot 157 is formed as a pivot rod that extends between opposing arms 160 at an end portion of the hanger 112 to form a loop 161 that is received by the receiver 159. In exemplary embodiments the hanger 112 has a unitary construction, in which the pivot 157 is unitary with a hanger portion 132 of the hanger 112. Similarly to the above-described hanger 12, the hanger portion 132 of hanger 112 includes respective first and second segments 132*a*, 132*b* that form a hook 138 which may be so dimensioned to hang the paint brush on an object such as a paint can, or the like.

Figure 19:
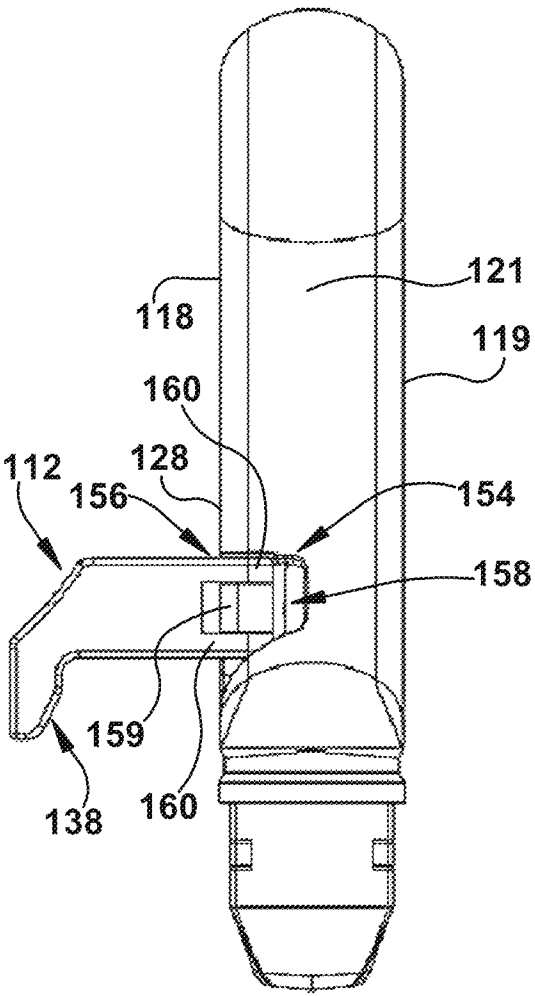
FIG. 19 is a right side view of the paint brush handle with the hanger in the extended position.
Figure 18:
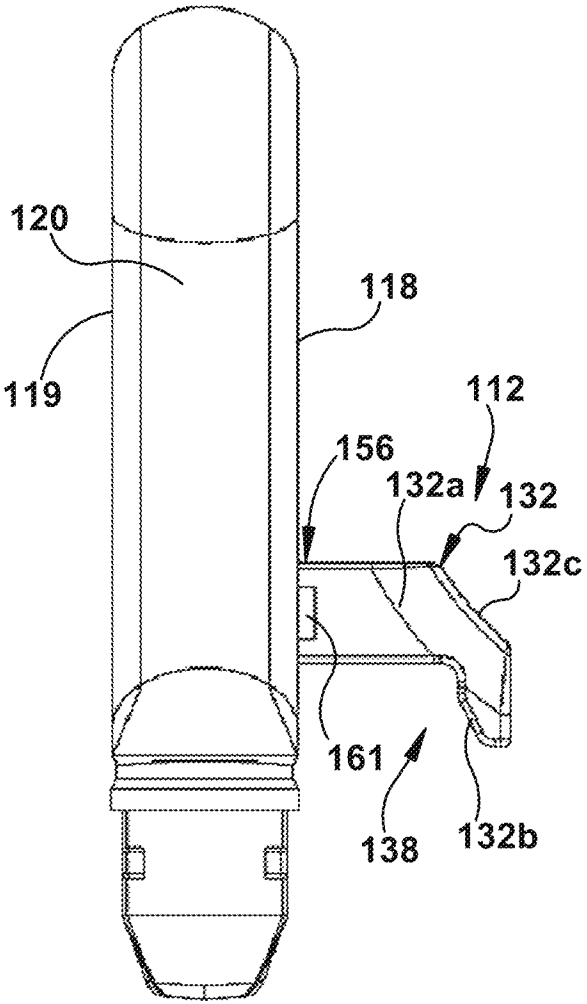
FIG. 18 is a left side view of the paint brush handle with the hanger in the extended position.
Figure 21:
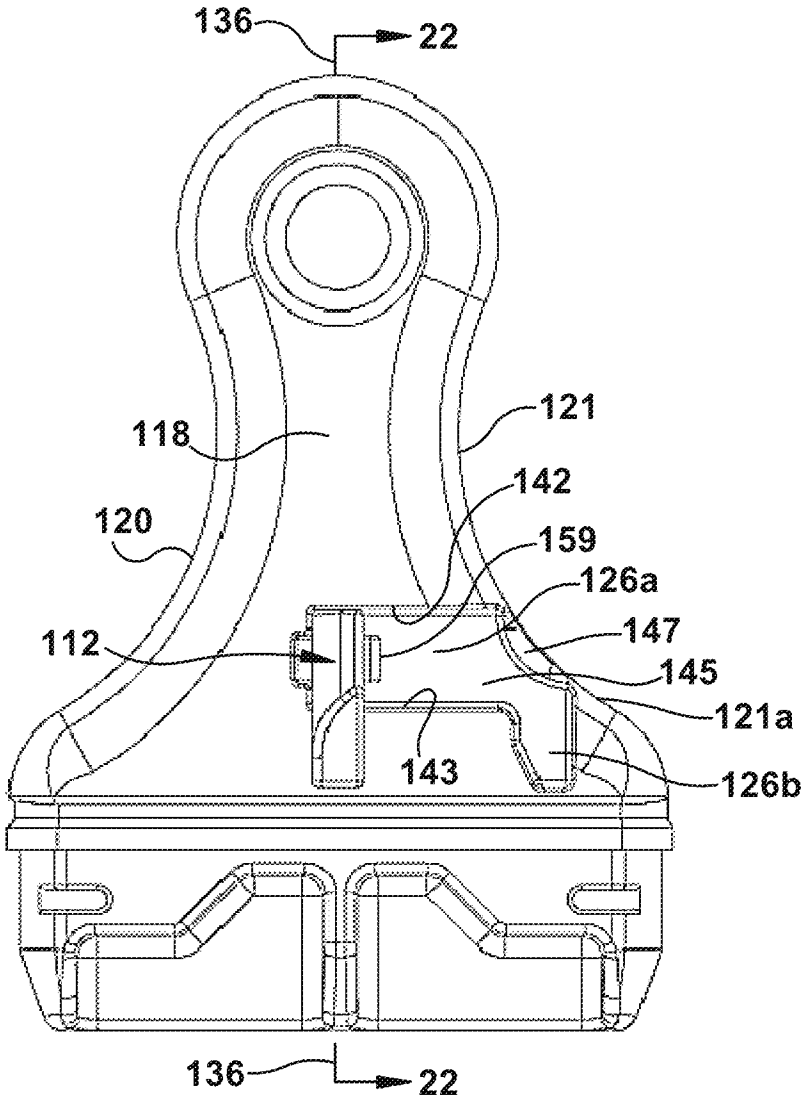
FIG. 21 is a front plan view of the paint brush handle with the hanger in the extended position.
Figure 22:
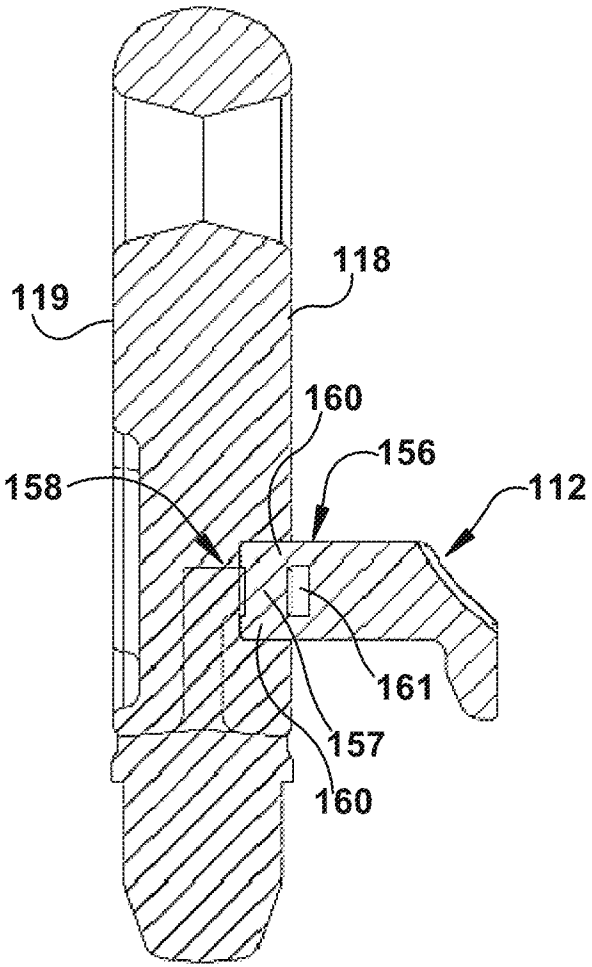
FIG. 22 is a cross-sectional view of the paint brush handle taken about the line 22-22 in FIG. 21.
Figure 26:
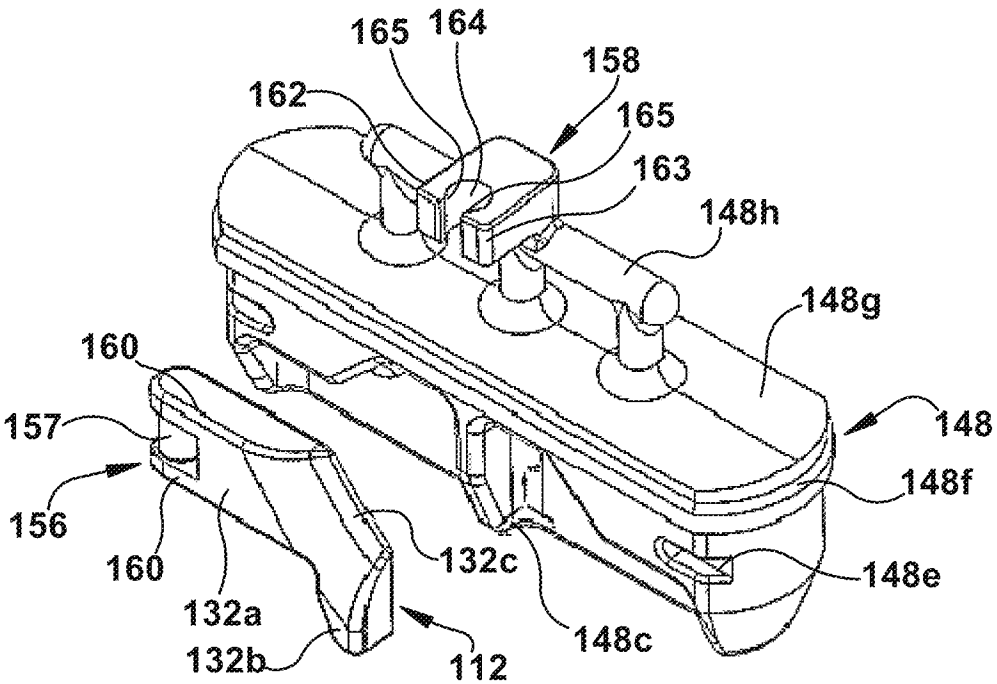
FIG. 26 is a perspective view of a head portion of the paint brush handle shown with the hanger detached.
Figure 28:
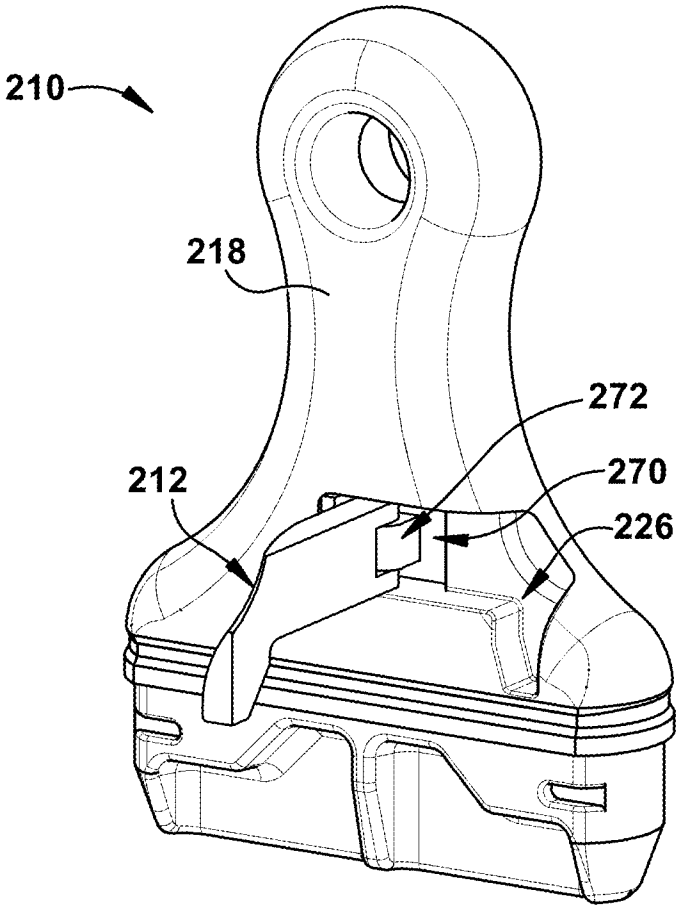
FIG. 28 is a perspective bottom view another exemplary handle of another exemplary paint brush with another exemplary hanger.

In exemplary embodiments, the pivot receiver 159 is configured as a resilient snap-in receiver 159 that receives and pivotably secures the pivot 157 of the hanger 112. As best shown in FIG. 26, for example, the snap-in receiver 159 may include opposing first and second prongs 162, 163 that form a concave, generally U-shaped receiver barrel 164. In exemplary embodiments, at least one of the prongs 162, 163 is resiliently movable relative to the other prong for receiving the pivot 157, and in the illustrated embodiment both prongs 162, 163 are resiliently movable. As shown, one or more of the prongs 162, 163 also includes a catch 165, such as a curve or abutment at the end of the prong 162,163, for gripping the pivot 157. In exemplary embodiments, the back of the receiver barrel 164 is flush with the bottom surface 145 of the groove 126, and the pivot receiver 159 does not protrude beyond the outer surface 128 from within the groove 126 (as shown in FIG. 19, for example). Such feature(s) enhance the ergonomics of the handle 114 by not having the hinge connector 154 protrude from the groove.

Similarly to the above-described handle 14, the groove 126 of the handle 114 has a shape that corresponds to a shape of the hanger portion 132 of the hanger 112, and the hanger 112 is configured to be flush with the outer surface 128 of the handle 114 when in the retracted and stowed position. Also similarly to the above-described handle 14, the hanger 112 and groove 126 are disposed on the front side 118 of the handle 114 with the pivot axis 136 generally centrally located and extending in the longitudinal direction. Similarly, the groove 126 and the hanger 112 may extend to the edge 121 of the handle 114 such that a corner 132*c* of the hanger portion 132 (when stowed) is exposed at the edge 121 for improving access of the hanger 112 to the user. The corner 132*c* of the hanger 112 may be contoured to the shape of a curved surface 144 that connects the edge 121 of the handle with the front side 118 of the handle, and the corner 132*c* also may be contoured to the shape of the curved transition 121*a* along the edge 121 between the upper and lower portions of the handle 114. Such contouring of the hanger 112 provides a continuous flush interface between the outer surface 128 of the handle 114 and the hanger 112. In addition, the edge 121 of the handle 114 may include an indent 146 below the hanger 112 (when stowed), such as below the corner 132*c* of the hanger 112, to further provide an access point for enabling the user to deploy the hanger 112.

Also similarly to the above-described handle 14, the portion of the handle 114 having the groove 126 may be made of a flexible material, such as a thermoplastic elastomer material, and the hanger 112 and/or hinge connector 154 may be made of a rigid material, such as a thermoplastic polymer. Similarly to the handle 14, the use of the flexible material for the handle 114 may provide several advantages. For example, the resiliency provided by the flexible material may deformably grip the hanger portion 132 via the sidewalls 142, 143 when the hanger 112 is stowed to prevent inadvertent deployment of the hanger 112 to the extended position. In addition, the handle 114 (e.g., flexible portion) may be pre-molded with the groove 126 and other features formed therein for minimizing the number of manufacturing steps.

Similarly to the handle 14, in exemplary embodiments the handle 114 may include a head portion 148 and a grip portion 150 that at least partially overlies the head portion 148. The grip portion 150 may be made of the relatively soft, flexible material described above, which may be overmolded onto the head portion 148 to secure the grip portion 150 to the head portion 148. As shown, the head portion 148 and/or grip portion 150 may be substantially similar to the above-described head portion 48 and grip portion 50, and consequently the same reference numerals are used to refer to similar structures between the head portions 48, 148 and grip portions 50, 150.

In exemplary embodiments, the head portion 148 of the handle 114 has the second hinge part 158 of the hinge connector 154 (e.g., pivot receiver 159), in which the head portion 148 extends inwardly through the grip portion 150 such that this second hinge part 158 is exposed within the surface groove 126 of the handle 114. More particularly, the grip portion 150 may be over-molded onto the head portion 148 to secure the grip portion 150 onto the head portion 148 (as discussed above), but is over-molded around the second hinge part 158 and with the groove 126 formed therein to provide the exposed hinge part 158 of the hinge connector 154. As shown in the illustrated embodiment, particularly with reference to FIGS. 25-27, the second hinge part 158 (e.g., snap-in receiver 159) is integral with the web portion 148*h* of the head portion 148 that extends from the end wall 148*g*. As noted above, it is understood that although the head portion 148 is shown having the pivot receiver 159 (e.g., resilient snap-in receiver), in other embodiments the head portion 148 may include the pivot 157, such as a pivot rod, that is received with a pivot receiver 159 (e.g., snap-in receiver) of the hanger 112.

The exemplary paint brush 114 provides one or more of the following advantages. The hinge connector 154 provides a simple assembly process in which the first hinge part 156 (e.g., pivot 157) of the hanger 112 may be connected with the second hinge part 158 (e.g., pivot receiver 159) disposed within the groove 126 of the handle 114. More particularly, the groove 126 may be pre-molded into the handle 114 (e.g., flexible grip portion 150) with the second hinge part 158 (e.g. pivot receiver 159) connected to the head portion 148 and already accessible within the groove 126 for connection to the hanger 112, thereby minimizing machining and assembly time. The grip portion 150 may be made of a flexible material, which may improve the grip on the hanger 112 to maintain the hanger 112 in the retracted (stowed) position. The hanger portion 132 (when stowed) may extend to the edge 121 of the handle 114 to improve accessibility to the user, and an indent 146 may be provided below the stowed hanger 112 to provide an access point to deploy the hanger 112 with only one hand. When in the stowed position, the hanger 112 may be flush with the outer surface 128 of the handle 114 (e.g., flexible grip portion 150), and also may have contoured surfaces, such as at the corner 132*c*, to provide a continuous flush surface, thereby enhancing the ergonomic design.

FIGS. 28-42 show another exemplary embodiment of a paint brush 210 having an integrated hanger 212, in which only the handle 214 is shown. The paint brush handle 214 is similar to the above-referenced paint brush handle(s) 14, 114, and consequently the same reference numerals but in the 200-series are used to denote structures corresponding to similar structures in the paint brush handles 14, 114, 214. In addition, the foregoing description of the paint brush(es) 10, 110 are equally applicable to the paint brush 210, except as noted below. For example, although the paint brush 210 is not shown with the ferrule or filaments, it is understood that such features of the paint brush 10 may be employed with the paint brush 210. In addition, it is understood that other aspects of the paint brushes 10, 110, 210 may be substituted for one another or used in conjunction with one another where applicable.

Figure 31:
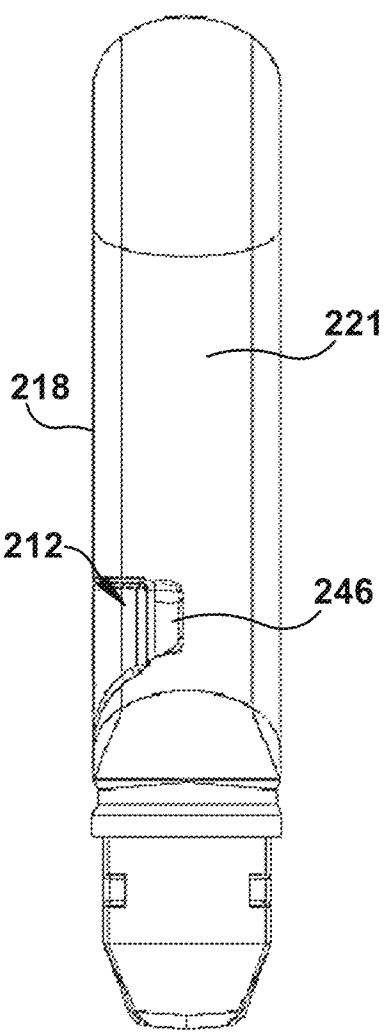
FIG. 31 is a right side view of the paint brush handle with the hanger in the retracted position.
Figure 30:
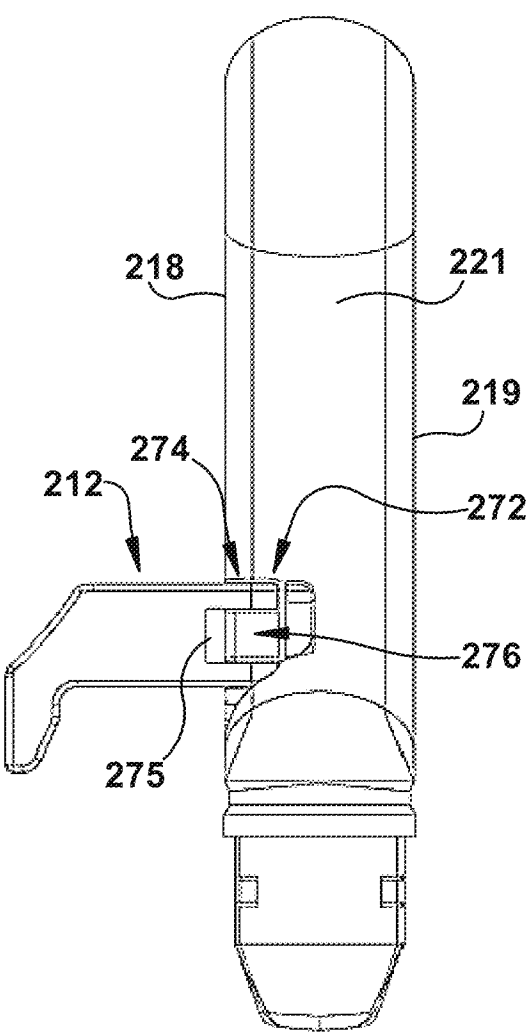
FIG. 30 is a right side view of the paint brush handle with the hanger in the extended position.
Figure 29:
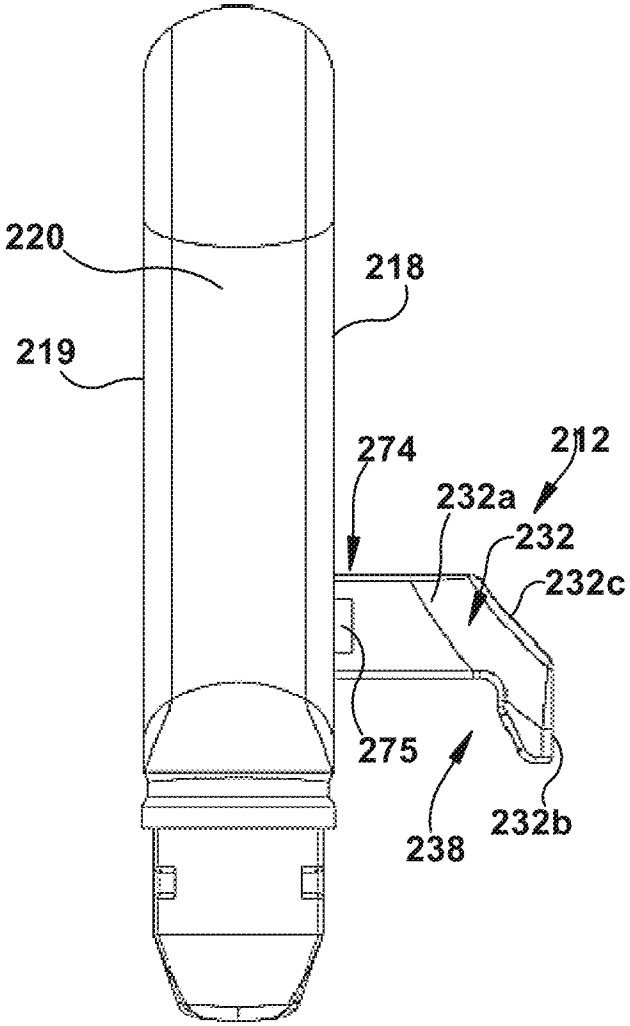
FIG. 29 is a left side view of the paint brush handle with the hanger in the extended position.
Figure 32:
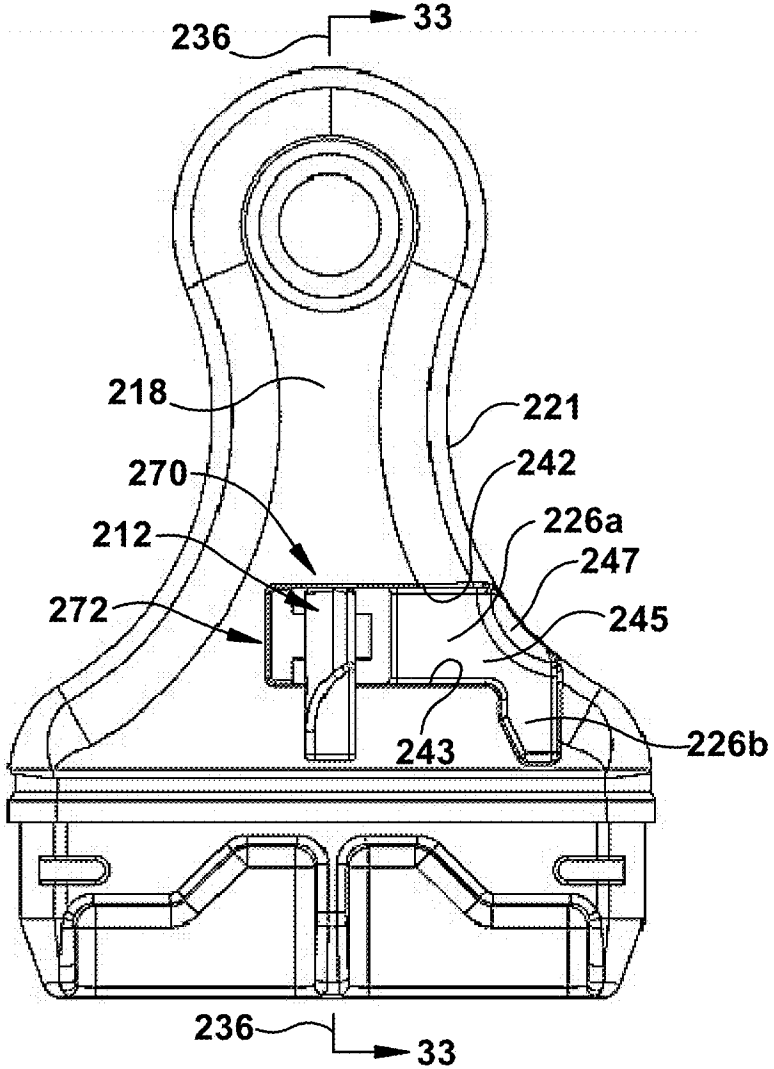
FIG. 32 is a front plan view of the paint brush handle with the hanger in the extended position.
Figure 33:
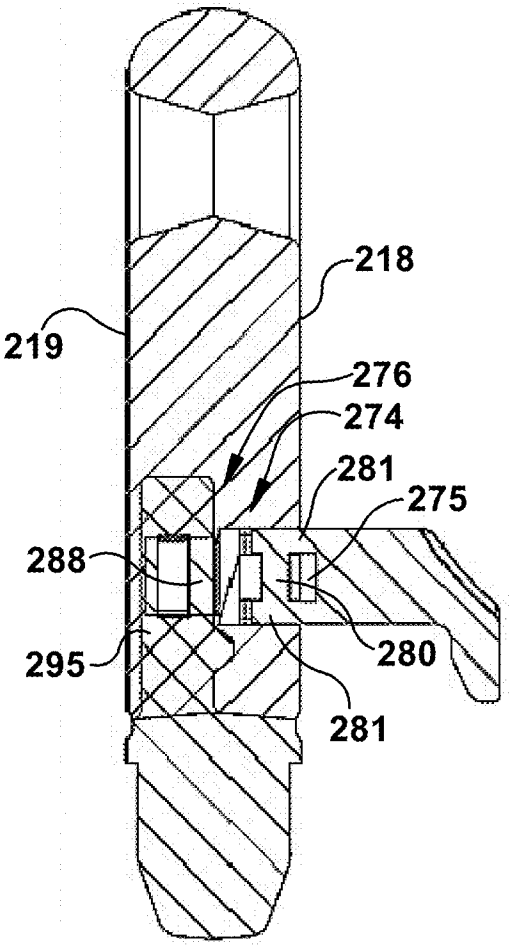
FIG. 33 is a cross-sectional view of the paint brush handle taken about the line 33-33 in FIG. 32.
Figure 34:
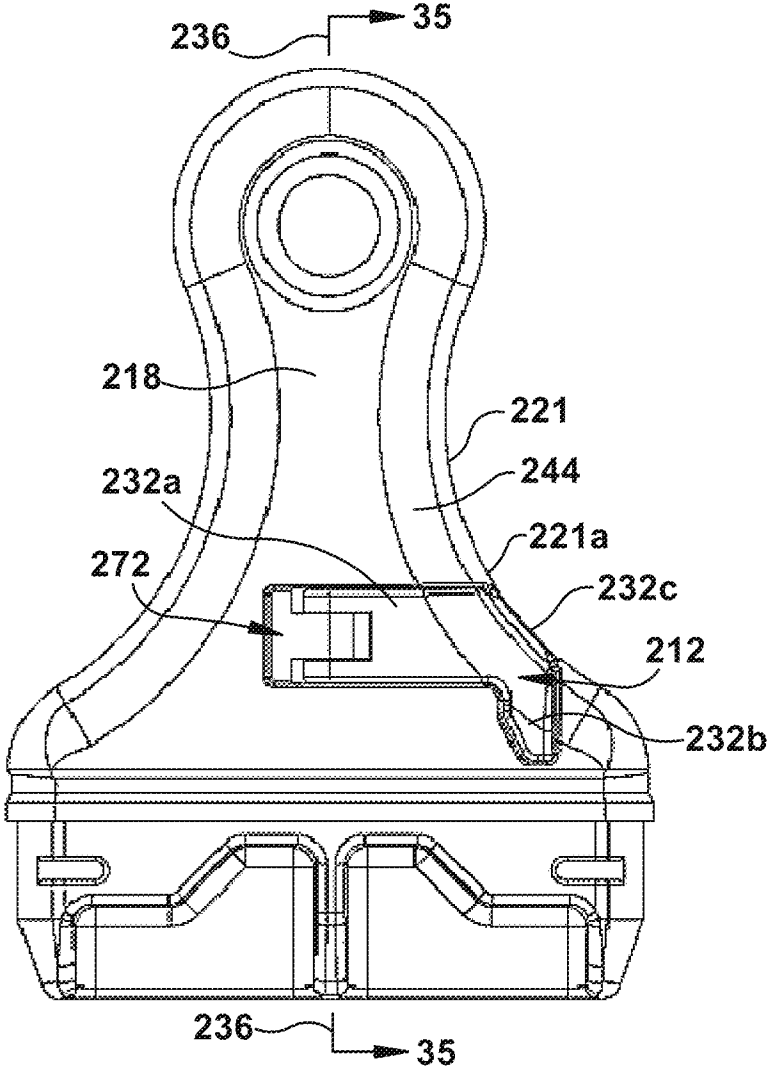
FIG. 34 is a front plan view of the paint brush handle with the hanger in the retracted position.
Figure 35:
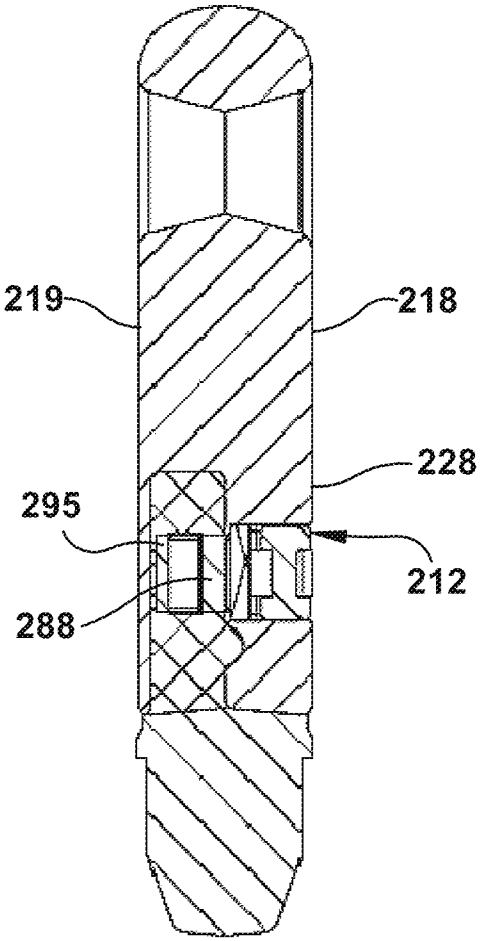
FIG. 35 is a cross-sectional view of the paint brush handle taken about the line 35-35 in FIG. 34.

As shown, the exemplary paint brush handle 214 has an outer surface 228 with a groove 226, and an exemplary hanger 212 operatively connected to the handle 214 with a hinge connector 270. The hanger 212 is pivotably movable between a retracted position (as shown in FIGS. 31, 34 and 35), and an extended position (as shown in FIGS. 28-30, 32 and 33). In exemplary embodiments, the paint brush 210 includes an integrally-formed hinge assembly 272 having a first linkage part 274 that forms a first loop 275 and a second linkage part 276 that forms a second loop 277, wherein the first and second loops 275, 277 are permanently (non-removably) and pivotably interlinked together.

In the illustrated embodiment, the hanger 212 includes the first linkage part 274 that forms the first loop 275 of the hinge assembly 272. For example, in the illustrated embodiment the hanger 212 includes a pivot 280, such as a pivot rod, that extends between opposing arms 281 at an end portion of the hanger 212 to form the first loop 275 that is linked with the second loop 277 of the second linkage part 276 (as best shown in 46, for example). In exemplary embodiments, the hanger 212 has a unitary construction, in which the first loop 275 is unitary with a hanger portion 232 of the hanger. Similarly to the above-described hanger(s) 12, 112, the hanger portion 232 of hanger 212 has respective first and second segments 232*a*, 232*b* that form a hook 238 which may be so dimensioned to hang the paint brush on an object such as a paint can, or the like.

Figure 36:
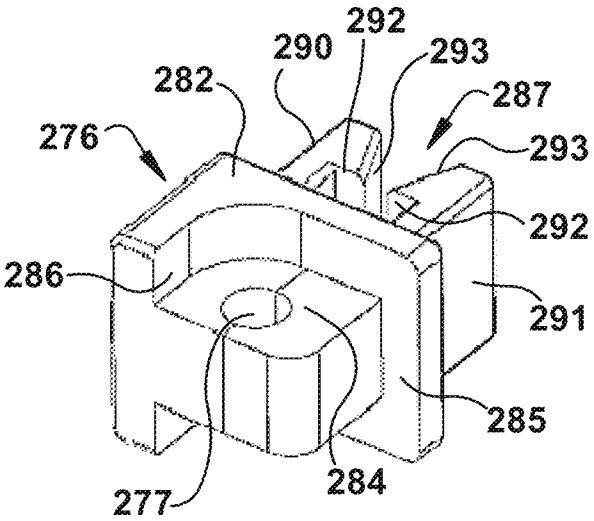
FIG. 36 is a perspective view of an exemplary hinge body of an exemplary integrally-formed hinge assembly shown without the exemplary hanger.
Figure 39:
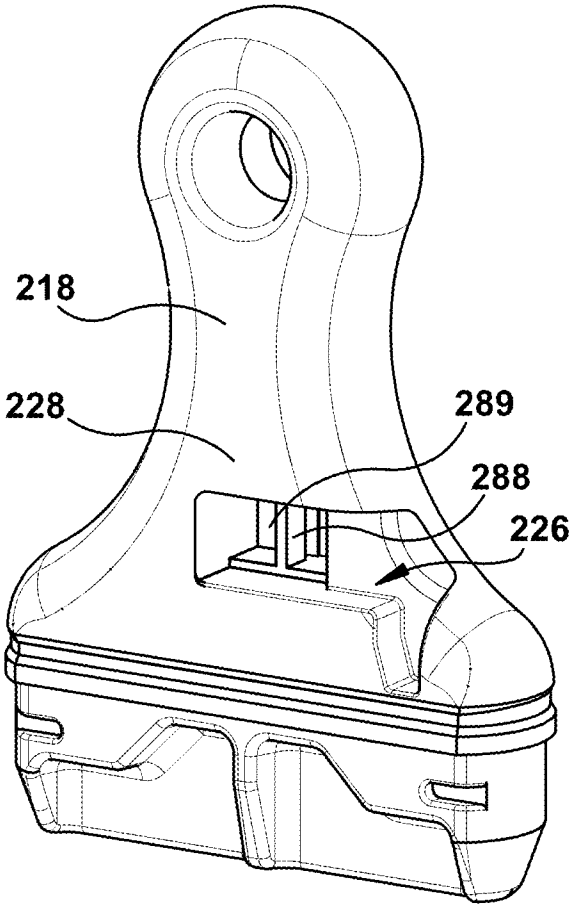
FIG. 39 is a perspective front view of the paint brush handle without the integrally-formed hinge assembly installed.
Figure 38:
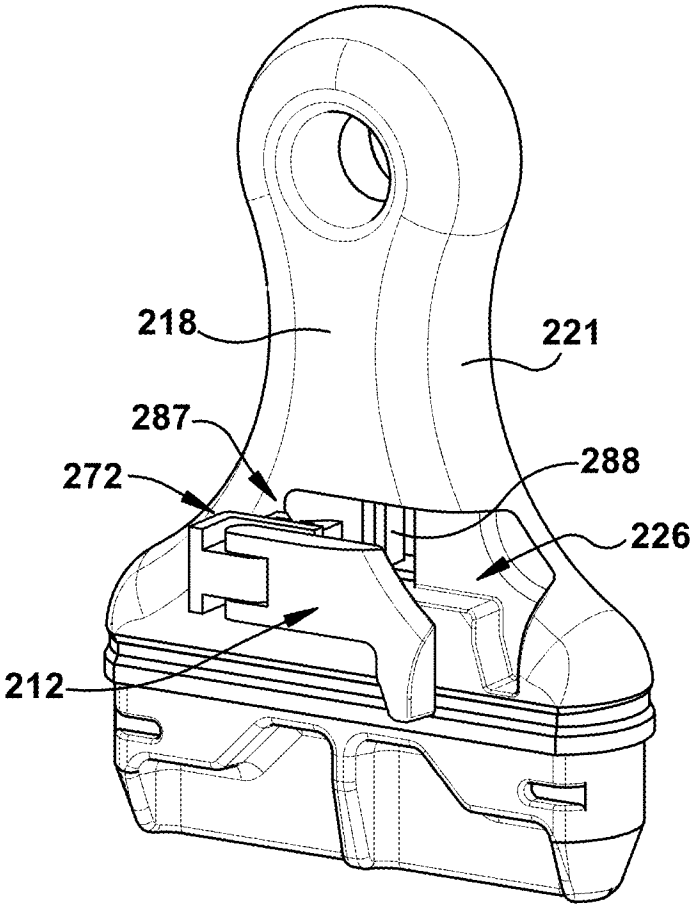
FIG. 38 is a perspective front view of the paint brush handle showing the installation of the integrally-formed hinge assembly.
Figure 40:
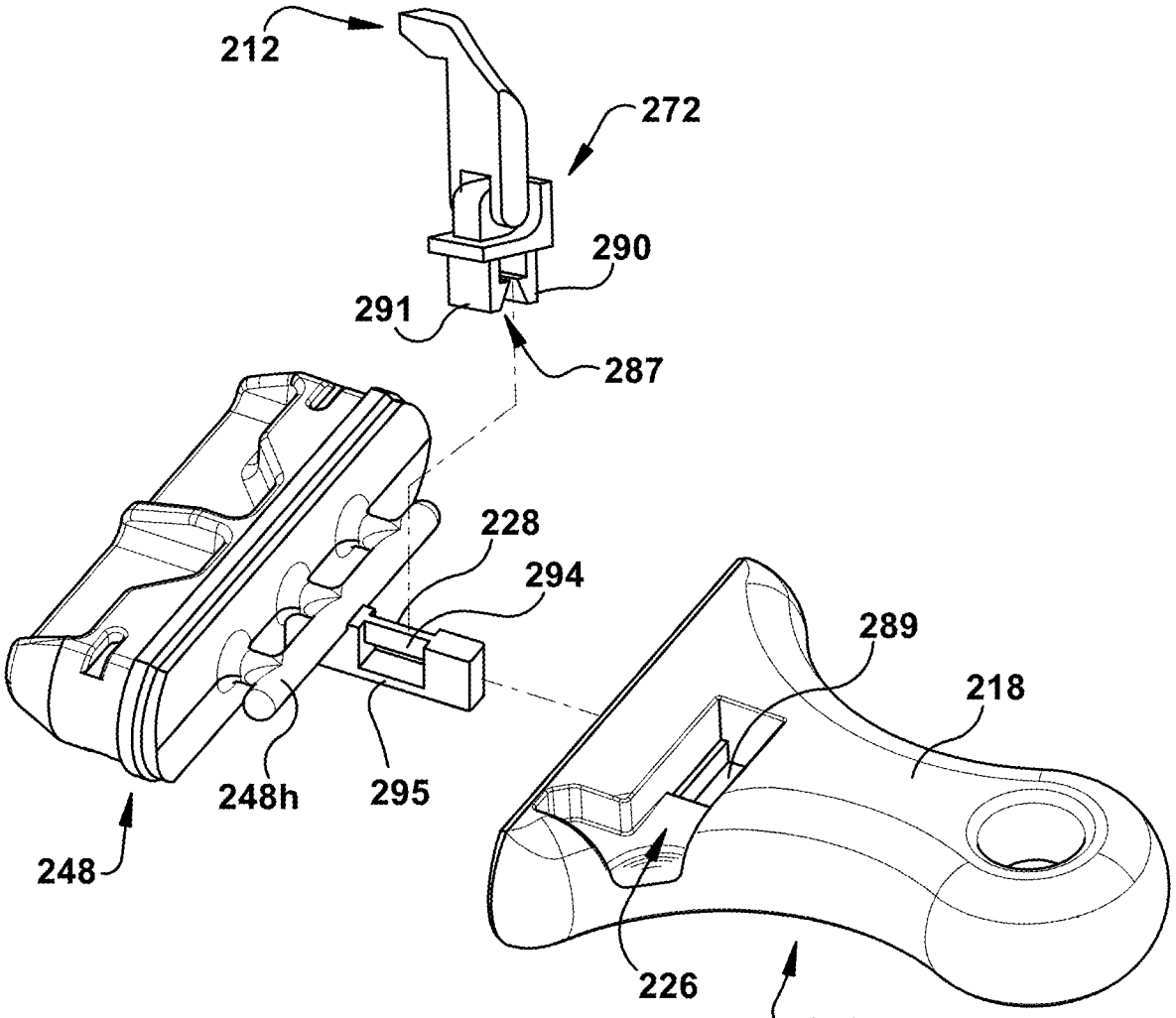
FIG. 40 is an exploded perspective front view of the paint brush handle with integrally-formed hinge assembly.
Figure 42:
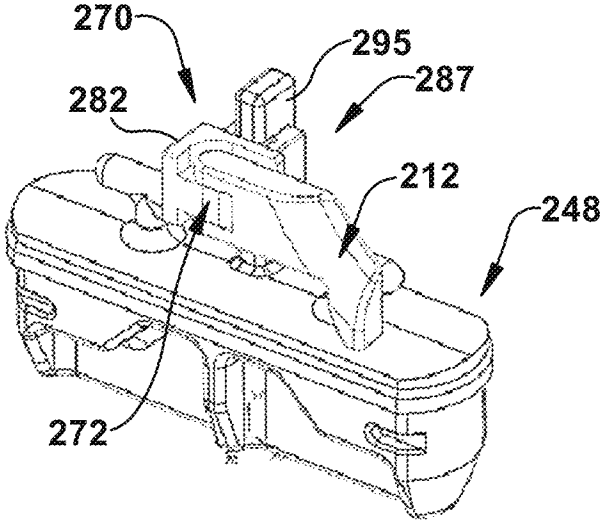
FIG. 42 is a perspective view of the head portion of the paint brush handle shown with the integrally-formed hinge assembly assembled.
Figure 41:
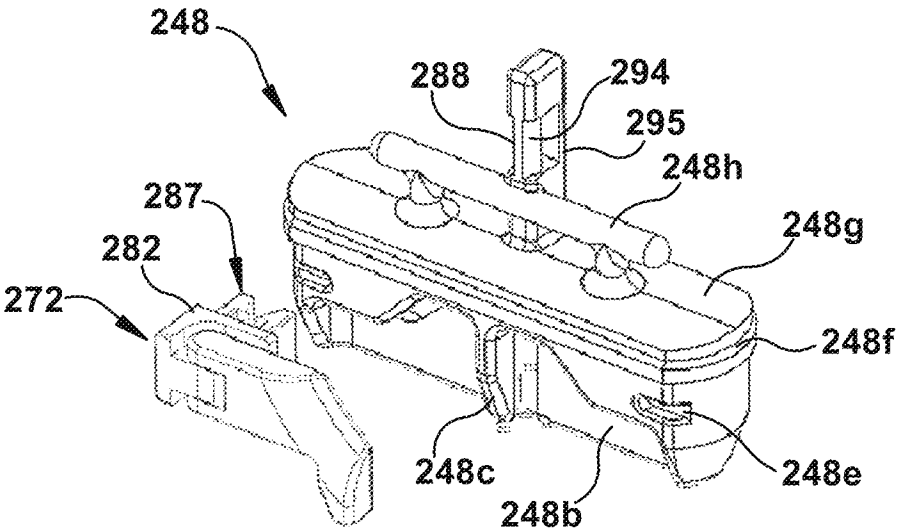
FIG. 41 is a perspective view of a head portion of the paint brush handle shown with the integrally-formed hinge assembly detached.

In exemplary embodiments, the second linkage part 276 of the integrally-formed hinge assembly 272 includes a hinge body 282 that is discrete with respect to the hanger 212 (e.g., first linkage part 274). As best shown in FIG. 36, for example, the hinge body 282 includes a hinge barrel portion 284 that continuously encompasses the pivot 280 of the hanger 212 to form the second loop 277 that permanently (i.e., non-removably) interlinks with the first loop 275 formed by the hanger 212. As shown, the hinge body 282 may include a back wall 285 that may serve as stop and/or anchor when the hinge assembly 272 is connected to the handle 214, as discussed below. The hinge body 282 also may include a side wall 286 that may restrict over-rotation of the hanger 212 when deployed to its extended position. In exemplary embodiments, the hinge body 282 further includes a connector 287, such as a resilient snap-in connector 287, for connecting the hinge assembly 272 to the handle 214, as discussed in further detail below.

The integrally-formed hinge assembly 272 may be formed as a single assembled unit by any suitable process, such as an injection molding process or an additive manufacturing process. For example, both the hanger 212 (including the pivot 280 formed by the first loop 275) and the hinge body 282 (including the hinge barrel 284 formed by the second loop 277) may be together formed by injection molding. In such a process, the hinge body 282 may be injection molded as a first shot thus forming loop 277, and then via the configuration of the mold tooling, after the first shot has cooled, the hanger 212 may be molded as the second shot thus forming loop 275, whereby the first and second loops 275, 277 are interlinked together directly in the mold during the injection molding process, commonly referred to as an in-mold assembly. Alternatively, the integrally-formed hinge assembly 272 may be formed by a suitable additive manufacturing process, such as fused filament fabrication, powder bed fusion, or the like. In such process(es) as described above, the integrally-formed hinge assembly 272 is molded or additively formed into a single structure, which reduces the need for multiple parts and/or post-machining processes. Moreover, since the hanger 212 and hinge body 282 are permanently interlinked during the process, these components cannot be disassembled from each other without destroying the hinge. This reduces the risk associated with disassembly and losing parts during use of the paint brush 210.

In exemplary embodiments, the integrally-formed hinge assembly 272 is a separate part that is connected to the handle 214 via any suitable connection. For example, in the illustrated embodiment the hinge body 282 includes the resilient snap-in connector 287 which constitutes a first part of the hinge connector 270 for connecting the hinge assembly 272 to a second part 288 of the connector 270 disposed in the handle 214, which may be any suitable structure. For example, in the illustrated embodiment, the second part 288 of the connector 270 is a post 288 that is configured to receive the snap-in connector 287 of the hinge assembly 272. As shown, the post 288 may be disposed in a deeper portion 289 of the groove 226, and is spaced apart from surfaces of the groove 226 to enable the snap-in connector 287 to connect with the post 288.

Figure 37:
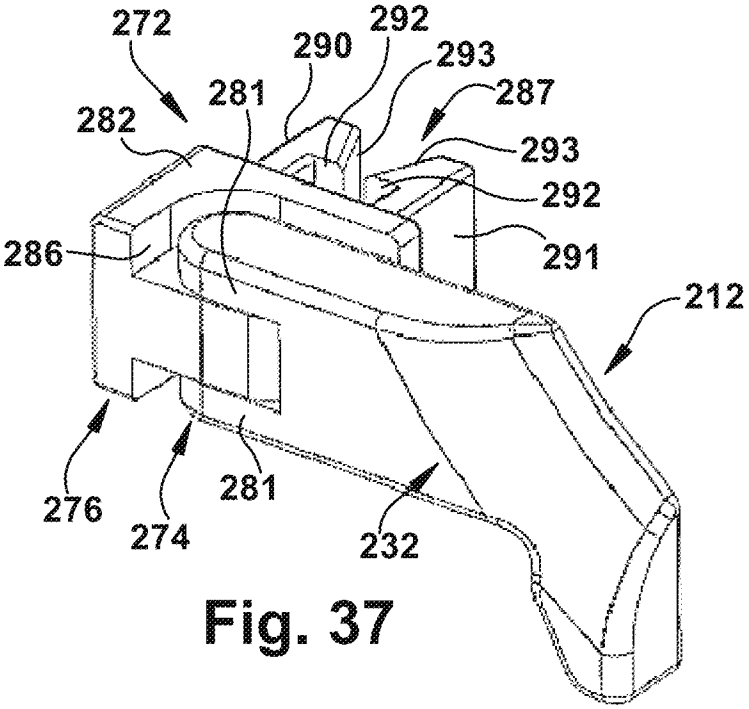
FIG. 37 is a perspective view of the integrally-formed hinge assembly shown with the hanger interlinked with the hinge body.

As shown in FIGS. 36 and 37, the resilient snap-in connector 287 of the hinge body 282 may include opposing first and second prongs 290, 291 that form a concave, generally U-shaped, connector. In exemplary embodiments, at least one of the prongs 290, 291 is resiliently movable relative to the other prong for connecting to the post 288 or other suitable structure in the handle 214. In the illustrated embodiment both prongs 290, 291 of the snap-in connector 287 are resiliently movable. As shown, one or more of the prongs 290, 291 also includes a catch 292, such as an abutment at the end of the prong, for gripping the post 288 or other suitable structure in the handle. Also as shown, one or more of the prongs 290, 291 may have a tapered surface 293 which is configured to interface with the post 288 (which also may have tapered surfaces 294) to facilitate insertion of the snap-in connector 287 onto the post 288. It is understood that although the hinge assembly 272 may be connected to the handle 214 in this manner, in other exemplary embodiments the integrally-formed hinge assembly 272 may be provided directly as part of the handle 214 by suitable techniques (e.g., additive manufacturing or injection molding), in which the interlinking between the first linkage (hanger 212) and second linkage (hinge body 282) would constitute the hinge connector 270.

Similarly to the above-described handles 14, 114, the groove 226 of the handle 214 has a shape that corresponds to a shape of the hanger portion 232 of the hanger 212, and the hanger 212 is configured to be flush with the outer surface 228 of the handle 214 when in the retracted and stowed position. Also similarly to the above-described handles 14, 114, the hanger 212 and groove 226 are disposed on the front side 218 of the handle 214 with the pivot axis 236 generally centrally located and extending in the longitudinal direction. Similarly, the groove 226 and the hanger 212 may extend to the edge 221 of the handle 214 such that a corner 232*c* of the hanger portion 232 (when stowed) is exposed at the edge 221 for improving access of the hanger 212 to the user. The corner 232*c* of the hanger 212 may be contoured to the shape of a curved surface 244 that connects the edge 221 of the handle with the front side 218 of the handle, and the corner 232*c* also may be contoured to the shape of the curved transition 221*a* along the edge 221 between the upper and lower portions of the handle 214. Such contouring of the hanger 212 provides a continuous flush interface between the outer surface 228 of the handle 214 and the hanger 212. Likewise, the hinge assembly 272 including the hinge body 282 may be configured to not protrude beyond the outer surface 228 of the handle 214 to enhance the ergonomics of the design. In addition, the edge 221 of the handle 214 may include an indent 246 below the hanger 212 (when stowed), such as below the corner 232*c* of the hanger 212, to further provide an access point for enabling the user to deploy the hanger 212.

Also similarly to the above-described handles 14, 114, the portion of the handle 214 having the groove 226 may be made of a flexible material, such as a thermoplastic elastomer material, and the hanger 212 and/or hinge body 282 may be made of a rigid material, such as a thermoplastic polymer. Similarly to the handles 14, 114, the use of the flexible material for the handle 214 may provide several advantages. For example, the resiliency provided by the flexible material may deformably grip the hanger portion 232 via the sidewalls 242, 243 when the hanger 212 is stowed to prevent inadvertent deployment of the hanger 212 to the extended position. In addition, the handle 214 (e.g., flexible portion) may be pre-molded with the groove 226 and other features formed therein for minimizing the number of manufacturing steps.

Similarly to the handles 14, 114, in exemplary embodiments the handle 214 may include a head portion 248 and a grip portion 250 that at least partially overlies the head portion 248. The grip portion 250 may be made of the relatively soft, flexible material described above, which may be over-molded onto the head portion 248 to secure the grip portion 250 to the head portion 248. As shown, the head portion 248 and/or grip portion 250 may be substantially similar to the above-described head portion 48, 148 and grip portion 50,150, and consequently the same reference numerals are used to refer to similar structures between the head portions 48, 148, 248 and grip portions 50, 150, 250.

In exemplary embodiments, the head portion 248 of the handle 214 has the second part 288 of the connector 270 (e.g., post 288 or other suitable structure) for connecting the integrally-formed hinge assembly 272 to the handle 214. As shown in the illustrated embodiment, the head portion 248 may extend inwardly through the grip portion 250 such that the connector second part 288 (e.g., post 288) is exposed within the groove 226 of the handle 214. More particularly, the grip portion 250 may be over-molded onto the head portion 248 to secure the grip portion 250 onto the head portion 248 (as discussed above), but is over-molded around the post 288 and with the groove 226 formed therein to provide the exposed second part (e.g., post 288) of the hinge connector 270. As discussed above, the groove 226 may be pre-molded with a deeper portion 289 to provide spacing around the post 288, thereby enabling insertion of the prongs 290, 291 of the hinge assembly 272. As shown in the illustrated embodiment, the connector second part (e.g., post 288) is integral with the web portion 248*h* of the head portion 248 via a main support structure 295. In exemplary embodiments, the post 288 is spaced apart from the main support structure 295 such that the prongs 290, 291 of the snap-in connector 287 may better grip and secure onto the post 288. It is understood that although the integrally-formed hinge assembly 272 is shown having the resilient snap-in connector 287, in other embodiments the head portion 248 may include the snap-in connector 287 for receiving a post 288 or other suitable structure of the integrally-formed hinge assembly 272.

The exemplary paint brush 210 provides one or more of the following advantages. The integrally-formed hinge assembly 272 provides a more secure pivotable connection for the hanger 212 which cannot be disassembled without destroying the hinge assembly 272. In addition, the integrally-formed hinge assembly 272 may be connected to the handle via a simple assembly process in which the connector first part (e.g., snap-in connector 287) of the hinge-assembly 272 may be connected with the connector second part (e.g., post 288 or other suitable structure) disposed within the groove 226 of the handle 214. More particularly, the groove 226 may be pre-molded into the handle 214 (e.g., flexible grip portion 250) with the connector second part (e.g. post 288) already accessible for connection to the integrally-formed hinge assembly 272 via snap-in connector 287, thereby minimizing machining and assembly time. The handle 214 (e.g., grip portion 250) may be made of a flexible material, which may improve the grip on the hanger 212 to maintain the hanger 212 in the retracted (stowed) position. The hanger portion 232 (when stowed) may extend to the edge 221 of the handle 214 to improve accessibility to the user, and an indent 246 may be provided below the stowed hanger 212 to provide an access point to deploy the hanger 212 with only one hand. When in the stowed position, the hanger 212 may be flush with the outer surface 228 of the handle 214 (e.g., flexible grip portion 250), and also may have contoured surfaces, such as at the corner 232*c*, to provide a continuous flush surface, thereby enhancing the ergonomic design.

FIGS. 43-56 show another exemplary embodiment of a paint brush 310, or components thereof. Similarly to the foregoing embodiments, the paint brush 310 includes an integrated hanger 312 that is hinged to the handle 314 for pivotable movement of the hanger 312 between retracted and stowed positions. In the figures, only the handle 314 with the hanger 312 of the paint brush 310 is shown. The handle 314 is similar to the above-referenced paint brush handle(s) 14, 114, 214 and consequently the same reference numerals but in the 300-series are used to denote structures corresponding to similar structures in the paint brush handles 14, 114, 214. In addition, the foregoing description of the paint brush 10, 110, 210 is equally applicable to the paint brush 310, except as noted below. For example, although the paint brush 310 is not shown with the ferrule or filaments, it is understood that such features of the paint brush 10 may be employed with the paint brush 310. In addition, it is understood that other aspects of the paint brushes 10, 110, 210, 310 may be substituted for one another or used in conjunction with one another where applicable.

Figure 45:
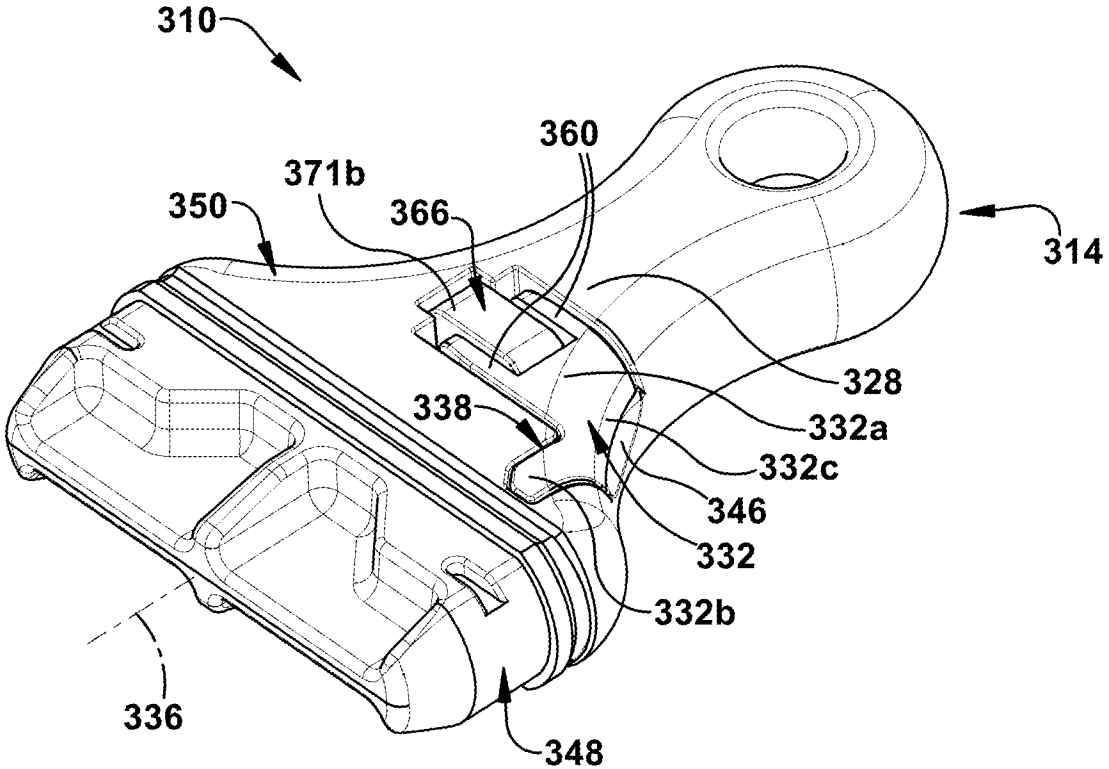
FIG. 45 is a bottom perspective view of the handle with the hanger assembled to the handle with a hinge connector, and with the hanger shown in an exemplary stowed position.
Figure 48:
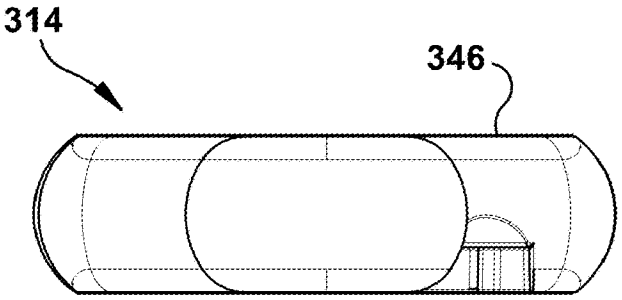
FIG. 48 is a top view of the handle without the hanger assembled thereto.
Figure 47:
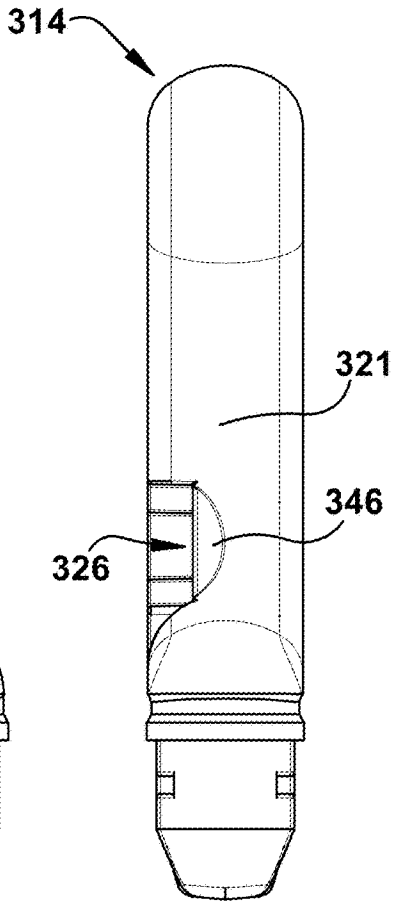
FIG. 47 is a right side view of the handle without the hanger assembled thereto.
Figure 46:
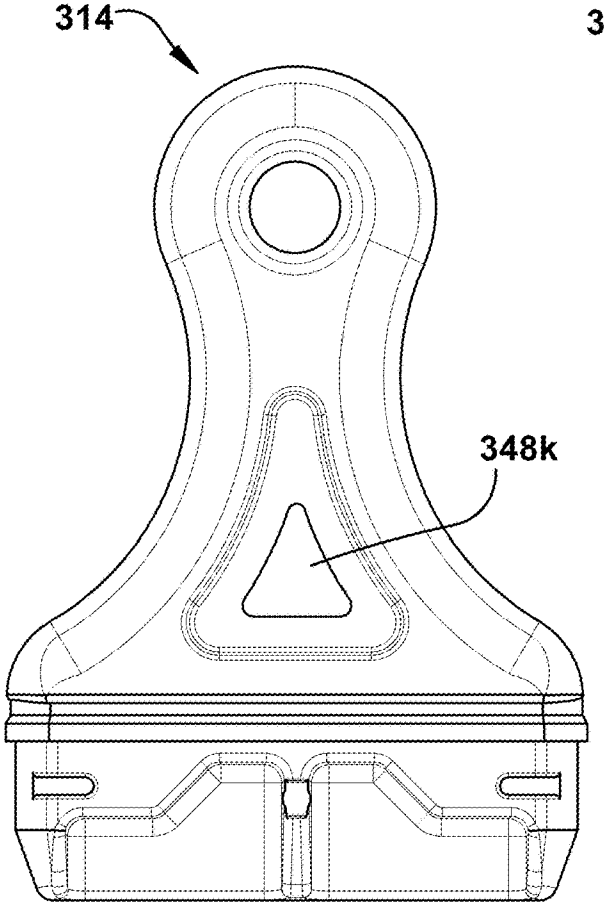
FIG. 46 is a rear view of the handle without the hanger assembled thereto.

As shown, the exemplary paint brush handle 314 has an outer surface 328 with a groove 326, and an exemplary hanger 312 hinged to the handle 314 with a hinge connector 354 for providing pivotable movement of the hanger 312 between a retracted position (as shown in FIGS. 45, 47, 48 for example), and an extended position (e.g., FIGS. 62A-62H, described below). In exemplary embodiments, the hinge connector 354 includes a first hinge part 356 having a pivot 357, and second and third hinge parts 358, 366 that cooperate with each other to pivotably secure the first hinge part 356 to the handle 314, such that the hanger 312 is pivotably movable between the retracted and extended positions.

Figure 54:
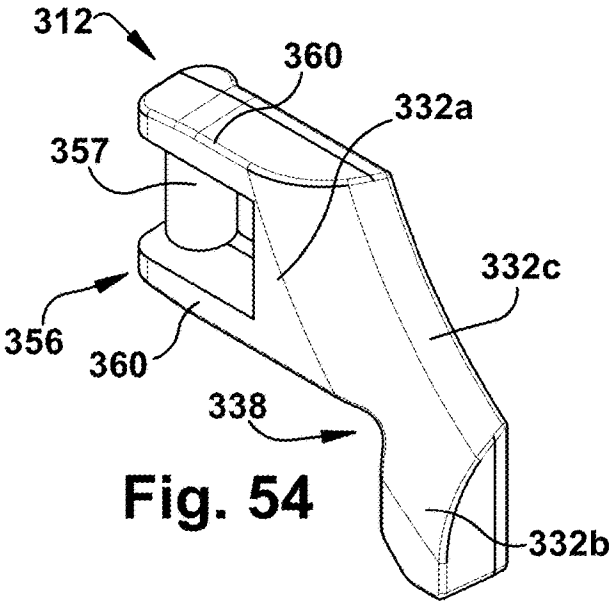
FIG. 54 is a perspective view of another exemplary hinge part of the hinge connector of the handle in FIG. 45.
Figure 55:
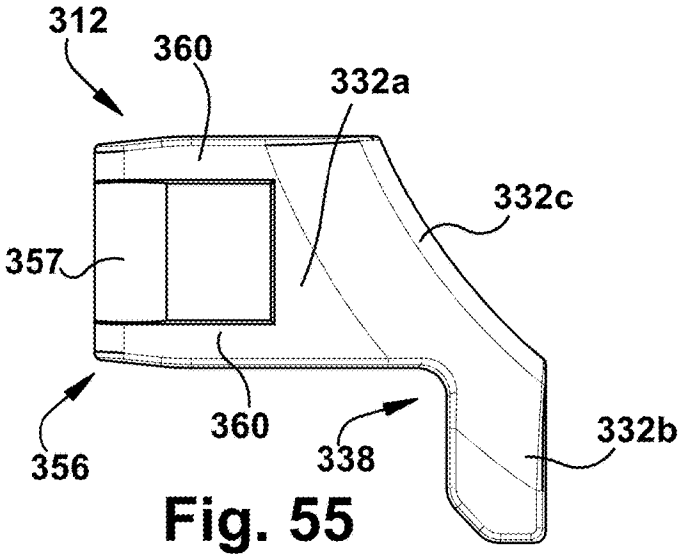
FIG. 55 is a top view of the other hinge part.
Figure 56:
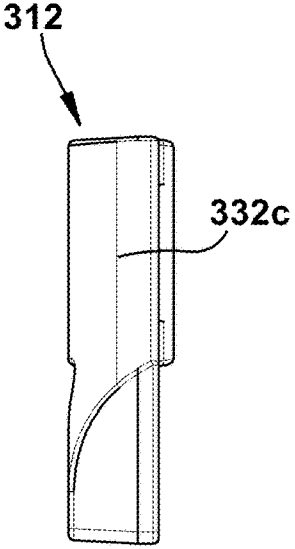
FIG. 56 is a side view of the other hinge part.

As shown in the illustrated embodiment, particularly with reference to FIGS. 54-56, the pivot 357 is formed as a pivot rod that extends between opposing arms 360 at an end portion of the hanger 312 to form a loop that is pivotable interlinked between the second hinge part 358 and the third hinge part 366 (as shown in FIG. 45, for example). In exemplary embodiments the hanger 312 has a unitary construction, in which the pivot 357 is unitary with a hanger portion 332 of the hanger 312. Similarly to the above-described hanger(s) 12, 112, 212 the hanger portion 332 of hanger 312 includes respective first and second segments 332*a*, 332*b* that form a hook 338 which may be so dimensioned to hang the paint brush on an object such as a paint can, or the like.

In exemplary embodiments, the second hinge part 358 includes at least one receiver 367 that is configured to receive at least one portion of the third hinge part 366 to pivotably secure the pivot 357 of the hanger 312 to the handle 314. In the illustrated embodiment, the at least one receiver is configured as a socket 367, and the at least one portion of the third hinge part 366 received by the socket 367 is configured as at least one pin 368. As shown, the first hinge part 358 includes a pair of laterally spaced apart sockets 367 that open to a mounting face 369 of the second hinge part 358 for receiving corresponding laterally spaced apart pins 368. As shown, the pins 368 extend from a cross-member portion 371 of the third hinge part 366, in which the cross-member portion 371 may mate with the mounting face 369 of the second hinge part 358. In the illustrated embodiment, the cross-member portion 371 includes a lateral portion 371*b*. The lateral portion 371*b* has a width that spans between the opposing arms 360 of the first hinge part 356 to permit pivotable movement of the hanger 312 relative to the third hinge part 366.

In the illustrated embodiment, the receiver(s) 367 (e.g., sockets 367) of the second hinge part 358 receive and secure the portion(s) (e.g. the pins 368) of the third hinge part 366 with a friction fit. For example, the pins 368 may be slightly oversized relative to the sockets 367 such that the pins 368 and/or sockets 367 slightly deform (e.g., either with elastic or plastic deformation) to frictionally and/or resiliently engage each other with sufficient force to hold the third hinge part 366 to the second hinge part 358. In this manner, the third hinge part 366 may be press-fit into second hinge part 358. In exemplary embodiments, the sockets 367 have a polygonal-shaped cross-section, such as a hexagonal shaped cross-section, that receive pins 368 with a round cross-section. Such hexagonal-shaped sockets 367 may be easier to displace (deform) and frictionally hold the pins 368 compared to round sockets with round pins. The second hinge part 358 and the third hinge part 366 may be made of the same material (e.g., polypropylene), or one of the hinge parts 358, 366 may be made of a more resilient material to facilitate insertion and holding of the hinge parts 358, 366 together. It is understood that although in the illustrated embodiment, the second hinge part 358 has the receiver(s) (e.g., sockets 367) for receiving portion(s) (e.g., pins 368) of the third hinge part 366, that in alternative embodiments the third hinge part 366 could have the receiver(s) (e.g., sockets) for receiving portion(s) (e.g., pins) of the second hinge part 358.

Figure 44:
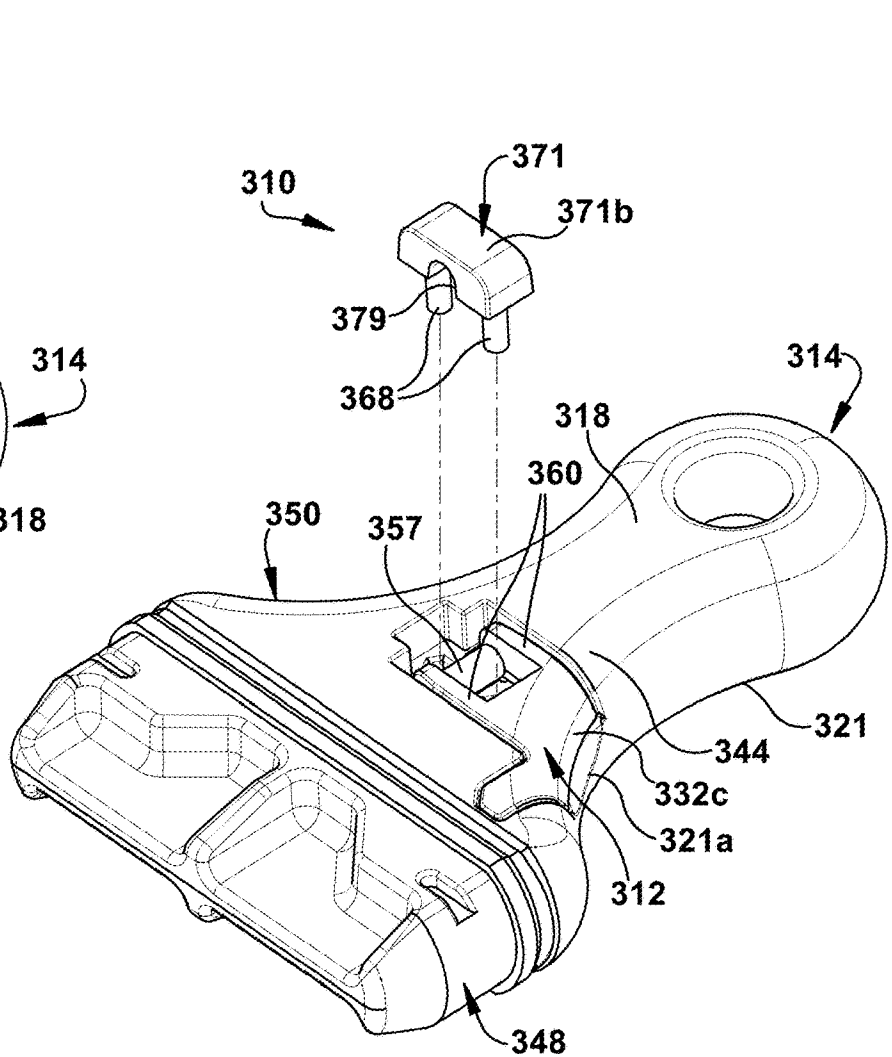
FIG. 44 is a partially exploded perspective bottom view of the handle in FIG. 43 with the exemplary hanger shown in a groove of the handle.
Figure 43:
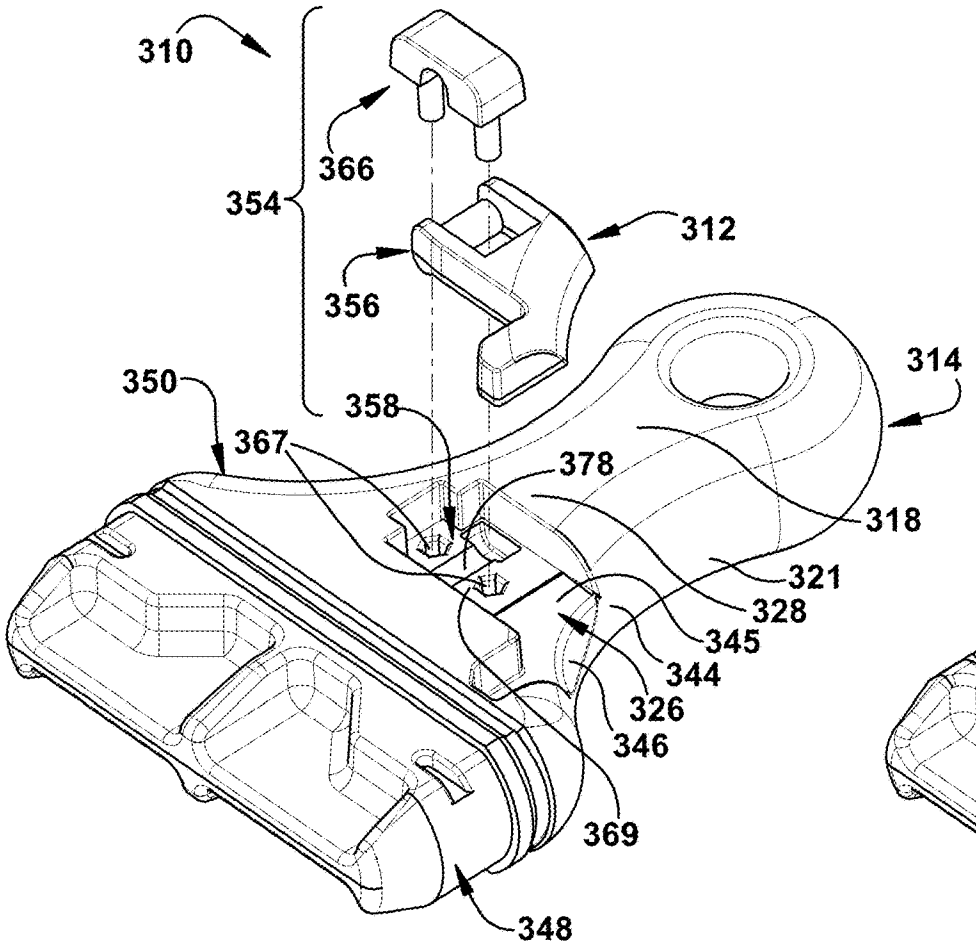
FIG. 43 is a partially exploded perspective bottom view another exemplary handle of another exemplary paint brush with another exemplary hanger.
Figure 50:
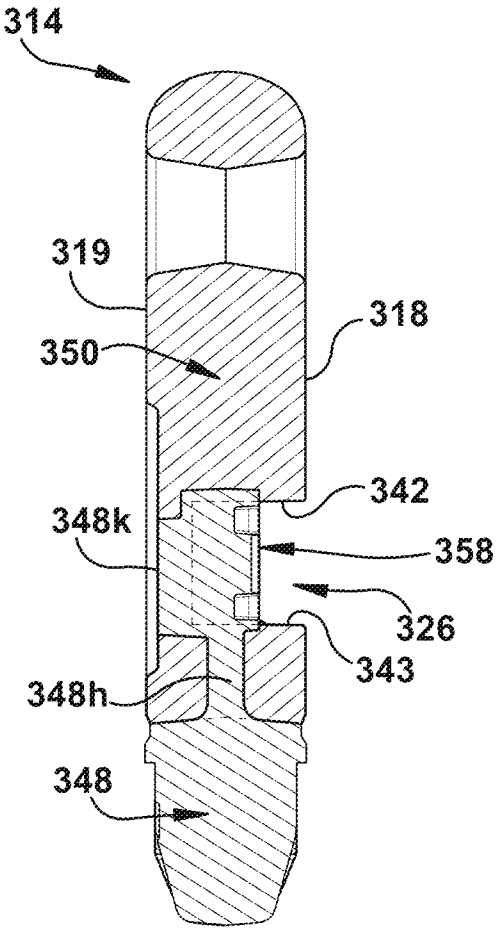
FIG. 50 is a cross-sectional view taken about the line 50-50 in FIG. 49.
Figure 49:
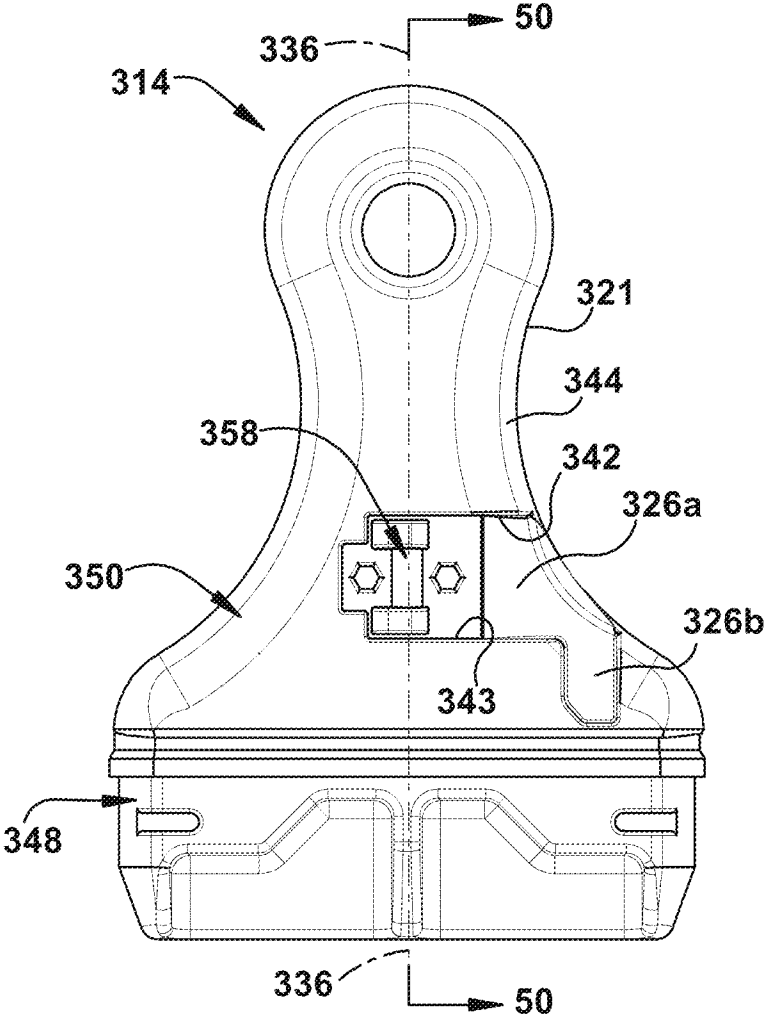
FIG. 49 is a front view of the handle without the hanger assembled thereto.
Figure 51:
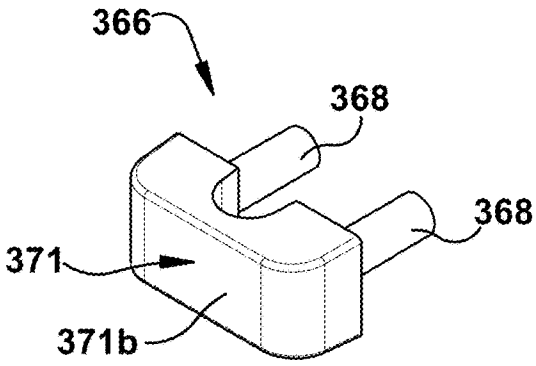
FIG. 51 is a perspective view of an exemplary hinge part of the hinge connector of the handle in FIG. 45.
Figure 52:
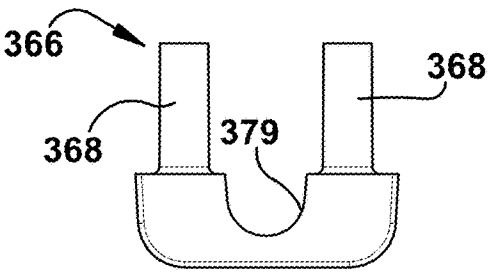
FIG. 52 is a top view of the hinge part.
Figure 53:
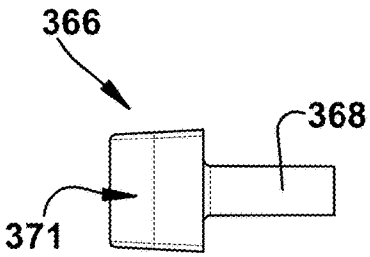
FIG. 53 is a side view of the hinge part.

In exemplary embodiments, the mounting face 369 of the second hinge part 358 is flush with the bottom surface 345 of the groove 326, and the pin(s) 368 are inserted deep enough into the socket(s) 367 such that the third hinge part 366 does not protrude beyond the outer surface 328 of the handle 314 from within the groove 326 (as shown in FIG. 44 or FIG. 50, for example). Such feature(s) enhance the ergonomics of the handle 314 by not having the hinge connector 354 protrude from the groove. As shown, the mounting face 369 of the second hinge part 358 may have a curved, generally U-shaped recess 378 that may receive a portion of the pivot 357. The cross-member portion 371 also may have a U-shaped recess 379 for receiving a portion of pivot 357. Such U-shaped features may further facilitate the flushness and ergonomics of the design while further facilitating the pivoting function of the hanger 312.

Similarly to the above-described handle(s) 14, 114, 214, the groove 326 of the handle 314 has a shape that corresponds to a shape of the hanger portion 332 of the hanger 312, and the hanger 312 may be configured to be flush with the outer surface 328 of the handle 314 when in the retracted and stowed position. Also similarly to the above-described handle(s) 14, 114, 214, the hanger 312 and groove 326 are disposed on the front side 118 of the handle 114 with the pivot axis 336 generally centrally located and extending in the longitudinal direction. Similarly, the groove 326 and the hanger 312 may extend to the edge 321 of the handle 314 such that a corner 332*c* of the hanger portion 332 (when stowed) is exposed at the edge 321 for improving access of the hanger 312 to the user. The corner 332*c* of the hanger 312 may be contoured to the shape of a curved surface 344 that connects the edge 321 of the handle with the front side 318 of the handle. The corner 332*c* also may be contoured to the shape of the curved transition 321*a* along the edge 321 between the upper and lower portions of the handle 314. Such contouring of the hanger 312 provides a continuous flush interface between the outer surface 328 of the handle 314 and the hanger 312. In addition, the edge 321 of the handle 314 may include an indent 346 below the hanger 312 (when stowed), such as below the corner 332*c* of the hanger 312, to further provide an access point for enabling the user to deploy the hanger 312.

Also similarly to the above-described handle(s) 14, 114, 214, the portion of the handle 314 having the groove 326 may be made of a flexible material, such as a thermoplastic elastomer material, and the hanger 312 and/or hinge connector 354 may be made of a rigid material, such as a thermoplastic polymer. Similarly to the handle(s) 14, 114, 214, the use of the flexible material for the handle 314 may provide several advantages. For example, the resiliency provided by the flexible material may deformably grip the hanger portion 332 via the sidewalls 342, 343 when the hanger 312 is stowed to prevent inadvertent deployment of the hanger 312 to the extended position. In addition, the handle 314 (e.g., flexible portion) may be pre-molded with the groove 326 and other features formed therein for minimizing the number of manufacturing steps.

Similarly to the handle(s) 14, 114, 214, in exemplary embodiments the handle 314 may include a head portion 348 and a grip portion 350 that at least partially overlies the head portion 348. The grip portion 350 may be made of the relatively soft, flexible material described above, which may be over-molded onto the head portion 348 to secure the grip portion 350 to the head portion 348. As shown, the head portion 348 and/or grip portion 350 may be substantially similar to the above-described head portion(s) 48, 148, 248 and grip portion(s) 50, 150, 250, and consequently the same reference numerals are used to refer to similar structures between the head portions 48, 148, 248, 348 and grip portions 50, 150, 250, 350.

In exemplary embodiments, the head portion 348 of the handle 314 has the second hinge part 358 of the hinge connector 354, in which the head portion 348 extends inwardly through the grip portion 350 such that this second hinge part 358 is exposed within the surface groove 326 of the handle 314. More particularly, the grip portion 350 may be over-molded onto the head portion 348 to secure the grip portion 350 onto the head portion 348 (as discussed above). The grip portion 350 may be over-molded around the second hinge part 358 and with the groove 326 formed therein to provide the exposed second hinge part 358 of the hinge connector 354. As shown in the illustrated embodiment, particularly with reference to FIG. 50, the second hinge part 358 (e.g., having the receivers 159) may be integral with the web portion 348*h* of the head portion 348.

Also shown in the illustrated embodiment, the head portion 348 may have a rearward portion 348*k* that extends through the rear surface of the grip portion 350 opposite the groove 326. Because the grip portion 350 (e.g., second shot) may be over-molded onto the head portion 348 (e.g., first shot), such a rearward portion 348*k* may help to prevent the head portion material from re-melting and flowing into the groove 326 formed in the grip portion material during the second shot. In other words, the rearward portion 348*k* may help to hold the head portion 348 (e.g., first shot) in the cavity when forming the grip portion 350 (e.g., second shot), thereby enabling more precision in the formation of the hinge connector 354.

The exemplary paint brush 314 provides one or more of the following advantages. The hinge connector 354 provides a simple assembly process in which the first hinge part 356 (e.g., pivot 357) of the hanger 312 may be connected within the groove 326 via the second hinge part 358 (e.g., having receiver 367) and the third hinge part 366 (e.g., having the pin(s) 368). More particularly, the groove 326 may be pre-molded into the handle 314 (e.g., flexible grip portion 350) with the second hinge part 358 connected to the head portion 348 and already accessible within the groove 326 for connection to the first hinge part (e.g., pivot 357) with the third hinge part 366, thereby minimizing machining and assembly time. The third hinge part 366 may be easily inserted or press-fit into connection with the second hinge part 358 to facilitate such connection of the hanger 312. The grip portion 350 may be made of a flexible material, which may improve the grip on the hanger 312 to maintain the hanger 312 in the retracted (stowed) position. The hanger portion 332 (when stowed) may extend to the edge 321 of the handle 314 to improve accessibility to the user, and an indent 346 may be provided below the stowed hanger 312 to provide an access point to deploy the hanger 312 with only one hand. When in the stowed position, the hanger 312 may be flush with the outer surface 328 of the handle 314 (e.g., flexible grip portion 350), and also may have contoured surfaces, such as at the corner 332*c*, to provide a continuous flush surface, thereby enhancing the ergonomic design.

FIGS. 57-60 show another exemplary embodiment of a paint brush 410, or components thereof. Similarly to the foregoing embodiments, the paint brush 410 includes an integrated hanger 412 that is hinged to the handle 414 for pivotable movement of the hanger 412 between retracted and stowed positions. In the figures, only the handle 414 with the hanger 412 of the paint brush 410 is shown. The handle 414 is similar to the above-referenced paint brush handle(s) 14, 114, 214, 314 and consequently the same reference numerals but in the 400-series are used to denote structures corresponding to similar structures in the paint brush handles 14, 114, 214, 314. In addition, the foregoing description of the paint brush 10, 110, 210, 310 is equally applicable to the paint brush 410, except as noted below. For example, although the paint brush 410 is not shown with the ferrule or filaments, it is understood that such features of the paint brush 10 or 310 may be employed with the paint brush 410. In addition, it is understood that other aspects of the paint brushes 10, 110, 210, 310, 410 may be substituted for one another or used in conjunction with one another where applicable.

As shown, similarly to the paint brushes 10, 110, 210, and 310, the paint brush 410 includes a surface groove 426 in a front side 418 of the handle, in which the groove 426 extends laterally (horizontally) to open to an edge 421 of the handle 414. The hanger 412 when in the retracted position extends to the edge 421 such that a corner 432*c* of the hanger 412 is exposed at the edge 421 for enabling pivoting of the hanger from the retracted to extended position. The corner 432*c* of the hanger 412 may be contoured to the shape of a curved surface 444 that connects the edge 421 of the handle with the front side 418 of the handle. The corner 432*c* also may be contoured to the shape of the curved transition 421*a* along the edge 421 between the upper and lower portions of the handle 414. Such contouring of the hanger 412 provides a continuous flush interface between the outer surface of the handle 414 and the hanger 412. In addition, the edge 421 of the handle 414 may include a recess or indent 446 below the hanger 412 (when stowed), such as below the corner 432*c* of the hanger 412, to further provide an access point for enabling the user to deploy the hanger 412. Similarly to the foregoing embodiments of paint brushes 10-310, the recess or indent 446 may be formed by a deeper part of the groove 426, such that the bottom surface of the indent portion 446 is spaced apart from the corner 432*c* of the hanger 412 when in the retracted position.

Figure 58:
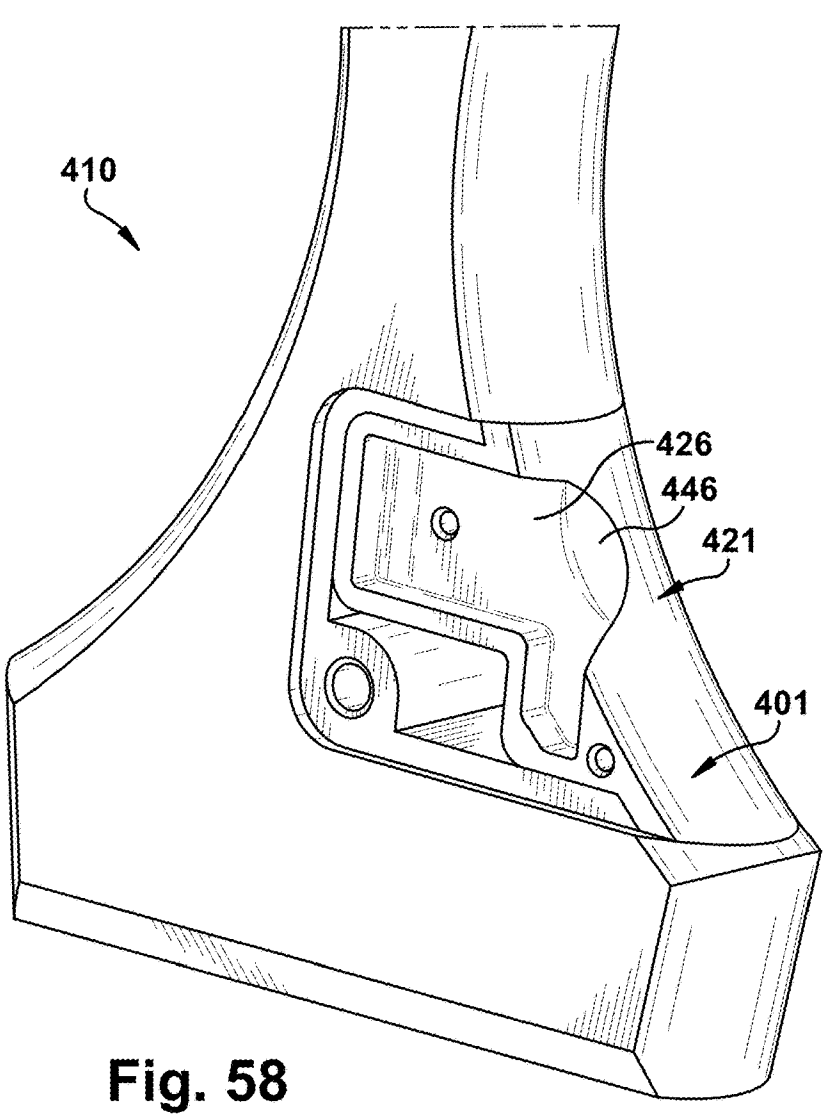
FIG. 58 is a perspective view of the subassembly in FIG. 57 with an exemplary insert.
Figure 57:
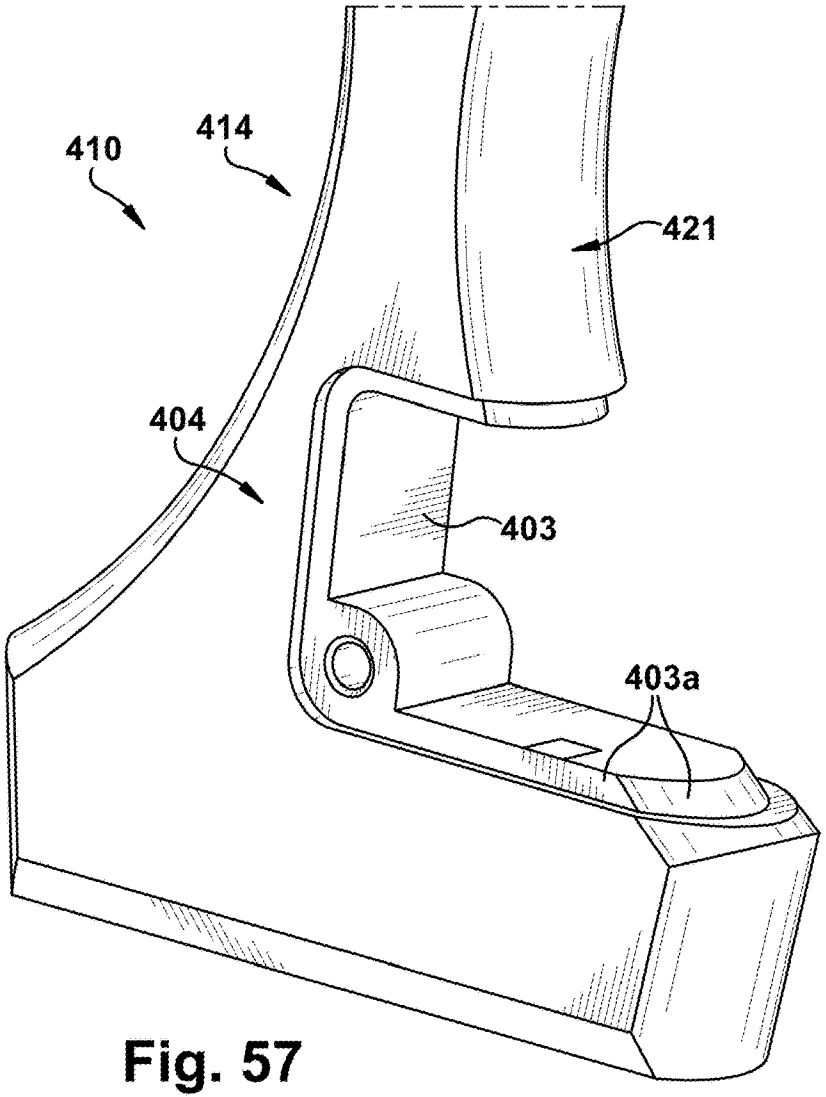
FIG. 57 is a perspective view of an exemplary subassembly of another exemplary handle of another exemplary paint brush.
Figure 60:
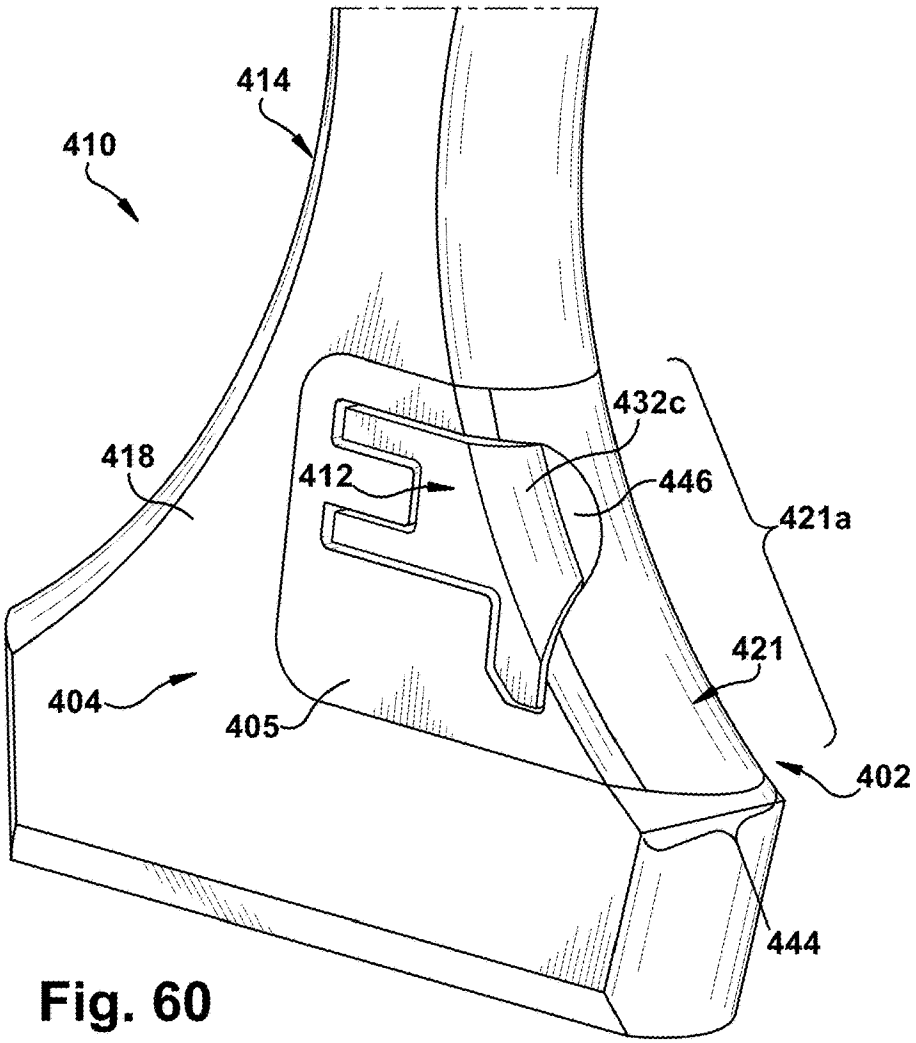
FIG. 60 is a perspective view of an exemplary paint brush handle assembly for an exemplary paint brush according to an embodiment.
Figure 59:
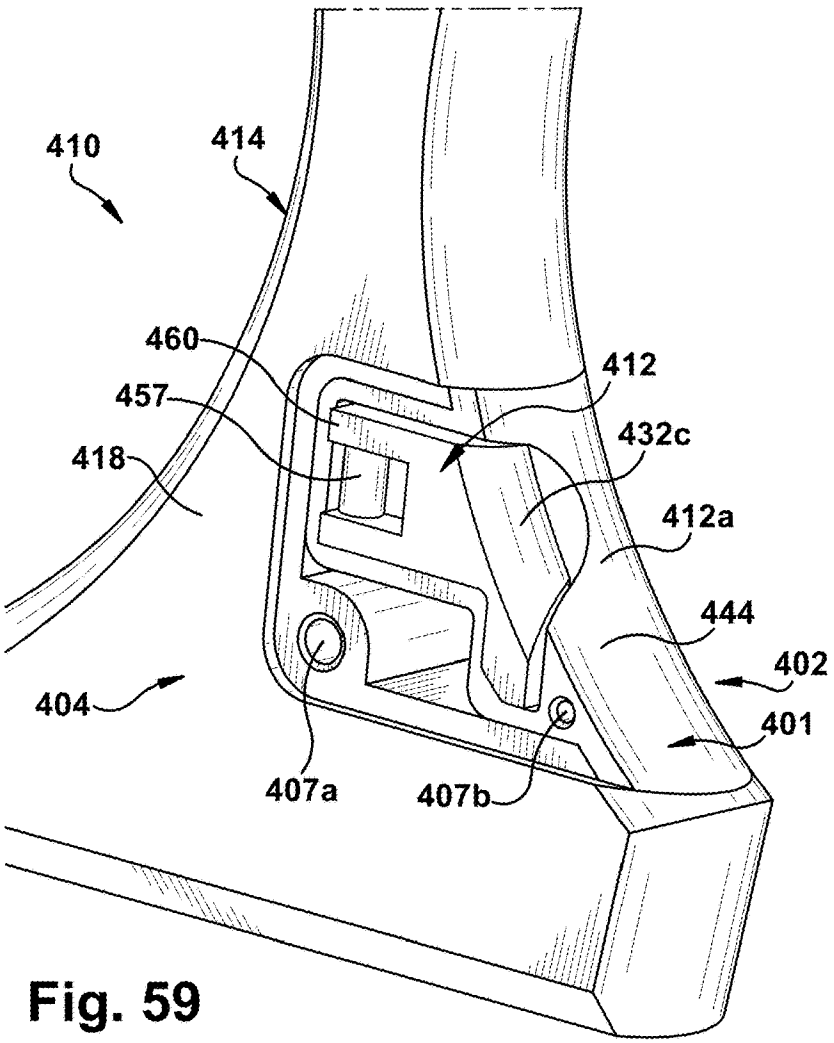
FIG. 59 is a perspective view of the subassembly in FIG. 58 with an exemplary hanger.

The paint brush 410 differs from the embodiments illustrated as paint brushes 10, 110, 210 and 310 in that the surface groove 426 is formed in a body portion 401 of an insert assembly 402 (e.g., cartridge assembly) (shown in FIGS. 58-60) that is inserted into a notch 403 (FIG. 57) in a main body portion 404 of the handle to thereby form the handle 414. As shown in FIG. 57, for example, the notch 403 is formed in the edge portion 421 of the major body portion 404 of the handle 414. The body portion 401 of the insert assembly 402 is operatively attached within the notch 403 as shown in FIG. 58, such as with a press fit, via fasteners, and/or via adhesive such as glue. As shown in FIG. 59, the hanger 412 may be placed in the groove 426, and a cover portion 405 of the insert assembly 402 operatively couples the hanger 412 to the body portion 401, and thus the handle 414 (as shown in FIG. 60). The cover portion 405 may be inserted into one or more holes, such as hole 407*a* in the main body portion 404 and hole 407*b* in body portion 401. As shown, the hanger 412 is substantially the same as hanger 312, including pivot 457 and arms 460, and thus the coupling of the hanger 412 to the handle 414 may be similar as that described above for brush 310. As shown, the notch 403 may have tapered and/or recessed surfaces 403*a*, which may facilitate the insertion and/or attachment of the insert assembly 402, including components thereof, into the notch 403.

When installed, the insert assembly 402 preferably has a flush interface with the main body portion 404 of the handle. For example, as shown in the illustrated embodiment, the edge portion 421*a* of the insert assembly 402 flushingly mates with the edge portion 421 of the major body portion 404 of the handle to provide a continuous curved transition from an upper portion of the handle to a lower portion of the handle 414. In addition, the insert assembly 402 is flush with the front and back sides of the major body portion 404 of the handle. In exemplary embodiments, the major body portion 404 is made of wood and the insert assembly 402, including body 401, cover 405, and hanger 412 is made of a different material, such as plastic.

Referring to FIGS. 61A-61H and FIGS. 62A-62H, the exemplary paint brush 310 is shown with the paint brush handle 314, and more particularly the head portion 348 (hidden from view), operatively coupled to a plurality of bristles 316 via a ferrule 322. In the illustrated embodiment, the bristles 316 form a tapered edge, but also could form a straight edge or any other suitable edge. Likewise, the ferrule 322 could have a tapered portion or straight portion to match the bristle edge. FIGS. 61A-61H show the hanger 312 stowed in the groove 326. FIGS. 62A-62H show the hanger 312 deployed from the groove 326.

Figure 61C:
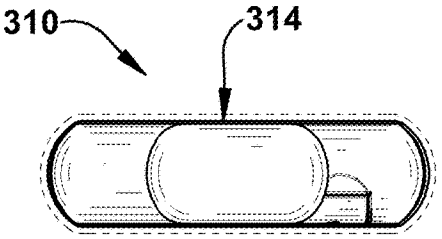
FIGS. 61A-61H show an exemplary ornamental design for an exemplary paint brush, or paint brush handle, in which an exemplary hanger is shown in an exemplary stowed position, and in which the broken line showing illustrates portions of the paint brush that are presently not intended to form of part of the ornamental design.
Figure 61D:
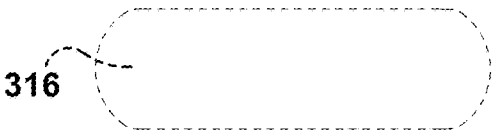
Figure 61B:
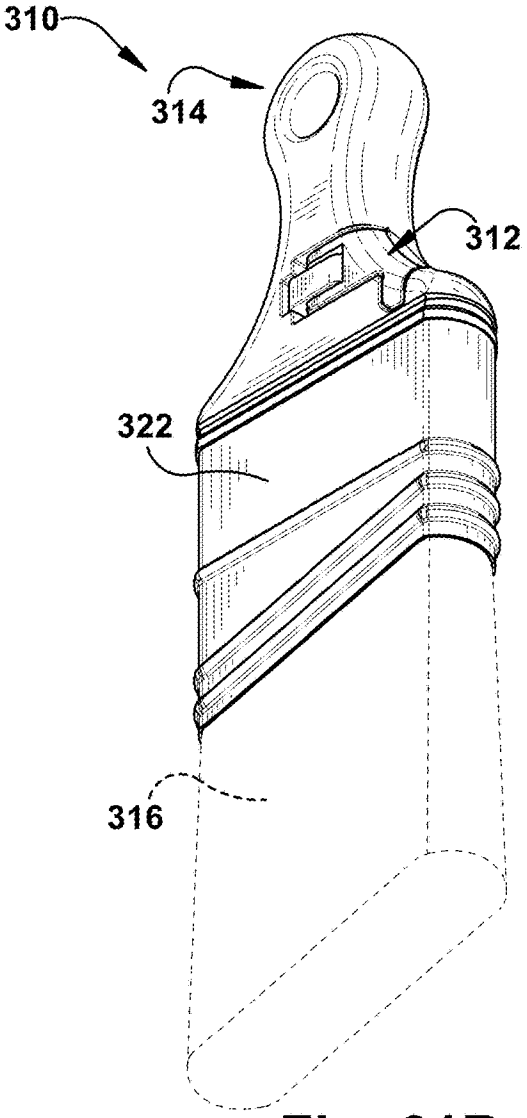
Figure 61A:
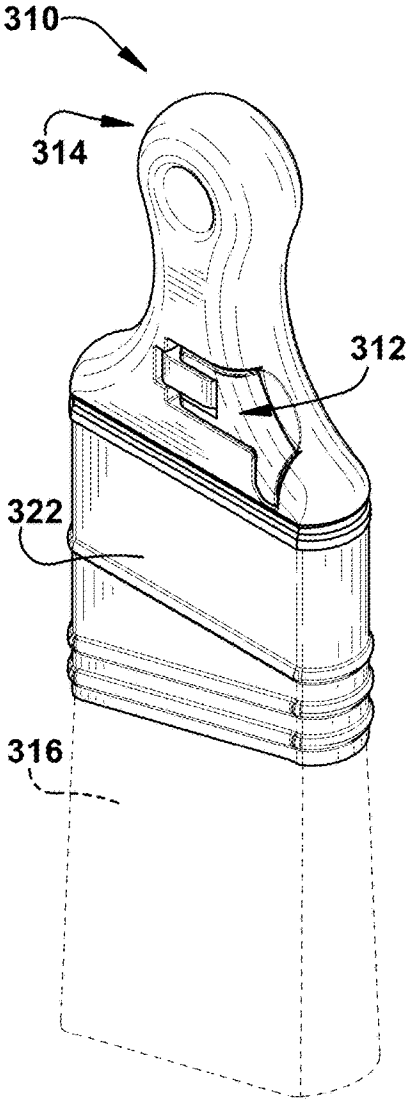
Figures 61E, 61F, 61G, 61H:
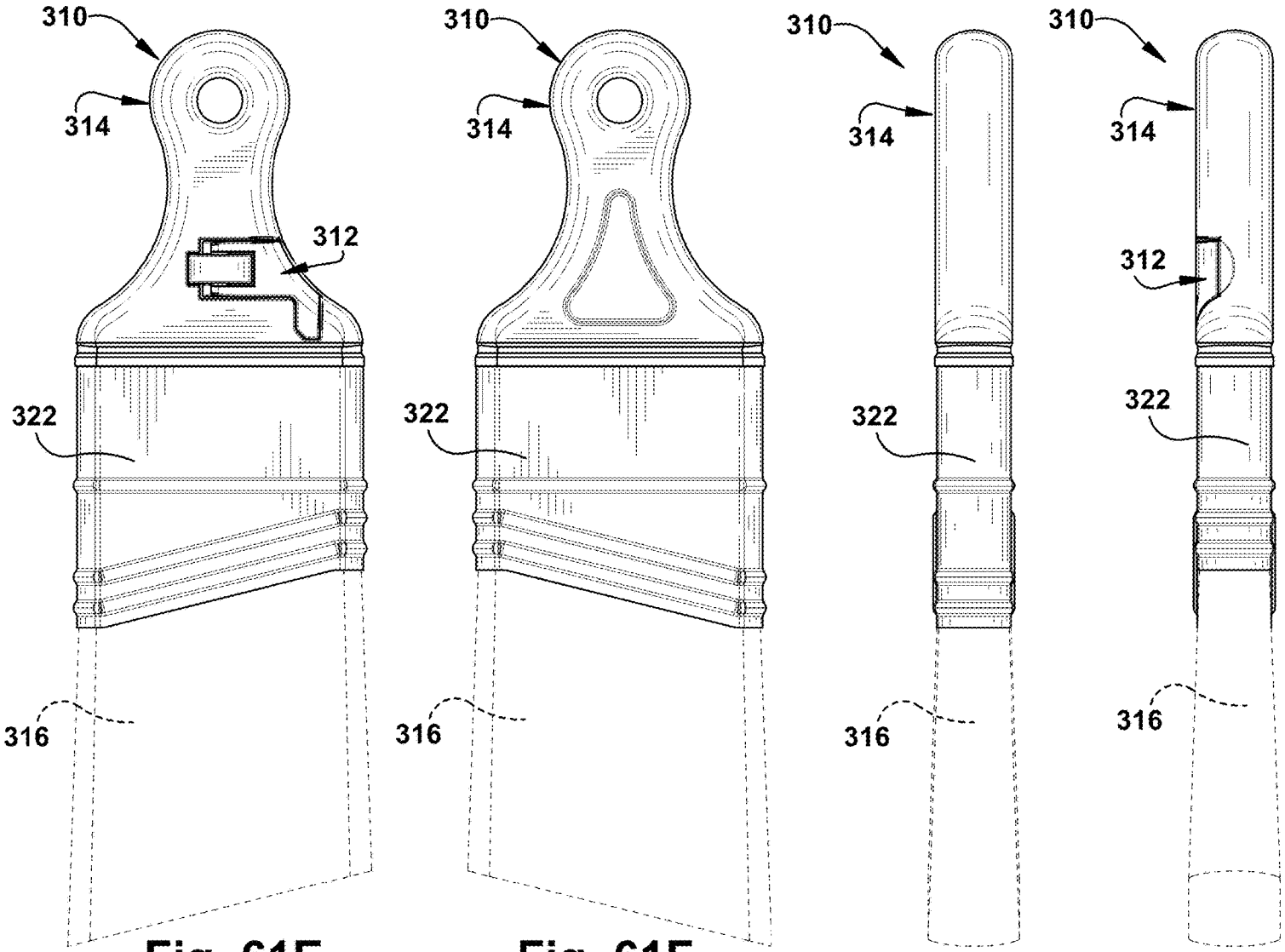

In exemplary embodiments, FIGS. 61A-61H also show an exemplary ornamental design for a paint brush, or paint brush handle, as shown and described herein. FIG. 61A is a top, right front perspective view of the paint brush showing the new design; FIG. 61B is a bottom, right, front perspective view thereof; FIG. 61C is a top plan view thereof; FIG. 61D is a bottom plan view thereof; FIG. 61E is a front elevation view thereof; FIG. 61F is a rear elevation view thereof; FIG. 61G is a left side elevation view thereof; FIG. 61H is a right side elevation view thereof. The broken line showing in FIGS. 61A-61H is for the purpose of illustrating portions of the paint brush that are presently not intended to form of part of the ornamental design. It is understood that in FIGS. 61A-61H, one or more portions of the paint brush 310 generally, and more particularly the handle 314, hanger 312, bristles 316 and/or ferrule 322 may or may not be intended to form a part of the ornamental design.

Figure 62C:
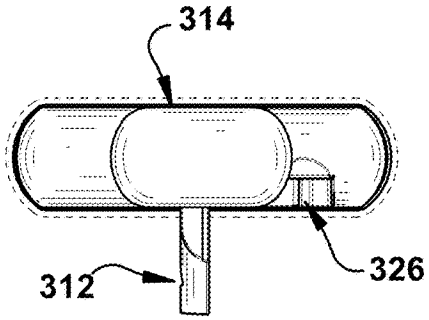
FIGS. 62A-62H show another exemplary ornamental design for an exemplary paint brush, or paint brush handle, in which an exemplary hanger is shown in an exemplary deployed position, and in which the broken line showing illustrates portions of the paint brush that are presently not intended to form of part of the ornamental design.
Figure 62D:
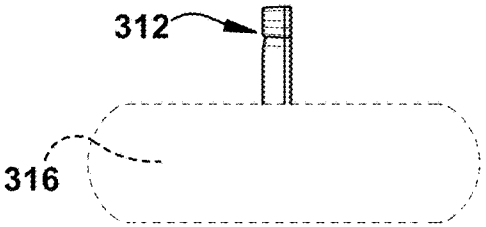
Figure 62B:
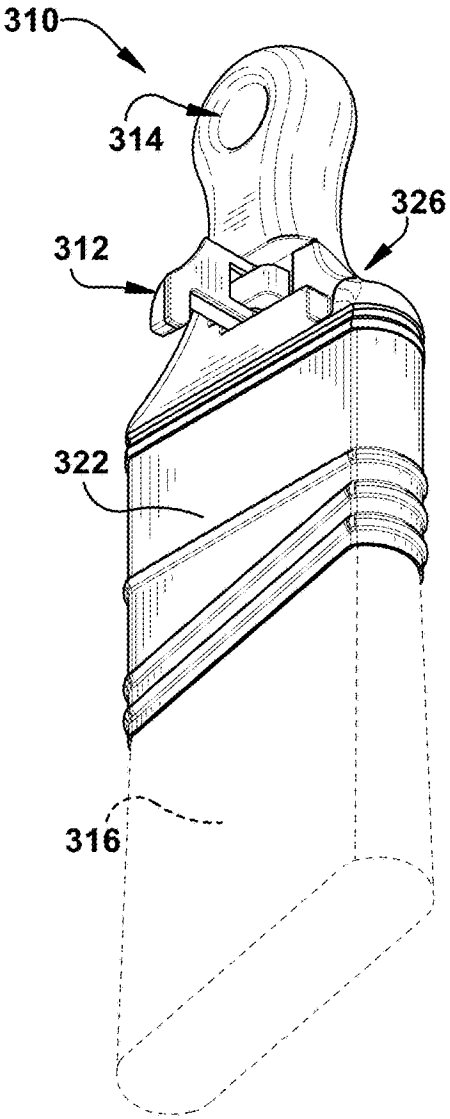
Figure 62A:
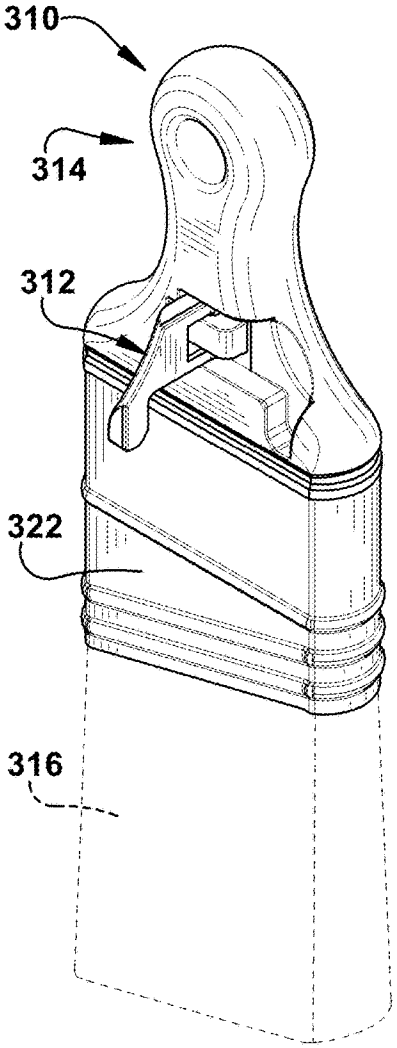
Figures 62E, 62F, 62G, 62H:
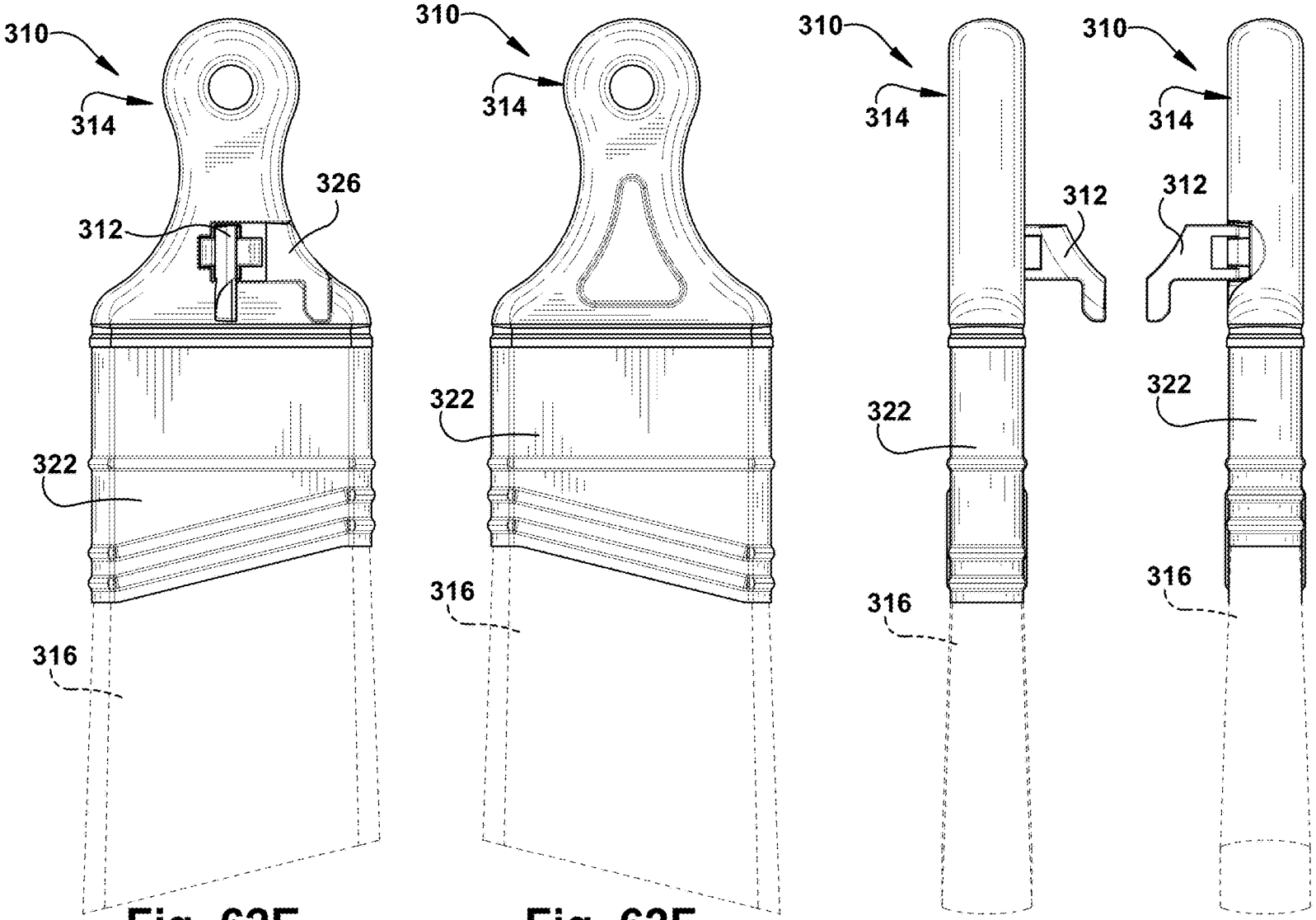

In exemplary embodiments, FIGS. 62A-62H also show an exemplary ornamental design for a paint brush, or paint brush handle, as shown and described herein. FIG. 62A is a top, right front perspective view of the paint brush showing the new design; FIG. 62B is a bottom, right, front perspective view thereof; FIG. 62C is a top plan view thereof; FIG. 62D is a bottom plan view thereof; FIG. 62E is a front elevation view thereof; FIG. 62F is a rear elevation view thereof; FIG. 62G is a left side elevation view thereof; FIG. 62H is a right side elevation view thereof. The broken line showing in FIGS. 62A-62H is for the purpose of illustrating portions of the paint brush that are presently not intended to form of part of the ornamental design. It is understood that in FIGS. 62A-62H, one or more portions of the paint brush 310 generally, and more particularly the handle 314, hanger 312, bristles 316 and/or ferrule 322 may or may not be intended to form a part of the ornamental design.

Figure 63C:
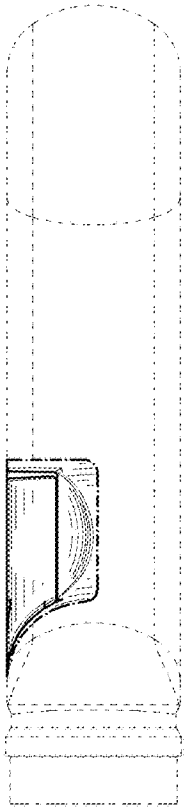
FIGS. 63A-63D show another exemplary ornamental design for an exemplary paint brush, or paint brush handle, in which the dot-dash broken line showing is for illustrating an imaginary boundary line, and the other broken line showing is for illustrating portions of the paint brush or paint brush handle that are presently not intended to form of part of the ornamental design.
Figure 63B:
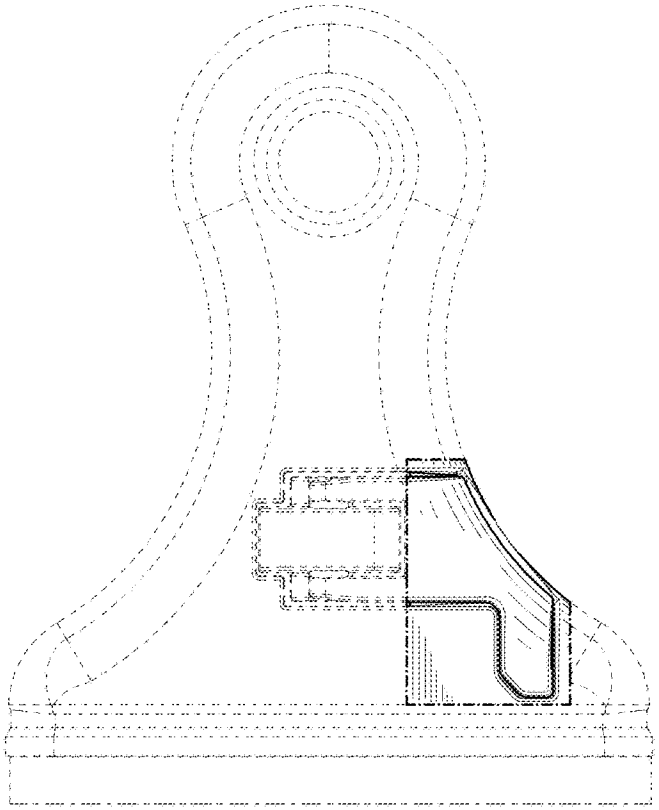
Figure 63D:
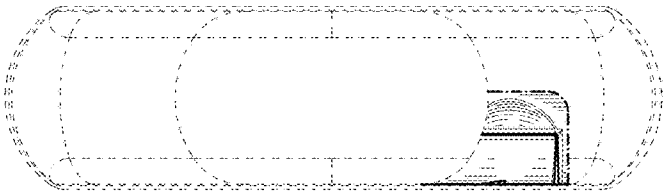
Figure 63A:
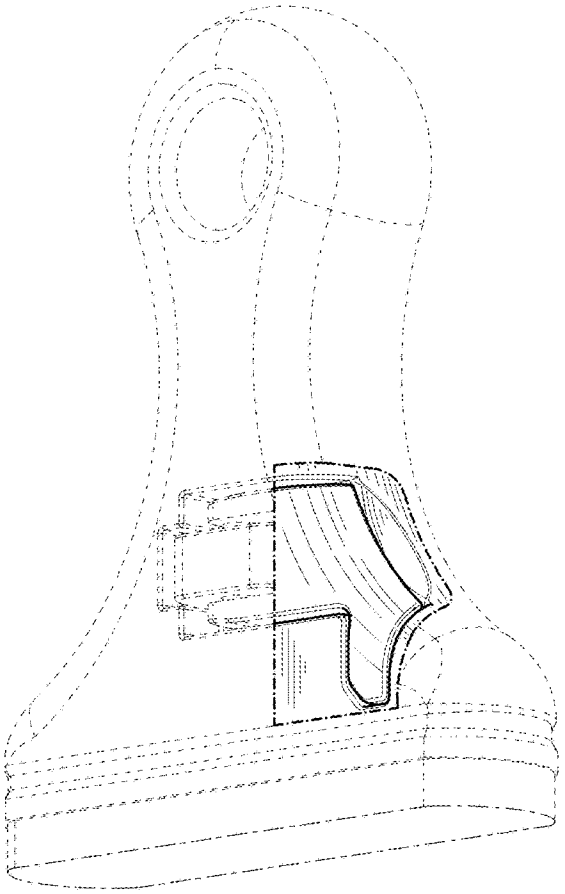

Referring to FIGS. 63A-63D, another exemplary ornamental design for a paint brush, or paint brush handle, is shown and described herein. FIG. 63A is a bottom, right, front perspective view of the paint brush showing the new design; FIG. 62B is a front elevation view thereof; FIG. 63C is a right side elevation view thereof; FIG. 63D is a top plan view thereof. The dot-dash broken line showing in FIGS. 63A-63D is for the purpose of illustrating an imaginary boundary line of the paint brush or paint brush handle. The other broken line showing in FIGS. 63A-63D is for the purpose of illustrating portions of the paint brush that are presently not intended to form of part of the ornamental design. It is understood that in the illustrated embodiment, the left side view, the rear view and the bottom view are entirely in broken line and thus not shown. It is also understood that the paint brush (or components thereof) shown in FIGS. 63A-63D is the same as the paint brush (or components thereof) shown in FIGS. 61A-61H and FIGS. 43-56 and therefore these views may be combined with each other or derived from each other for further understanding as would be understood by those having ordinary skill in the art. Specifically, the ornamental design shown in FIGS. 63A-63D may include bristles 316 and/or ferrule 322 (as shown in FIGS. 61A-61H, for example), which said bristles 316 and/or ferrule 322 may or may not be intended to form a part of the ornamental design. In addition, the location of the dot-dash imaginary boundary and corresponding portions that are, or are not, presently intended to form a part of the ornamental design may be applied to any of the embodiments shown and described in the present disclosure.

Generally, it is understood that FIGS. 43-56, FIGS. 61A-61H, FIGS. 62A-62H, and/or FIGS. 63A-63D may be combined in any manner to form an ornamental design for a paint brush or paint brush handle as shown and described herein. It is furthermore understood that although the foregoing ornamental design(s) are shown as having a "right-hand" hanger (i.e., the hanger extending toward the right edge in the illustrated embodiment(s)), the ornamental design(s) according to the foregoing may instead include a "left-hand" hanger in which the hanger would be mirrored about the longitudinal axis of the handle and extend toward the left edge.

Turning to FIGS. 64A-64H, FIGS. 65A-65H, and FIGS. 66A-66H, exemplary packaging 500 is shown for displaying a paint brush with a hinged hanger, such as the paint brushes 10, 110, 210, 310, 410. Other paint brushes with a hinged hanger also could be utilized with display packaging 500. FIGS. 64A-64H show the display packaging in combination with the paint brush in which the hanger 312 is stowed in the groove 326. FIGS. 65A-65H show the display packaging in combination with the paint brush in which the hanger 312 is deployed from the groove 326. FIGS. 66A-66H show the display packaging without the paint brush contained therein.

Generally, the display packaging 500 includes sidewalls 502 that enclose a space for containing at least a portion of the paint brush, in which the sidewalls 502 include one or more openings 504 for one or more portions of the paint brush to extend therethrough. As shown, the packaging 500 may include at least one of front, back, left, right, top and bottom sidewalls 502 to form at least a portion of a box that encloses the space containing at least a portion of the paint brush (shown with paint brush 310 in the illustrated embodiment). In exemplary embodiments, the bottom sidewall 502*c* or top sidewall 502*b* may be formed as a flap for opening the box to remove the paint brush 310. The packaging 500 also may include a tab portion (not shown) with a hole for hanging the combined packaging 500 and paint brush 310 on a display rack.

As shown in the illustrated embodiment, the packaging 500 includes a first opening 504*a* in front sidewall 502*a*. The first opening 504*a* is configured to permit at least a portion of the hanger 312 to extend therethrough when the hanger is deployed to its extended position. In the illustrated embodiment, the first opening 504*a* is configured as a notch in the front sidewall 502*a* of the packaging 500. The notch 504*a* has an edge that corresponds with the hook portion of the hanger 312. As shown, the first opening 504*a* may extend to top sidewall 502*b* of the packaging to permit an upper portion of the handle 314 to extend therethrough. It is understood, however that separate openings could be provided for the hanger 312 and handle 314. The opening(s) 504 are bounded by portions of the respective sidewall 502 on which the opening is located.

Figure 64C:
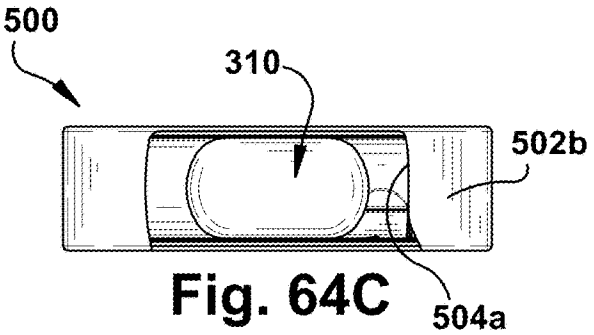
FIGS. 64A-64H show different views of an exemplary display packaging in combination with the paint brush shown in FIG. 61A, for example, in which the exemplary hanger is shown in a stowed position.
Figure 64D:
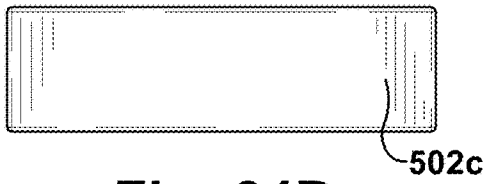
Figure 64B:
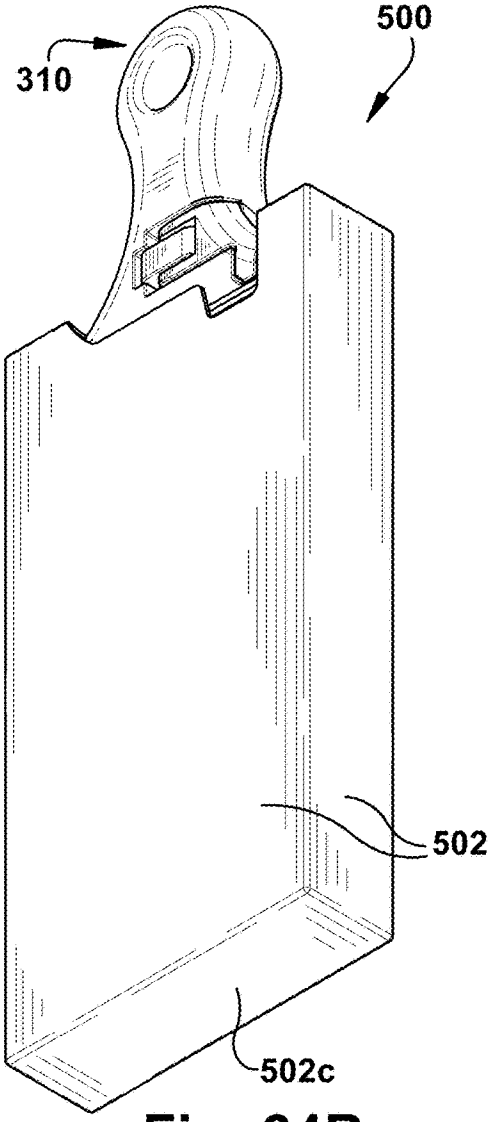
Figure 64A:
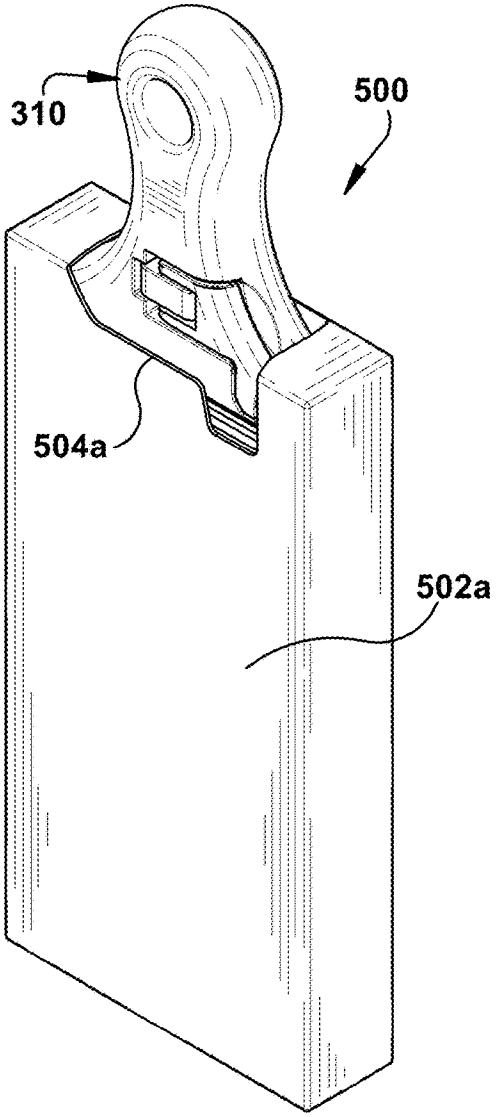
Figures 64E, 64F, 64G, 64H:
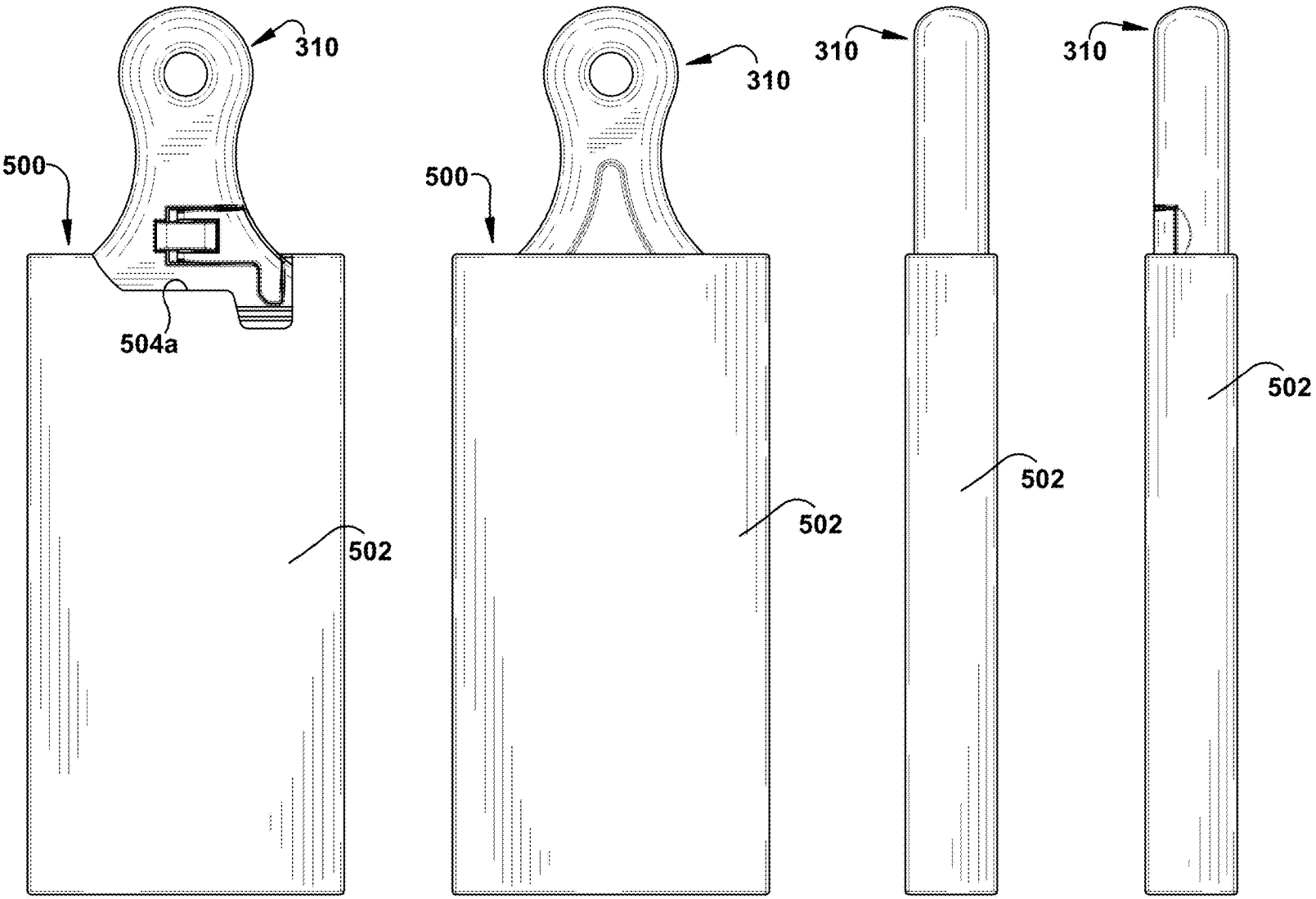

In exemplary embodiments, FIGS. 64A-64H also show an exemplary ornamental design for a combination display packaging and paint brush as shown and described herein. FIG. 64A is a top, right front perspective view of the paint brush showing the new design; FIG. 64B is a bottom, right, front perspective view thereof; FIG. 64C is a top plan view thereof; FIG. 64D is a bottom plan view thereof; FIG. 64E is a front elevation view thereof; FIG. 64F is a rear elevation view thereof; FIG. 64G is a left side elevation view thereof; FIG. 64H is a right side elevation view thereof. It is understood that in FIGS. 64A-64H, one or more portions of the display packaging 500 and/or paint brush 310 generally, and more particularly the handle 314, hanger 312, bristles 316 and/or ferrule 322, may or may not be intended to form a part of the ornamental design.

Figure 65C:
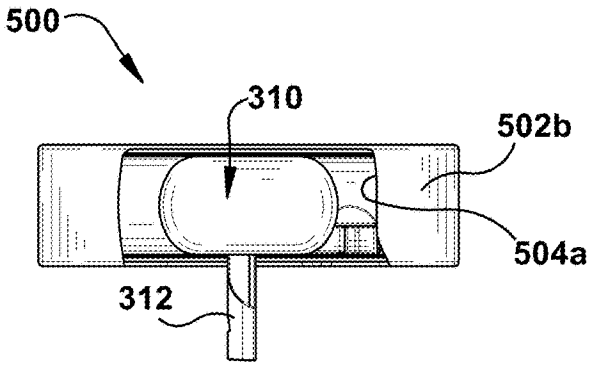
FIGS. 65A-65H show different views of the exemplary display packaging in combination with the paint brush, in which the exemplary hanger is shown in a deployed position.
Figure 65D:
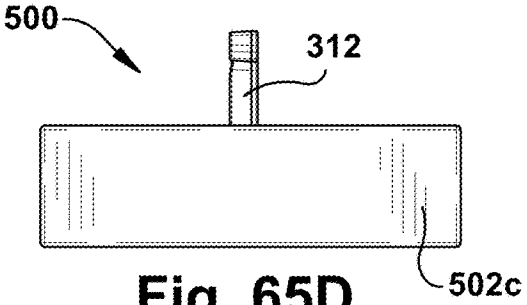
Figure 65B:
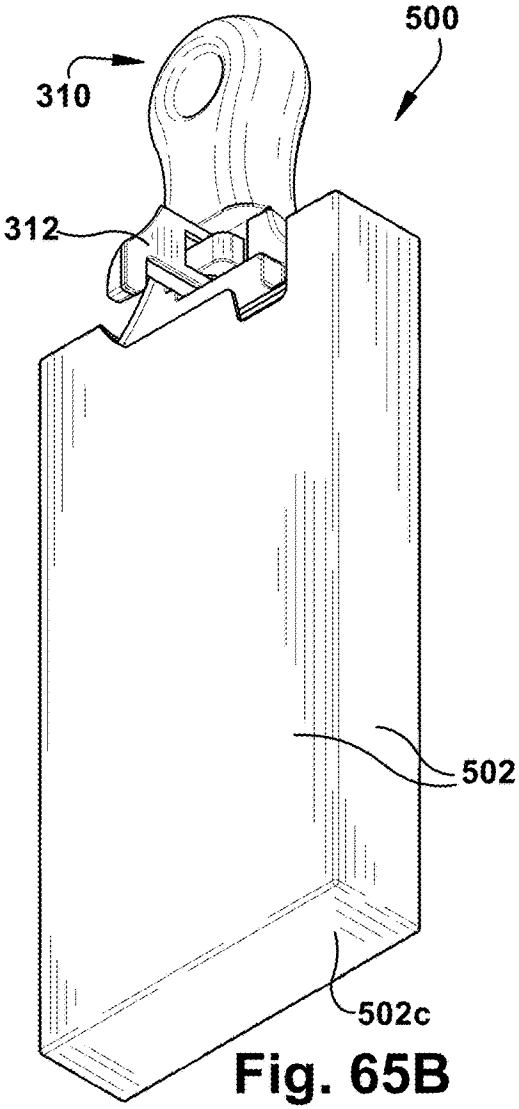
Figure 65A:
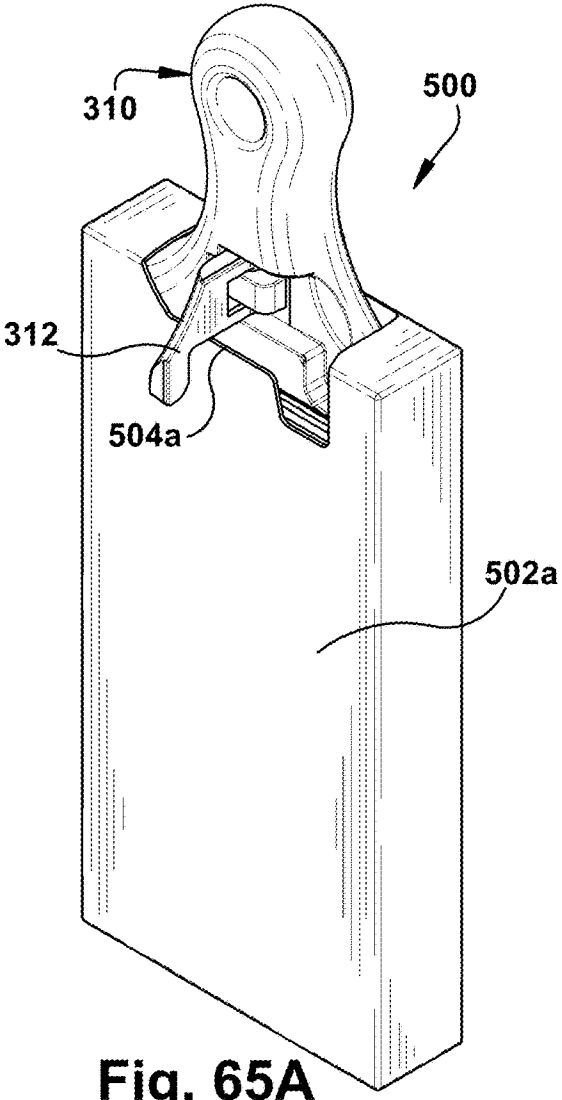
Figure 65H:
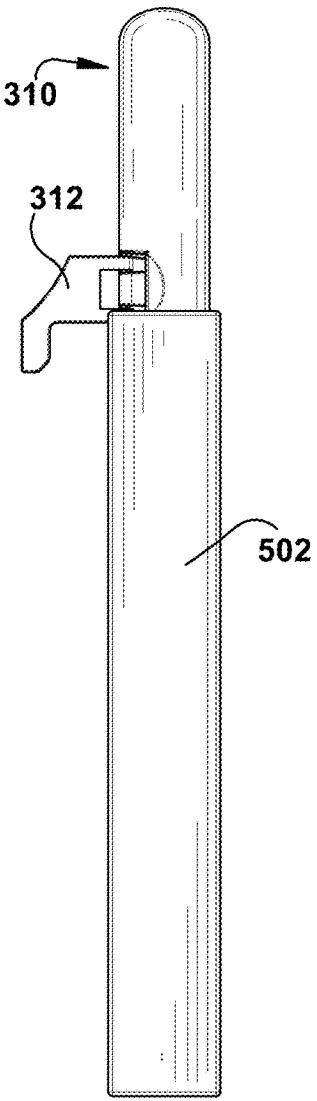
Figure 65G:
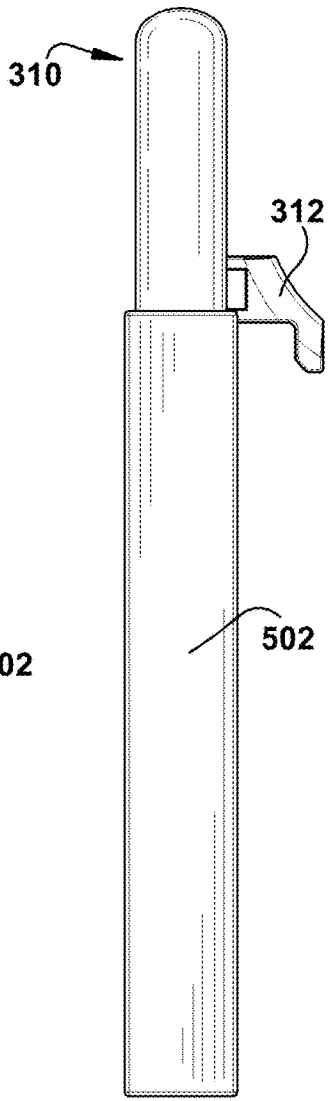
Figure 65F:
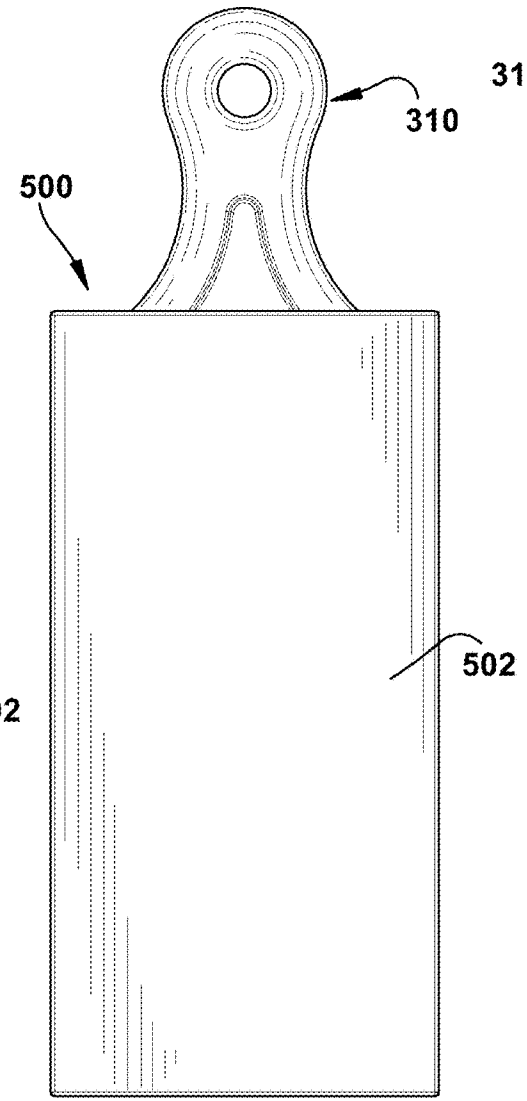
Figure 65E:
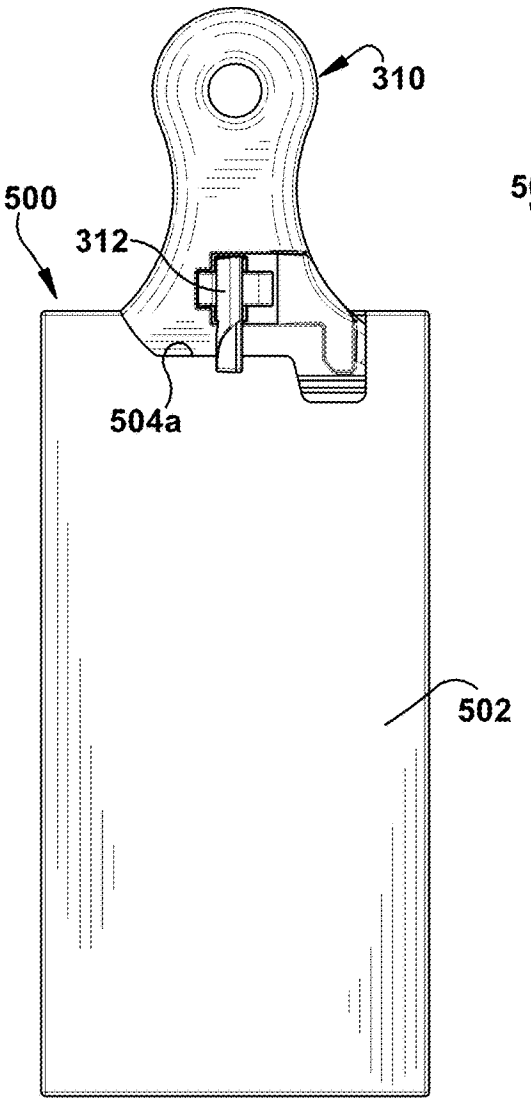

In exemplary embodiments, FIGS. 65A-65H also show an exemplary ornamental design for a combination display packaging and paint brush as shown and described herein. FIG. 65A is a top, right front perspective view of the paint brush showing the new design; FIG. 65B is a bottom, right, front perspective view thereof; FIG. 65C is a top plan view thereof; FIG. 64D is a bottom plan view thereof; FIG. 65E is a front elevation view thereof; FIG. 65F is a rear elevation view thereof; FIG. 65G is a left side elevation view thereof; FIG. 65H is a right side elevation view thereof. It is understood that in FIGS. 65A-65H, one or more portions of the display packaging 500 and/or paint brush 310 generally, and more particularly the handle 314, hanger 312, bristles 316 and/or ferrule 322, may or may not be intended to form a part of the ornamental design.

Figure 66C:
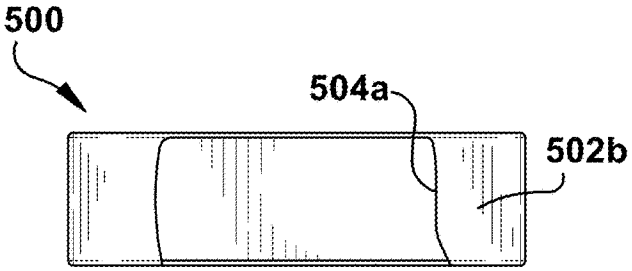
FIGS. 66A-66H show different views of the exemplary display packaging in FIGS. 64A-64H without an exemplary paint brush.
Figure 66D:
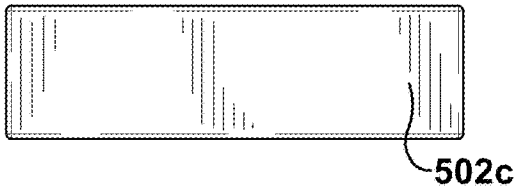
Figure 66B:
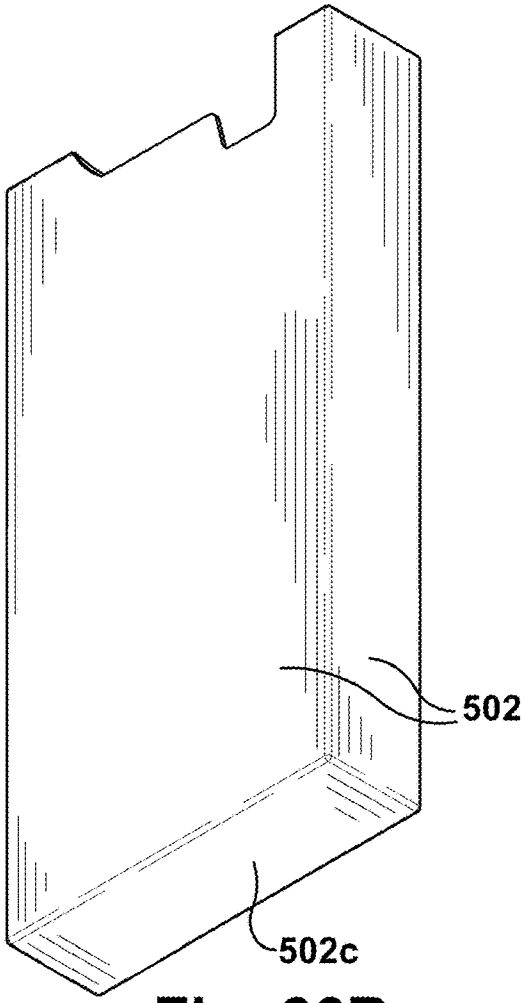
Figure 66A:
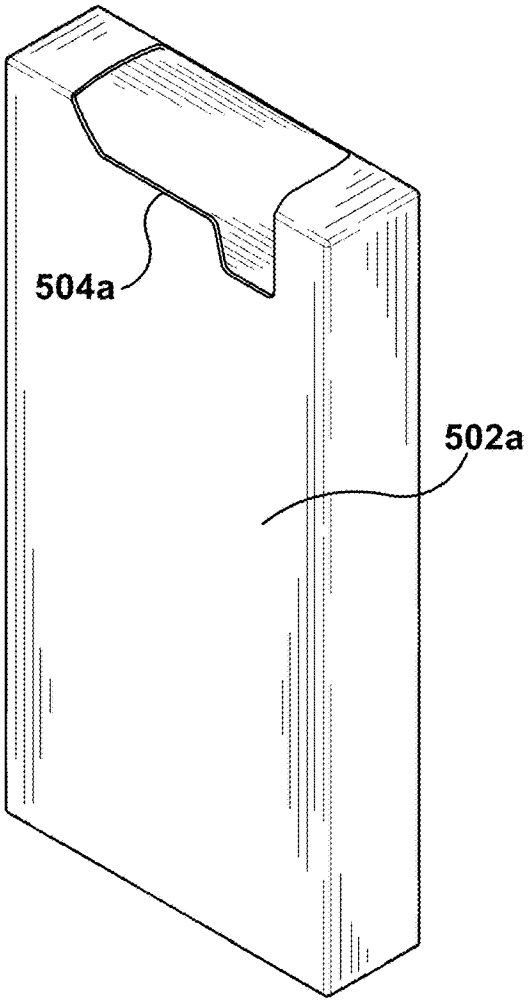
Figure 66H:
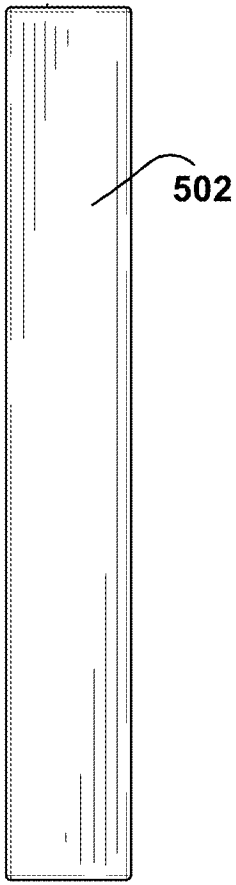
Figure 66G:
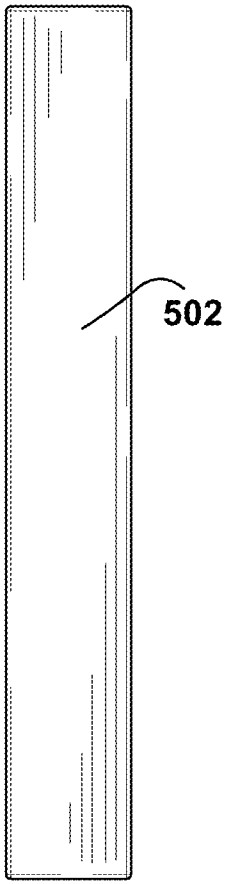
Figure 66F:
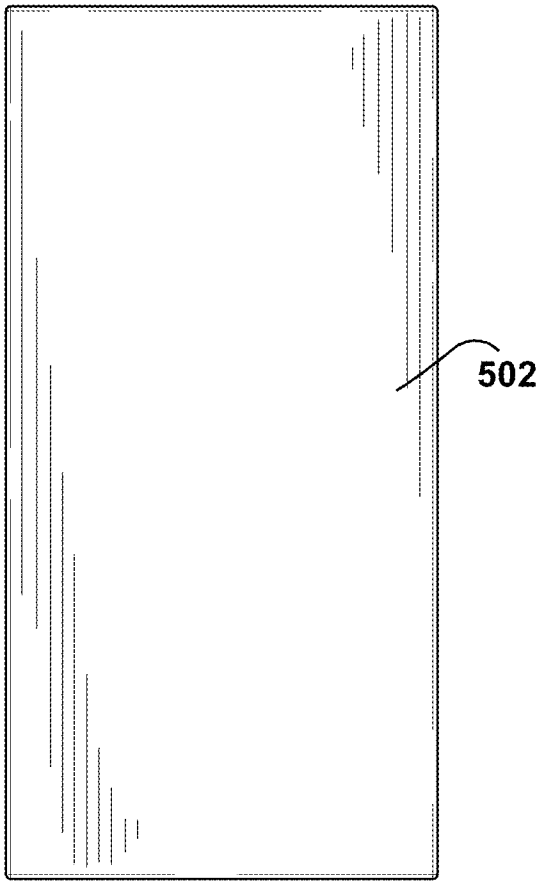
Figure 66E:
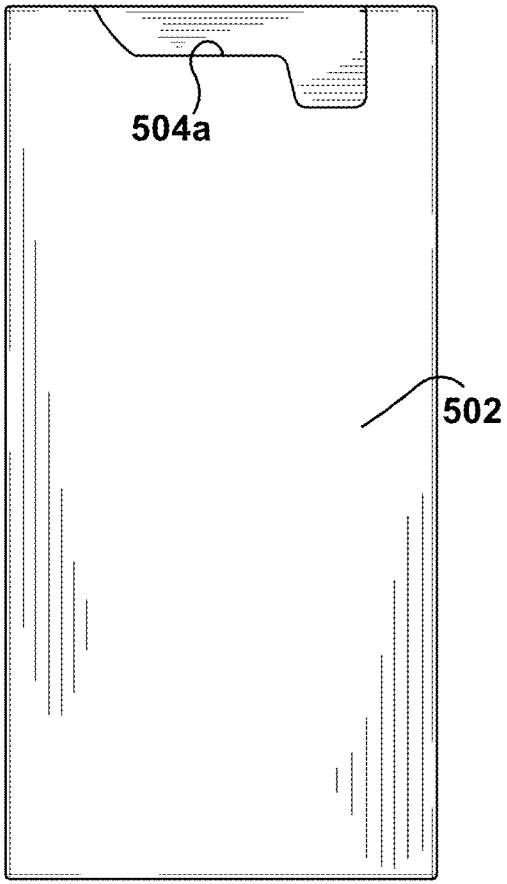

In exemplary embodiments, FIGS. 66A-66H also show an exemplary ornamental design for display packaging as shown and described herein. FIG. 66A is a top, right front perspective view of the paint brush showing the new design; FIG. 66B is a bottom, right, front perspective view thereof; FIG. 66C is a top plan view thereof; FIG. 66D is a bottom plan view thereof; FIG. 66E is a front elevation view thereof; FIG. 66F is a rear elevation view thereof; FIG. 66G is a left side elevation view thereof; FIG. 66H is a right side elevation view thereof. It is understood that in FIGS. 66A-66H, one or more portions of the display packaging 500 may or may not be intended to form a part of the ornamental design.

A paint brush has been described herein, having a handle with an integrated hanger that is pivotably movable between a retracted position for stowing the hanger within a groove of the handle, and an extended position for extending the hanger outwardly from the groove to hang the paint brush on an object. When stowed in the retracted position the hanger may be flush with an outer surface of the handle to enhance the ergonomic design. The hanger and groove may be configured to enable ease of deployment of the hanger from the retracted to extended position simply with a one-handed operation. The portion of the handle having the groove may be made of a flexible material which may better secure the hanger in the groove when stowed and/or may facilitate installation of the hanger. The handle may include a grip portion having the flexible material which is over-molded onto a rigid head portion.

According to an aspect, a paint brush includes: a handle having a flexible portion having a groove; bristles operatively attached to the handle; and a hanger hinged to the handle for pivotable movement between a retracted position for stowing the hanger in the groove, and an extended position for extending the hanger from the groove for hanging the paint brush from an object; wherein the hanger has a hanger portion and a journal that is unitary with the hanger portion; wherein the flexible portion has a socket that opens to a sidewall of the groove, and wherein the journal of the hanger is received and pivotably retained in the socket to enable the hanger to move between the retracted and extended positions; and wherein the flexible portion of the handle has sufficient flexibility to enable the groove to be spread apart for inserting the journal of the hanger into the socket through the sidewall of the groove.

Embodiments of the invention may include one or more of the following or foregoing additional features, alone or in any combination.

In some embodiments, an outer surface of the flexible portion juxtaposed to the groove includes a continuous outer surface that continuously extends along at least a portion of the groove.

In some embodiments, the socket is inwardly spaced apart from the continuous outer surface and opens to the sidewall of the groove at a depth below the continuous outer surface.

In some embodiments, the groove has a shape that corresponds to a shape of the hanger portion of the hanger, such that when the hanger is pivotably moved to the retracted position, the hanger portion is stowed within the grove and is flush with an outer surface of the flexible portion having the groove.

In some embodiments, the hanger portion includes a first segment that extends in a direction transverse to the journal, and the hanger portion includes a second segment that extends transverse to the first segment to form a hook.

In some embodiments, the recessed groove includes a first groove segment that is configured to receive the first segment of the hanger portion, and includes a second groove segment that is transverse to the first groove segment and is configured to receive the second segment of the hanger portion.

In some embodiments, the socket is a first socket and the sidewall of the groove is a first sidewall.

In some embodiments, the handle includes a second socket that opens to a second sidewall of the groove that opposes the first sidewall, the second socket opposing the first socket.

In some embodiments, the journal of the hanger is a first journal, the hanger having a second journal opposite the first journal, the second journal being received and pivotably secured in second socket.

In some embodiments, the groove opens to an edge of the handle, and the hanger portion when in the retracted position extends to the edge such that a corner of the hanger portion is accessible at the edge for enabling pivoting of the hanger from the retracted to extended position.

In some embodiments, the edge of the handle has an indent portion having a bottom surface that is formed by a deeper part of the groove, such that the bottom surface of the indent portion is spaced apart from the hanger portion when in the retracted position.

In some embodiments, a curved surface connects the edge of handle to a front side of the handle having the groove.

In some embodiments, the corner of the hanger portion is contoured to the curved surface of the handle the such that corner of hanger is flush with the curved surface when the hanger is in the retracted position.

In some embodiments, the flexible portion is made of an elastomer material and the hanger is made of a rigid polymer material.

In some embodiments, the handle includes a head portion and a grip portion at least partially overlying the head portion.

In some embodiments, the grip portion includes the flexible portion of the handle having the groove.

In some embodiments, the socket and groove are pre-molded into the grip portion.

In some embodiments, the head portion is made of a rigid polymer, and wherein the bristles are attached to the head portion with a ferrule.

According to another aspect, a paint brush includes: a handle having a surface groove; bristles operatively attached to the handle; and a hanger hinged to the handle with a hinge connector for pivotable movement between a retracted position for stowing the hanger in the surface groove and an extended position for extending the hanger from the surface groove for hanging the paint brush from an object; wherein a first hinge part of the hinge connector includes a resilient snap-in receiver, and wherein a second hinge part of the hinge connector includes a pivot that is received and pivotably retained in the snap-in receiver such that the hanger is pivotably movable between the retracted and extended positions.

Embodiments of the invention may include one or more of the following or foregoing additional features, alone or in any combination.

In some embodiments, the hanger has the pivot and the handle has the snap-in receiver.

In some embodiments, the pivot is formed as a pivot rod that extends between opposing arms at an end portion of the hanger to form a loop that is received by the snap-in receiver.

In some embodiments, the snap-in receiver includes opposing first and second prongs, and at least one of the first and second prongs is resiliently movable relative to the other prong.

In some embodiments, the handle includes a head portion and a grip portion at least partially overlying the head portion; the head portion includes the snap-in receiver; and wherein the head portion extends inwardly through the grip portion such that the snap-in receiver is exposed in the surface groove.

According to another aspect, a paint brush includes: a handle having a head portion and a grip portion that at least partially overlies the head portion, the grip portion having a surface groove; bristles operatively attached to the head portion of the handle; and a hanger hinged to the handle with a hinge connector for pivotable movement between a retracted position for stowing the hanger in the surface groove and an extended position for extending the hanger from the surface groove for hanging the paint brush from an object; wherein the head portion has a first hinge part of the hinge connector, the head portion extending inwardly through the grip portion such that the first hinge part is exposed in the surface groove; and wherein the hanger has a second hinge part of the hinge connector, the second hinge part of the hanger being received and pivotably secured to the first hinge part of the head portion such that the hanger is pivotably movable between the retracted and extended positions.

Embodiments of the invention may include one or more of the following or foregoing additional features, alone or in any combination.

In some embodiments, the first hinge part of the head portion includes a resilient snap-in receiver, and wherein the second hinge part of the hanger includes a pivot that is received and pivotably retained by the snap-in receiver.

According to another aspect, a paint brush includes: a handle having a surface groove; bristles operatively attached to the handle; and a hanger hinged to the handle for pivotable movement between a retracted position for stowing the hanger in the surface groove and an extended position for extending the hanger from the surface groove for hanging the paint brush from an object; wherein the paint brush includes an integrally-formed and permanently-linked hinge assembly having a first linkage part that forms a first loop and a second linkage part that forms a second loop, wherein the first and second loops are non-removably and pivotably interlinked together, wherein the hanger includes the first linkage part that forms the first loop, and wherein the hinge assembly includes a hinge body having the second linkage part that forms the second loop, the hinge body and the hanger being pivotably interlinked together by the respective first and second loops such that the hanger is pivotably movable relative to the hinge body between the retracted and extended positions.

Embodiments of the invention may include one or more of the following or foregoing additional features, alone or in any combination.

In some embodiments, the hinge body is discrete with respect to the hanger.

In some embodiments, the hanger includes a pivot, and wherein the hinge body includes a hinge barrel portion that continuously encompasses the pivot.

In some embodiments, the integrally-formed hinge assembly is made by additive manufacturing or injection molding.

In some embodiments, the handle includes a head portion and a grip portion at least partially overlying the head portion; wherein the head portion includes a post that forms one part of a hinge connector for connecting the integrally-formed hinge assembly to the handle; wherein the integrally-formed hinge assembly includes a second part of the hinge connector, the hinge assembly having a resilient snap-in connector that couples to the post to secure the hinge assembly to the handle.

According to another aspect, a paint brush includes: a handle having a head portion and a grip portion that at least partially overlies the head portion, the grip portion having a surface groove; and a hanger hinged to the handle such that the hanger is pivotably movable between a retracted position for stowing the hanger in the surface groove and an extended position for extending the hanger from the surface groove for hanging the paint brush from an object.

Embodiments of the invention may include one or more of the following or foregoing additional features, alone or in any combination.

In some embodiments, the head portion extends inwardly through the grip portion such that a part of the head portion is exposed in the surface groove; and wherein the hanger is operatively coupled to the part of the head portion exposed in the surface groove, such that the hanger is pivotably movable between the retracted position and the extended position.

In some embodiments, the head portion has a first hinge part of the hinge connector, the head portion extending inwardly through the grip portion such that the first hinge part is exposed in the surface groove; and wherein the hanger has a second hinge part of the hinge connector, the second hinge part being pivotably secured to the first hinge part with a third hinge part of the hinge connector, such that the hanger is pivotably movable between the retracted and extended positions.

In some embodiments, the second hinge part includes a pivot operatively coupled to a hook portion of the hanger; wherein the first hinge part includes at least one receiver; and wherein at least one portion of the third hinge part is received by the at least one receiver of the second hinge part to pivotably secure the hanger on the handle.

In some embodiments, the at least one receiver includes a socket, and wherein the at least one portion of the third hinge part includes a pin that is received in the socket.

In some embodiments, the pin is frictionally secured in the socket.

In some embodiments, the socket has a polygonal cross-section and the pin has a round cross-section.

In some embodiments, the pivot is formed as a pivot rod that extends between opposing arms at an end portion of the hanger to form a loop that is pivotably interlinked between the first hinge part and the third hinge part.

In some embodiments, the third hinge part includes a pair of pins laterally spaced apart and extending from a cross-member portion of the third hinge part; and wherein the first hinge part includes a pair of sockets laterally spaced apart and configured to receive the pair of pins.

In some embodiments, the cross-member portion includes an enlarged portion that is sized to engage sidewalls of the surface groove, and a narrow portion that is sized to fit between the opposing arms of the hanger.

In some embodiments, first hinge part includes a mounting face that is flush with a bottom surface of the surface groove.

In some embodiments, the surface groove has a shape that corresponds to a shape of a hanger portion of the hanger, such that when the hanger is pivotably moved to the retracted position, the hanger portion is stowed within the surface grove and is flush with an outer surface of the handle having the surface groove.

In some embodiments, the hanger portion includes a first segment that extends in a direction transverse to a pivot axis of the pivot, and the hanger portion includes a second segment that extends transverse to the first segment to form a hook.

In some embodiments, the surface groove includes a first groove segment that is configured to receive the first segment of the hanger portion, and includes a second groove segment that is transverse to the first groove segment and is configured to receive the second segment of the hanger portion.

In some embodiments, the surface groove opens to an edge of the handle, and the hanger portion when in the retracted position extends to the edge such that a corner of the hanger portion is accessible at the edge for enabling pivoting of the hanger from the retracted to extended position.

In some embodiments, the edge of the handle has an indent portion having a bottom surface that is formed by a deeper part of the surface groove, such that the bottom surface of the indent portion is spaced apart from the hanger portion when in the retracted position.

In some embodiments, a curved surface connects the edge of the handle to a front side of the handle having the groove, and wherein the corner of the hanger portion is contoured to the curved surface of the handle the such that corner of hanger is flush with the curved surface when the hanger is in the retracted position.

In some embodiments, the grip portion is made of a flexible material, such as an elastomer material, and the head portion is made of a rigid polymer material.

In some embodiments, the surface groove is pre-molded into the grip portion.

In some embodiments, the head portion is made of a rigid polymer, and wherein bristles are attached to the head portion with a ferrule.

According to another aspect, a paint brush includes: a handle having a head portion and a grip portion that at least partially overlies the head portion, the grip portion having a surface groove; bristles operatively attached to the head portion of the handle; and a hanger hinged to the handle with a hinge connector for pivotable movement between a retracted position for stowing the hanger in the surface groove and an extended position for extending the hanger from the surface groove for hanging the paint brush from an object; wherein the head portion has at least a first portion or part of the hinge connector, the head portion extending inwardly through the grip portion such that the first portion or part of the hinge connector is exposed in the surface groove; and wherein the hanger is pivotably secured to the handle via at least the first portion or part of the hinge connector, such that the hanger is pivotably movable between the retracted and extended positions.

Embodiments of the invention may include one or more of the following or foregoing additional features, alone or in any combination.

In some embodiments, the bristles are operatively attached to the handle with a ferrule.

According to another aspect, a paint brush includes: a handle having a surface groove; bristles operatively attached to the handle; and a hanger hinged to the handle for pivotable movement between a retracted position for stowing the hanger in the surface groove and an extended position for extending the hanger from the surface groove for hanging the paint brush from an object; wherein the surface groove opens to an edge of the handle, and the hanger when in the retracted position extends to the edge such that a corner of the hanger is exposed at the edge for enabling pivoting of the hanger from the retracted to extended position.

Embodiments of the invention may include one or more of the following or foregoing additional features, alone or in any combination.

In some embodiments, the handle has opposite front and rear flat sides with the edge connecting respective portions of the flat sides, the surface groove being in the front flat side and extending laterally to open to the edge.

In some embodiments, the edge of the handle has a recessed portion having a bottom surface that is formed by a deeper part of the surface groove, such that the bottom surface of the recessed portion is spaced apart from the corner of the hanger when in the retracted position.

In some embodiments, the edge of the handle has a curved transition extending from an upper portion of the handle to a lower portion of the handle; and wherein the corner of the hanger is contoured to the curved transition such that the corner of the hanger is flush with the curved transition when the hanger is in the retracted position.

In some embodiments, a curved surface connects the edge of the handle to a front side of the handle having the surface groove, and wherein the corner of the hanger portion is contoured to the curved surface of the handle the such that corner of hanger is flush with the curved surface when the hanger is in the retracted position.

In some embodiments, the surface groove is formed in a body portion of an insert assembly that forms a portion of the handle.

In some embodiments, the insert assembly is disposed in a notch formed in an edge portion of a major body portion of the handle.

In some embodiments, the hanger is hingedly connected to the body portion of the insert assembly with a cover portion of the insert assembly.

In some embodiments, the insert assembly has an edge portion that flushingly mates with another edge portion of the major body portion of the handle to provide a continuous curved transition from an upper portion of the handle to a lower portion of the handle.

In some embodiments, the insert assembly is flush with the front, back and edge of the major body portion of the handle.

In some embodiments, the major body portion is made of wood and the insert assembly is made of a different material, in particular plastic.

In some embodiments, the entirety of the hanger is contained within the groove when in the stowed position; and/or wherein an outer face of the hanger is flush with an outer face of the handle.

According to another aspect, a method of forming a paint brush handle, includes: providing a handle having a grip portion that at least partially overlies a head portion adapted for operatively coupling to a plurality of bristles; wherein the grip portion includes a surface groove; and operatively connecting a hanger to the handle such that the hanger is hinged to the handle for pivotable movement between a retracted position for stowing the hanger in the surface groove and an extended position for extending the hanger from the surface groove for hanging the paint brush from an object.

According to another aspect, a method of forming a paint brush handle, includes: forming a surface groove in the handle such that the surface groove opens to an edge of the handle; and operatively connecting a hanger to the handle such that the hanger is hinged to the handle for pivotable movement between a retracted position for stowing the hanger in the surface groove and an extended position for extending the hanger from the surface groove for hanging the paint brush from an object, and such that the hanger when in the retracted position extends to the edge such that a corner of the hanger portion is exposed at the edge for enabling pivoting of the hanger from the retracted to extended position.

According to another aspect, a method of forming a paint brush handle, includes: providing a main body portion of the handle; forming a notch in an edge of the main body portion; inserting an insert assembly into the notch; wherein the insert assembly includes an insert body having a surface groove, and a hanger hinged to the insert body for pivotable movement between a retracted position for stowing the hanger in the surface groove and an extended position for extending the hanger from the surface groove.

According to another aspect, a method of forming a paint brush includes any of the foregoing, and further comprising operatively attaching a plurality of bristles to the paint brush handle.

According to another aspect, a display packaging is in combination with the paint brush according to any of the foregoing, wherein the display packaging at least partially encloses a portion of the paint brush.

Embodiments of the invention may include one or more of the following or foregoing additional features, alone or in any combination.

In some embodiments, the display packaging having one or more openings, in which one or more portions of the paint brush extend therethrough.

In some embodiments, the display packaging having a first opening that is configured to permit at least a portion of the hanger to extend therethrough when the hanger is deployed to its extended position.

In some embodiments, the first opening is configured as a notch in a front face of the packaging.

In some embodiments, the first opening extends to a top of the packaging to permit an upper portion of the handle to extend therethrough.

According to another aspect, a display packaging, includes: a box having sidewalls that enclose a space, the box being configured to at least partially contain a paint brush having: a handle and a hanger hinged to the handle; wherein the box includes at least one opening that is configured to permit at least a portion of the hanger to extend therethrough when the hanger is deployed to its extended position.

In some embodiments, the display packaging is in combination with the paint brush.

According to another aspect, a paint brush handle is provided according to any of the foregoing.

Another aspect includes an ornamental design for a paint brush hanger as shown and described with respect to any of FIGS. 1-63D.

Another aspect includes an ornamental design for a paint brush handle as shown and described with respect to any of FIGS. 1-63D.

Another aspect includes an ornamental design for a paint brush as shown and described with respect to any of FIGS. 1-63D.

Another aspect includes an ornamental design for a paint brush, or a paint brush handle, as shown and described with respect to FIGS. 61A-61H and/or FIGS. 62A-62H, in which the broken line showing is for illustrating portions of the paint brush that are not intended to form a part of the claimed design.

Another aspect includes an ornamental design for a paint brush, or a paint brush handle, as shown and described with respect to FIGS. 63A-63D, in which the dot-dash broken line showing is for illustrating an imaginary boundary line, and the other broken line showing is for illustrating portions of the paint brush or paint brush handle that are not intended to form a part of the claimed design.

Another aspect includes an ornamental design for a combination display packaging and paint brush as shown and described with respect to FIGS. 64A-64H and/or FIGS. 65A-65H.

Another aspect includes an ornamental design for display packaging as shown and described with respect to FIGS. 66A-66H.

Terms such as "top," "bottom," "upper," "lower," "left," "right," "front," "rear" and the like as used in this disclosure should be understood as referring to an arbitrary frame of reference (as shown in FIG. 1, for example), rather than to the ordinary gravitational frame of reference. Thus, a top surface, a bottom surface, a front surface, and a rear surface may extend upwardly, downwardly, diagonally, or horizontally in a gravitational frame of reference.

As used herein, an "operative connection," or a connection by which entities are "operatively connected," is one in which the entities are connected in such a way that the entities may perform as intended. An operative connection may be a direct connection or an indirect connection in which an intermediate entity or entities cooperate or otherwise are part of the connection or are in between the operatively connected entities.

The phrase "and/or" should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A paint brush comprising:

a handle having a head portion and a grip portion that at least partially overlies the head portion, the grip portion having a surface groove;

bristles operatively attached to the handle; and a hanger hinged to the handle such that the hanger is pivotably movable between a retracted position for stowing the hanger in the surface groove and an extended position for extending the hanger from the surface groove for hanging the paint brush from an object;

wherein the head portion extends inwardly through the grip portion such that a part of the head portion is exposed in the surface groove; and wherein the hanger is operably coupled to the part of the head portion exposed in the surface groove, such that the hanger is pivotably movable between the retracted position and the extended position.

2. The paint brush according to claim 1 wherein the hanger is hinged to the handle with a hinge connector;

wherein the head portion has a first hinge part of the hinge connector, the head portion extending inwardly through the grip portion such that the first hinge part is exposed in the surface groove; and wherein the hanger has a second hinge part of the hinge connector, the second hinge part being pivotably secured to the first hinge part with a third hinge part of the hinge connector, such that the hanger is pivotably movable between the retracted and extended positions.

3. The paint brush according to claim 2, wherein the second hinge part includes a pivot operatively coupled to a hook portion of the hanger;

wherein the first hinge part includes at least one receiver; and wherein at least one portion of the third hinge part is received by the at least one receiver of the second hinge part to pivotably secure the hanger on the handle.

4. The paint brush according to claim 3, wherein the at least one receiver includes a socket, and wherein the at least one portion of the third hinge part includes a pin that is received in the socket.

5. The paint brush according to claim 4, wherein the pin is frictionally secured in the socket.

6. The paint brush according to claim 3, wherein the pivot is formed as a pivot rod that extends between opposing arms at an end portion of the hanger to form a loop that is pivotably interlinked between the first hinge part and the third hinge part.

7. The paint brush according to claim 6, wherein the third hinge part includes a pair of pins laterally spaced apart and extending from a cross-member portion of the third hinge part; and wherein the first hinge part includes a pair of sockets laterally spaced apart and configured to receive the pair of pins.

8. The paint brush according to claim 1, wherein the surface groove has a shape that corresponds to a shape of the hanger, such that when the hanger is pivotably moved to the retracted position, the hanger is stowed within the surface groove and is flush with an outer surface of the handle having the surface groove.

9. The paint brush according to claim 1, wherein the grip portion is made of a flexible material, and the head portion is made of a rigid polymer material.

10. The paint brush according to claim 1, wherein the surface groove is pre-molded into the grip portion.

11. The paint brush according to claim 1, wherein the head portion is made of a rigid material, and wherein the bristles are attached to the head portion with a ferrule.

12. A display packaging in combination with the paint brush according to claim 1, the display packaging comprising:

a box having sidewalls that enclose a space, the box being configured to at least partially contain the paint brush;

wherein the box includes at least one opening that is configured to permit at least a portion of the hanger to extend therethrough when the hanger is deployed to its extended position.

13. A paint brush comprising:

a handle having a head portion and a grip portion that at least partially overlies the head portion, the grip portion having a surface groove;

bristles operatively attached to the handle; and a hanger hinged to the handle such that the hanger is pivotably movable between a retracted position for stowing the hanger in the surface groove and an extended position for extending the hanger from the surface groove for hanging the paint brush from an object;

wherein the surface groove opens to an edge of the handle, and the hanger when in the retracted position extends to the edge such that a corner of the hanger is accessible at the edge for enabling pivoting of the hanger from the retracted to extended position.

14. A paint brush comprising:

a handle having a surface groove;

bristles operatively attached to the handle; and a hanger hinged to the handle for pivotable movement between a retracted position for stowing the hanger in the surface groove and an extended position for extending the hanger from the surface groove for hanging the paint brush from an object;

wherein the surface groove opens to an edge of the handle, and the hanger when in the retracted position extends to the edge such that a corner of the hanger is exposed at the edge for enabling pivoting of the hanger from the retracted to extended position; and wherein the edge of the handle has a recessed portion having a bottom surface that is formed by a deeper part of the surface groove, such that the bottom surface of the recessed portion is spaced apart from the corner of the hanger when in the retracted position.

15. The paint brush according to claim 14, wherein the handle has opposite front and rear flat sides with the edge connecting respective portions of the flat sides, the surface groove being in the front flat side and extending laterally to open to the edge.

16. The paint brush according to claim 14, wherein the edge of the handle has a curved transition extending from an upper portion of the handle to a lower portion of the handle; and wherein the corner of the hanger is contoured to the curved transition such that the corner of the hanger is flush with the curved transition when the hanger is in the retracted position.

17. The paint brush according to claim 14, wherein the surface groove is formed in a body portion of an insert assembly that forms a portion of the handle.

18. The paint brush according to claim 14, wherein the entirety of the hanger is contained within the groove when in the stowed position; and/or wherein an outer face of the hanger is flush with an outer face of the handle.

19. A paint brush comprising:

a handle having a surface groove;

bristles operatively attached to the handle; and a hanger hinged to the handle for pivotable movement between a retracted position for stowing the hanger in the surface groove and an extended position for extending the hanger from the surface groove for hanging the paint brush from an object;

wherein the surface groove opens to an edge of the handle, and the hanger when in the retracted position extends to the edge such that a corner of the hanger is exposed at the edge for enabling pivoting of the hanger from the retracted to extended position, wherein a curved surface connects the edge of the handle to a front side of the handle having the surface groove, and wherein the corner of the hanger portion is contoured to the curved surface of the handle the such that corner of hanger is flush with the curved surface when the hanger is in the retracted position.

20. A paint brush comprising:

a handle having a surface groove;

bristles operatively attached to the handle; and a hanger hinged to the handle for pivotable movement between a retracted position for stowing the hanger in the surface groove and an extended position for extending the hanger from the surface groove for hanging the paint brush from an object;

wherein the surface groove opens to an edge of the handle, and the hanger when in the retracted position extends to the edge such that a corner of the hanger is exposed at the edge for enabling pivoting of the hanger from the retracted to extended position;

wherein the surface groove is formed in a body portion of an insert assembly that forms a portion of the handle;

wherein the insert assembly is disposed in a notch formed in an edge portion of a major body portion of the handle.

21. The paint brush according to claim 20, wherein the insert assembly is flush with the front, back and edge of the major body portion of the handle.

22. The paint brush according to claim 20, wherein the major body portion is made of wood and the insert assembly is made of plastic.

* * * * *